US011097271B2

(12) United States Patent
Breinlinger et al.

(10) Patent No.: US 11,097,271 B2
(45) Date of Patent: Aug. 24, 2021

(54) ACTUATED MICROFLUIDIC STRUCTURES FOR DIRECTED FLOW IN A MICROFLUIDIC DEVICE AND METHODS OF USE THEREOF

(71) Applicant: Berkeley Lights, Inc., Emeryville, CA (US)

(72) Inventors: Keith J. Breinlinger, San Rafael, CA (US); Andrew W. McFarland, Berkeley, CA (US); J. Tanner Nevill, El Cerrito, CA (US)

(73) Assignee: Berkeley Lights, Inc, Emeryville, CA (US)

( * ) Notice: Subject to any disclaimer, the term of this patent is extended or adjusted under 35 U.S.C. 154(b) by 0 days.

(21) Appl. No.: 16/057,306

(22) Filed: Aug. 7, 2018

(65) Prior Publication Data

US 2019/0083983 A1 Mar. 21, 2019

Related U.S. Application Data

(62) Division of application No. 14/961,868, filed on Dec. 7, 2015, now Pat. No. 10,058,865.
(Continued)

(51) Int. Cl.
*B01L 3/00* (2006.01)
*B01L 3/02* (2006.01)

(52) U.S. Cl.
CPC ..... *B01L 3/502761* (2013.01); *B01L 3/50273* (2013.01); *B01L 3/502715* (2013.01);
(Continued)

(58) Field of Classification Search
CPC ..... B01L 3/502761; B01L 3/502715; B01L 3/50273; B01L 2200/0647;
(Continued)

(56) References Cited

U.S. PATENT DOCUMENTS 6,294,063 B1 9/2001 Becker
6,942,776 B2 9/2005 Medoro
(Continued)

FOREIGN PATENT DOCUMENTS

CN 1369039 A 9/2002
CN 100402850 C 7/2008
(Continued)

OTHER PUBLICATIONS

Chiou et al., Massively Parallel Manipulation of Single Cells and Microparticles Using Optical Images, Nature 436: 370-73 (2005).
(Continued)

*Primary Examiner* — Brian J. Sines
(74) *Attorney, Agent, or Firm* — Kenneth E. Horton; Kirton McConkie

(57) ABSTRACT

A microfluidic device can comprise a plurality of interconnected microfluidic elements. A plurality of actuators can be positioned abutting, immediately adjacent to, and/or attached to deformable surfaces of the microfluidic elements. The actuators can be selectively actuated and de-actuated to create directed flows of a fluidic medium in the microfluidic (or nanofluidic) device. Further, the actuators can be selectively actuated and de-actuated to create localized flows of a fluidic medium in the microfluidic device to move reagents and/or micro-objects in the microfluidic device.

20 Claims, 24 Drawing Sheets

Related U.S. Application Data

(60) Provisional application No. 62/089,065, filed on Dec. 8, 2014.

(52) U.S. Cl.
CPC . *B01L 2200/0647* (2013.01); *B01L 2300/041* (2013.01); *B01L 2300/0816* (2013.01); *B01L 2300/0864* (2013.01); *B01L 2300/0877* (2013.01); *B01L 2300/0883* (2013.01); *B01L 2300/0887* (2013.01); *B01L 2300/12* (2013.01); *B01L 2400/0475* (2013.01); *B01L 2400/0481* (2013.01)

(58) Field of Classification Search
CPC ..... B01L 2300/041; B01L 2300/0816; B01L 2300/0864; B01L 2300/0877; B01L 2300/0883; B01L 2300/0887; B01L 2300/12; B01L 2400/0475; B01L 2400/0481; B01L 3/00; B01L 3/02
See application file for complete search history.

(56) References Cited

U.S. PATENT DOCUMENTS

| | | | |
|---|---|---|---|
| 7,090,759 | B1 | 8/2006 | Seul |
| 8,124,015 | B2 | 2/2012 | Diercks et al. |
| 8,289,519 | B2 | 10/2012 | Zare et al. |
| 2003/0008364 | A1 | 1/2003 | Wang |
| 2003/0224528 | A1 | 12/2003 | Chiou |
| 2004/0072278 | A1 | 4/2004 | Chiou |
| 2004/0191789 | A1 | 9/2004 | Manaresi et al. |
| 2005/0112548 | A1 | 5/2005 | Segawa |
| 2005/0173313 | A1 | 8/2005 | Tyvoll et al. |
| 2005/0175981 | A1 | 9/2005 | Voldman |
| 2006/0091015 | A1 | 5/2006 | Lau |
| 2007/0095669 | A1 | 5/2007 | Lau |
| 2007/0183934 | A1 | 8/2007 | Diercks et al. |
| 2008/0302732 | A1 | 12/2008 | Soh |
| 2009/0170186 | A1 | 7/2009 | Wu |
| 2010/0003666 | A1 | 1/2010 | Lee |
| 2010/0101960 | A1 | 4/2010 | Ohta |
| 2011/0003325 | A1 | 1/2011 | Durack |
| 2011/0008818 | A1 | 1/2011 | Durack |
| 2011/0053151 | A1 | 3/2011 | Hansen et al. |
| 2011/0117634 | A1 | 5/2011 | Halamish |
| 2012/0024708 | A1 | 2/2012 | Chiou et al. |
| 2012/0118740 | A1 | 5/2012 | Garcia et al. |
| 2012/0154814 | A1 | 6/2012 | Zare |
| 2012/0184010 | A1 | 7/2012 | Medoro et al. |
| 2012/0325665 | A1 | 12/2012 | Chiou et al. |
| 2013/0115606 | A1 | 5/2013 | Hansen et al. |
| 2013/0118905 | A1 | 5/2013 | Morimoto |
| 2013/0171628 | A1 | 7/2013 | DiCarlo |
| 2013/0190212 | A1 | 7/2013 | Handique |
| 2013/0204076 | A1 | 8/2013 | Han |
| 2013/0261021 | A1 | 10/2013 | Bocchi et al. |
| 2013/0319861 | A1 | 12/2013 | Khandros |
| 2014/0045277 | A1 | 2/2014 | Gordon |
| 2014/0094377 | A1 | 4/2014 | Ayliffe |
| 2014/0116881 | A1* | 5/2014 | Chapman ..... B03C 5/005 204/451 |
| 2015/0151298 | A1* | 6/2015 | Hobbs ..... G01N 33/558 435/7.1 |
| 2015/0151307 | A1 | 6/2015 | Breinlinger |
| 2015/0165436 | A1 | 6/2015 | Chapman |
| 2016/0252495 | A1 | 9/2016 | Ricicova et al. |
| 2017/0081625 | A1* | 3/2017 | Wikswo ..... C12M 41/48 |
| 2017/0355595 | A1* | 12/2017 | Breinlinger ..... B81B 7/02 |

FOREIGN PATENT DOCUMENTS

| | | | |
|---|---|---|---|
| CN | 101896599 | A | 11/2010 |
| CN | 102472701 | A | 5/2012 |
| CN | 102482631 | A | 5/2012 |
| EP | 1065378 | A2 | 1/2011 |
| EP | 2647434 | B1 | 5/2017 |
| NO | 2001001025 | A2 | 1/2001 |
| NO | 2009048878 | A2 | 4/2009 |
| NO | 2012024658 | A2 | 2/2012 |
| WO | 2004089810 | A2 | 10/2004 |
| WO | 2010147078 | A1 | 12/2010 |

OTHER PUBLICATIONS

Nevill et al., Integrated Microfluidic Cell Culture and Lysis on a Chip, Lab on a Chip 7: 1689-95 (2007).

Valley et al., Optoelectronic Tweezers as a Tool for Parallel Single-Cell Manipulation and Stimulation, IEEE Transactions on Biomedical Circuits and Systems 3 (6): 424-30 (2009).

Chung et al., Imaging Single-Cell Signaling Dynamics with a Deterministic High-Density Single-Cell Trap Array, Anal. Chem. 83 (18): 7044-7052 (2011).

The International Search Report and the Written Opinion of the International Searching Authority, PCT Serial No. PCT/US2015/064350 (dated May 30, 2016) 12 pages.

Somaweera et al., Generation of a Chemical Gradient Across an Array of 256 Cell Cultures in a Single Chip, Analyst, Oct. 7, 2013, vol. 138, No. 19, pp. 5566-5571.

* cited by examiner

ACTUATED MICROFLUIDIC STRUCTURES FOR DIRECTED FLOW IN A MICROFLUIDIC DEVICE AND METHODS OF USE THEREOF

CROSS REFERENCE TO RELATED APPLICATION(S)

This application claims a priority benefit under 35 U.S.C. 119(e) of U.S. Provisional Application Ser. No. 62/089,065, filed on Dec. 8, 2014, which is herein incorporated by reference in its entirety.

BACKGROUND

As the field of microfluidics continues to progress, microfluidic devices have become convenient platforms for processing and manipulating micro-objects such as biological cells. Some embodiments of the present invention are directed to improvements in manipulating micro-objects in microfluidic devices.

SUMMARY

In a first aspect a microfluidic system is provided including an actuator; and a microfluidic device having an enclosure, where the enclosure includes a flow region configured to contain a fluidic medium; and at least one chamber configured to contain the fluidic medium, the chamber fluidically connected to the flow region; where the chamber is bounded at least in part by a deformable surface; where the actuator is configured, upon being actuated, to deform the deformable surface, and when the flow region and the chamber are substantially filled with the fluidic medium, deformation of the deformable surface causes a flow of medium between the chamber and the flow region. The flow of medium may be capable of moving a micro-object located within the fluidic medium to a location different from its starting location. The flow of medium may be capable of moving a reagent contained within the fluidic medium to a location different from its starting location. In various embodiments, the flow region may be a channel configured to contain a flow of the fluidic medium. The enclosure may further include an inlet and an outlet. In various embodiments, the inlet and the outlet may be located at opposite ends of the channel.

In various embodiments of the microfluidic device of the system, the chamber may be a sequestration pen, and the sequestration pen may have an isolation region; and a connection region fluidically connecting the isolation region to the channel, where, in the absence of the actuator being actuated, there may be substantially no flow of medium between the channel and the isolation region of the sequestration pen. In some embodiments, the deformable surface may define a wall or a portion thereof of the isolation region. In some embodiments, the isolation region may have a volume of at least $1.0\times10^5$ $\mu m^3$. In various embodiments, the isolation region may have a volume between about $1.0\times10^5$ $\mu m^3$ and $5.0\times10^6$ $\mu m^3$.

In various embodiments of the microfluidic device of the system, the sequestration pen may further include a well region, where the well region may be fluidically connected to the isolation region, and where the deformable surface may define a wall or a portion thereof of the well region. In various embodiments, the well region may have a volume of at least $5.0\times10^5$ $\mu m^3$. In some embodiments, the well region may have a volume between about $5.0\times10^5$ $\mu m^3$ and $2.5\times10^7$ $\mu m^3$. In other embodiments, the well region may have a volume between about $5.0\times10^5$ $\mu m^3$ and $1\times10^8$ $\mu m^3$. The volume of the well region may be at least four times as large as the volume of the isolation region.

In various embodiments of the microfluidic device of the system, the microfluidic device may further include at least one actuatable flow sector, where the actuatable flow sector may have a flow sector connection region, a reservoir, and a plurality of sequestration pens and where, in the absence of the actuator being actuated, there may be substantially no flow of medium between the flow region and the reservoir and the plurality of sequestration pens. Each of the plurality of sequestration pens of the flow sector may have an isolation region; and a connection region fluidically connecting the isolation region to the reservoir. In various embodiments, the actuatable flow sector may further include an actuatable channel between the flow sector connection region and the reservoir, where, in the absence of the actuator being actuated, there is substantially no flow of medium between the actuatable channel and the reservoir. In some embodiments, when the flow sector includes an actuatable channel, each of the plurality of sequestration pens includes an isolation region; and a connection region fluidically connecting the isolation region to the actuatable channel. The deformable surface of the actuatable flow sector may define a wall or a portion thereof of the reservoir. In some embodiments, the volume of the reservoir may be at least 3 times as large as the volume of the actuatable channel. In various embodiments, the reservoir may have a volume of about $1\times10^7$ $\mu m^3$ to about $1\times10^9$ $\mu m^3$, or about $1\times10^8$ $\mu m^3$ to about $1\times10^{10}$ $\mu m^3$. In various embodiments, the microfluidic device may further include a plurality of actuatable flow sectors. Each of the actuatable flow sectors may contain from about 10 sequestration pens to about 100 sequestration pens. In various embodiments, the deformable surface may be pierceable. In some embodiments, the pierceable deformable surface may be self sealing.

In various embodiments of the microfluidic device of the system, the microfluidic device may further include a substantially non-deformable base. In some embodiments, the microfluidic device may have a substantially non-deformable cover. In some embodiments, the cover may include an opening that adjoins the deformable surface of the chamber, the sequestration pen, the isolation region, and/or the well region. In various embodiments, the enclosure of the microfluidic device may include a plurality of deformable surfaces. In various embodiments, the system may include a plurality of actuators. In some embodiments, each actuator of the plurality may be configured to deform a single deformable surface. In some embodiments, each deformable surface may be configured to be deformed by a single actuator. The actuator or each actuator of the plurality may be a microactuator. In some embodiments, the actuator or each of actuator of the plurality may be integrated into the microfluidic device. In some embodiments, the actuator may be a hollow needle. In various embodiments of the microfluidic device of the system, the microfluidic device may further include a controller configured to individually actuate and, optionally, de-actuate, the actuator or each actuator of the plurality. In various embodiments of the microfluidic device of the system, the enclosure contains a volume of about $1\times10^8$ $\mu m^3$ to about $1\times10^{10}$ $\mu m^3$. In other embodiments, the enclosure may contain a volume of about 1 μL to about 1 mL.

In various embodiments of the microfluidic device of the system, the actuator or individual actuators of the plurality may deform the deformable surface or each deformable surface of the plurality by pressing the deformable surface inward. In other embodiments, the actuator or individual actuators of the plurality may deform the deformable surface or each deformable surface of the plurality by pulling the deformable surface outward. In yet other embodiments, the actuator or individual actuators of the plurality may deform the deformable surface or each deformable surface of the plurality by piercing the deformable surface.

In another aspect, a process is provided for moving a micro-object in a microfluidic device, the process including disposing a fluidic medium containing the micro-object in an enclosure within the microfluidic device, where the enclosure may be configured to contain a fluidic medium and includes a flow region and a chamber, the chamber and the flow region are fluidically connected to one another, and the enclosure may be bounded at least in part by a deformable surface; and actuating an actuator to deform the deformable surface at a location proximal to the micro-object, thereby causing a flow of the fluidic medium within the enclosure, where the flow is of sufficient magnitude to move the micro-object from the flow region to the chamber, or from the chamber to the flow region. The microfluidic device may be a component of any one of the microfluidic systems described here. In various embodiments, the flow region may be a channel configured to contain a flow of the fluidic medium.

In some embodiments of the process, the chamber may be an actuatable flow sector including the deformable surface, the actuatable flow sector including a reservoir; a plurality of sequestration pens, each having an isolation region and a connection region where the connection region opens to the reservoir; and a flow sector connection region fluidically connecting the channel to the reservoir; where, in the absence of the actuator being actuated, there is substantially no flow of medium between the channel and the reservoir, and further where the disposing the micro-object includes disposing the micro-object within an isolation region of one of the sequestration pens. In some embodiments, the reservoir may further include an actuatable channel fluidically connecting the reservoir to the flow sector connection region, where, in the absence of the actuator being actuated, there is substantially no flow of medium in said actuatable channel. In some embodiments, when an actuatable channel is present, the connection region of the plurality of sequestration pens may open to the actuatable channel. In various embodiments, the step of actuating may cause a flow of the fluidic medium from the channel into the flow sector. The fluidic medium may be a second fluidic medium containing a first assay reagent.

In other embodiments, the chamber may be a sequestration pen, the sequestration pen including an isolation region; and a connection region fluidically connecting the isolation region to the actuatable channel, where, in the absence of the actuator being actuated, there is substantially no flow of medium between the channel and the isolation region of the sequestration pen. In various embodiments, the step of disposing may include disposing the fluidic medium containing the micro-object in the channel such that the micro-object may be located in the channel, proximal to the connection region of the sequestration pen; and the step of actuating may cause a flow of the fluidic medium from the channel into the isolation region of the sequestration pen, thereby transporting the micro-object from the channel into the isolation region. In some embodiments, the sequestration pen may be bounded at least in part by the deformable surface; and the step of actuating may include the actuator pulling on the deformable surface and thereby increasing the volume of the sequestration pen. In other embodiments, the step of disposing may include loading said micro-object into said isolation region of said sequestration pen. The sequestration pen may be bounded at least in part by the deformable surface; and the step of actuating may include the actuator pressing on the deformable surface and thereby reducing the volume of the sequestration pen. Reducing the volume of the sequestration pen may permit export of the micro-object from the isolation region of the sequestration pen. In various embodiments, the isolation region of the sequestration pen may be bounded at least in part by the deformable surface. The isolation region may further include a well region fluidically connected to the isolation region, and where the well region may be bounded at least in part by the deformable surface.

In various embodiments of the method, the step of actuating may include actuating a plurality of actuators. In some embodiments, the plurality of actuators may be actuated substantially simultaneously. In other embodiments, each actuator of the plurality may contact the deformable surface at a predetermined location proximal to the micro-object, and the plurality of predetermined locations may form a pattern. The pattern may generate a directed flow of fluidic medium such that the micro-object may be moved into or out of the chamber or the sequestration pen. In various embodiments, the plurality of actuators may be actuated sequentially. Each actuator of the plurality may contact the deformable surface at a predetermined location, and the plurality of predetermined locations may form a path from a location which is proximal to the micro-object prior to the actuation, to a location proximal to a predetermined destination for the micro-object. The path may be a linear path.

In various embodiments of the method, the fluidic medium in the flow region or the channel may be a non-aqueous medium; the fluidic medium in the chamber or the sequestration pen may be an aqueous medium; and the micro-object may be contained within the aqueous medium or a droplet of aqueous medium contained within the non-aqueous medium. The non-aqueous medium may be an oil-based medium. In some embodiments, the non-aqueous medium may have a low viscosity.

In another aspect, a method of selectively assaying a micro-object in a microfluidic device is provided, the method including the steps of providing a microfluidic device comprising an enclosure, wherein the enclosure includes a flow region configured to contain a fluidic medium; and a first and a second actuatable flow sector, each fluidically connected to the flow region and configured to contain the fluidic medium; where each of the first and second actuatable flow sectors includes a reservoir bounded at least in part by a deformable surface, and where the first and second actuatable flow sectors further include a respective first and second plurality of sequestration pens; disposing at least one micro-object within an initial fluidic medium into at least one sequestration pen of each of the first and second plurality of sequestration pens; importing a volume of a first fluidic medium containing a first assay reagent into the first actuatable flow sector, where the importing includes deforming the deformable surface of the first actuatable flow sector; importing a volume of a second fluidic medium containing a second assay reagent into the second actuatable flow sector, wherein the importing includes deforming the deformable surface of the second actuatable flow sector; permitting the first assay reagent to diffuse into the first plurality of sequestration pens in the first actuatable flow sector and the second assay reagent to diffuse into the second plurality of sequestration pens in the second actuatable flow sector; detecting a first assay result based upon an interaction between the first assay reagent and the at least one micro-object, or a secretion therefrom, in the at least one sequestration pen of the first plurality of sequestration pens; and detecting a second assay result based upon an interaction between the second assay reagent and the at least one micro-object, or a secretion therefrom, in said at least one sequestration pen of said second plurality of sequestration pens.

In various embodiments, the first assay reagent may be different from the second assay reagent. In some embodiments, the first assay reagent and/or the second assay reagent may include a bead. The microfluidic device may be any component of the microfluidic systems described here. The micro-object may be a biological cell.

In various embodiments of the method, the flow region of the microfluidic device may further include an inlet and an outlet and at least one flow channel there between. In various embodiments of the method, the first and the second actuatable flow sectors may each include a flow sector connection region, where the respective flow sector connection region may fluidically connect each of the first actuatable flow sector and the second actuatable flow sector to the flow region. In various embodiments, the sequestration pens may each include a connection region and an isolation region, and the connection region may further include a proximal opening to the first actuatable flow sector or the second actuatable flow sector and a distal opening to the isolation region. In various embodiments of the method, the first actuatable flow sector and the second actuatable flow sector each further includes a reservoir and an actuatable channel, where the reservoir includes the deformable surface and the actuatable channel connects the reservoir with the flow sector connection region. The first plurality of pens and the second plurality of pens may each open to respective actuatable channels of the first actuatable flow sector and the second actuatable flow sector.

In various embodiments of the method, the step of importing the volume of the first fluidic medium containing the first assay reagent to the first actuatable flow sector may further include substantially replacing the initial fluidic medium in the actuatable channel of the first actuatable flow sector with the first fluidic medium; and the step of importing the volume of the second fluidic medium containing a second assay reagent to the second actuatable flow sector may further include substantially replacing the initial fluidic medium in the actuatable channel of the second actuatable flow sector with the second fluidic medium.

In various embodiments of the method, the step of importing the volume of first fluidic medium into said first actuatable flow sector may include depressing and pulling the deformable surface of said reservoir of said first actuatable flow sector. The step of deforming the deformable surface may include actuating an actuator to deform the deformable surface. In various embodiments, the step of actuating may include the actuator pulling on the deformable surface and thereby increasing a volume of the first actuatable flow sector and/or a volume of the second actuatable flow sector; or may include the actuator pushing on the deformable surface and thereby decreasing the volume of the first actuatable flow sector and/or the volume of the second actuatable flow sector. In various embodiments, the step of deforming a deformable surface of the first actuatable flow sector and the step of deforming a deformable surface of the second actuatable flow sector are performed sequentially. In some embodiments, the step of deforming the deformable surface includes piercing the deformable surface with a hollow needle.

In various embodiments of the method, the method may further include the step of flowing a third fluidic medium though the at least one flow channel after the step of importing the first fluidic medium containing the first assay reagent, thereby clearing the first fluidic medium from the flow channel. In various embodiments of the method, the method may further include the step of flowing the third fluidic medium through the at least one flow channel after the step of importing the second fluidic medium containing the first assay reagent, thereby clearing the second fluidic medium from the flow channel.

In various embodiments of the method, the step of importing the volume of the first fluidic medium containing the first assay reagent to the first actuatable flow sector may include injecting the first fluidic medium through the hollow needle into the first actuatable flow sector; and the step of importing the volume of the second fluidic medium containing the second assay reagent to the second actuatable flow sector may include injecting the second fluidic medium through the hollow needle into the second actuatable flow sector.

In various embodiments of the method, the step of importing the volume of the first fluidic medium to the first actuatable flow sector may further include replacing the initial fluidic medium in the actuatable channel of the first actuatable flow sector and the step of importing the volume of the second fluidic medium to the second actuatable flow sector may further include replacing the initial fluidic medium in the actuatable channel of the second actuatable flow sector.

In various embodiments of the method, the step of importing the volume of the first medium may further include injecting a volume of the first fluidic medium sufficient to replace the initial fluidic medium in the flow sector connection region of the first actuatable flow sector and the step of importing the volume of the second medium may further include injecting a volume of the second fluidic medium sufficient to replace the initial fluidic medium in the flow sector connection region of the second actuatable flow sector. In various embodiments, the step of importing the first fluidic medium to the first actuatable flow sector and the step of importing the second fluidic medium to the second actuatable flow sector may be performed substantially simultaneously.

In another aspect, a microfluidic system is provided, including an actuator; and a microfluidic device including an enclosure, where the enclosure includes a region configured to contain a fluidic medium, the region bounded at least in part by a deformable surface; where the actuator is configured, upon being actuated, to deform the deformable surface, and where, when the region is substantially filled with the fluidic medium, deformation of the deformable surface causes a flow of medium within the region. In various embodiments, the flow of medium may be capable of moving a micro-object located within the fluidic medium to a location different from its starting location in the region.

In various embodiments of the microfluidic system, the enclosure of the microfluidic device may further include an inlet. The enclosure may further include an outlet. The enclosure may further include a substantially non-deformable base. In various embodiments, the enclosure may further include a substantially non-deformable cover. In some embodiments, the cover may include an opening adjacent to or adjoining the deformable surface. In various embodiments, the enclosure may include a plurality of deformable surfaces. In some embodiments, the system may include a plurality of actuators. In some embodiments, each actuator of the plurality may be configured to deform a single deformable surface. Each deformable surface may be configured to be deformed by a single actuator. In various embodiments, the actuator or each actuator of the plurality may be a microactuator. In some embodiments, the actuator or each actuator of the plurality may be integrated into the microfluidic device. In various embodiments of the microfluidic system, the system may include a controller configured to individually actuate and, optionally, de-actuate, the actuator or each actuator of the plurality. In some embodiments, the actuator or individual actuators of the plurality may deform the deformable surface or individual deformable surfaces of the plurality by pressing the deformable surface inward. In other embodiments, the actuator or individual actuators of the plurality may deform the deformable surface or individual deformable surfaces of the plurality by pulling the deformable surface outward.

In various embodiments of the microfluidic system, the region of the enclosure configured to contain the fluidic medium, may contain a volume of about $1\times10^6$ $\mu m^3$ to about $1\times10^8$ $\mu m^3$. In other embodiments, the region may contain a volume of about $1\times10^8$ $\mu m^3$ to about $1\times10^{10}$ $\mu m^3$.

In another aspect, a process of moving a micro-object in a microfluidic device is provided, the process including the steps of disposing a fluidic medium containing the micro-object in an enclosure within the microfluidic device, where the enclosure may include a region configured to contain fluidic media, the region bounded at least in part by a deformable surface; and actuating an actuator to deform the deformable surface at a location proximal to the micro-object and thereby may cause a flow of fluidic medium within the region, where the flow is of sufficient magnitude to move the micro-object to a location within the region that is different than its location prior to actuation of the actuator. The microfluidic device may be any component of the microfluidic systems described here.

In various embodiments, the step of actuating may include actuating a plurality of actuators. In some embodiments, the plurality of actuators may be actuated substantially simultaneously. In various embodiments, each actuator of the plurality may contact the deformable surface at a predetermined location proximal to the micro-object, and the plurality of predetermined locations may form a pattern. The pattern may generate the flow of fluidic medium within the region such that the micro-object may be moved in a predetermined direction.

In other embodiments, the plurality of actuators may be actuated sequentially. Each actuator of the plurality may contact the deformable surface at a predetermined location, and the plurality of predetermined locations may form a path from a location which is proximal to the micro-object prior to the actuation, to a location proximal to a predetermined destination for the micro-object. The path may be a linear path.

In various embodiments of the method, the fluidic medium containing the micro-object may be a non-aqueous medium. The non-aqueous medium may be an oil-based medium. The non-aqueous medium may have a low viscosity. The micro-object may be contained within a droplet of aqueous medium, and the droplet may be contained within the non-aqueous medium.

In various embodiments of any of the methods described here, the micro-object may be a biological cell. In some embodiments, the biological cell may be a mammalian cell. In other embodiments, the biological cell may be a eukaryotic cell, a prokaryotic cell, or a protozoan cell.

DETAILED DESCRIPTION OF EXEMPLARY EMBODIMENTS

Figure 1:
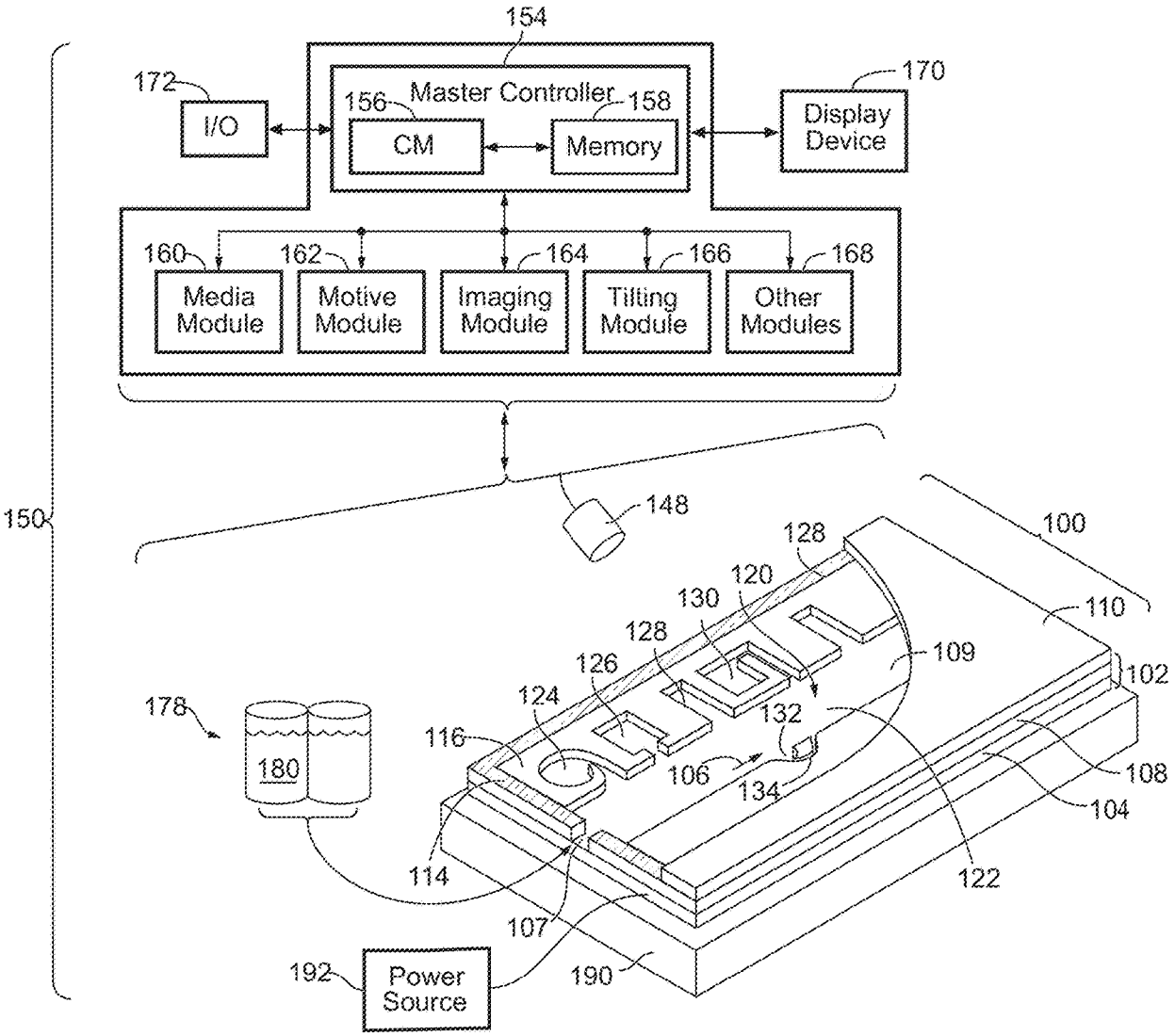
FIG. 1 illustrates an example of a system for use with a microfluidic device and associated control equipment according to some embodiments of the invention.

This specification describes exemplary embodiments and applications of the invention. The invention, however, is not limited to these exemplary embodiments and applications or to the manner in which the exemplary embodiments and applications operate or are described herein. Moreover, the figures may show simplified or partial views, and the dimensions of elements in the figures may be exaggerated or otherwise not in proportion. In addition, as the terms "on," "attached to," "connected to," "coupled to," or similar words are used herein, one element (e.g., a material, a layer, a substrate, etc.) can be "on," "attached to," "connected to," or "coupled to" another element regardless of whether the one element is directly on, attached to, connected to, or coupled to the other element or there are one or more intervening elements between the one element and the other element. In addition, where reference is made to a list of elements (e.g., elements a, b, c), such reference is intended to include any one of the listed elements by itself, any combination of less than all of the listed elements, and/or a combination of all of the listed elements.

Section divisions in the specification are for ease of review only and do not limit any combination of elements discussed.

As used herein, "substantially" means sufficient to work for the intended purpose. The term "substantially" thus allows for minor, insignificant variations from an absolute or perfect state, dimension, measurement, result, or the like such as would be expected by a person of ordinary skill in the field but that do not appreciably affect overall performance. When used with respect to numerical values or parameters or characteristics that can be expressed as numerical values, "substantially" means within ten percent.

As used herein, the term "ones" means more than one. As used herein, the term "plurality" can be 2, 3, 4, 5, 6, 7, 8, 9, 10, or more.

As used herein, the term "disposed" encompasses within its meaning "located."

As used herein, a "microfluidic device" or "microfluidic apparatus" is a device that includes one or more discrete microfluidic circuits configured to hold a fluid, each microfluidic circuit comprised of fluidically interconnected circuit elements, including but not limited to region(s), flow path (s), channel(s), chamber(s), and/or pen(s), and at least two ports configured to allow the fluid (and, optionally, micro-objects suspended in the fluid) to flow into and/or out of the microfluidic device. Typically, a microfluidic circuit of a microfluidic device will include at least one microfluidic channel and at least one chamber, and will hold a volume of fluid of less than about 1 mL, e.g., less than about 750, 500, 250, 200, 150, 100, 75, 50, 25, 20, 15, 10, 9, 8, 7, 6, 5, 4, 3, or 2 μL. In certain embodiments, the microfluidic circuit holds about 1-2, 1-3, 1-4, 1-5, 2-5, 2-8, 2-10, 2-12, 2-15, 2-20, 5-20, 5-30, 5-40, 5-50, 10-50, 10-75, 10-100, 20-100, 20-150, 20-200, 50-200, 50-250, or 50-300 μL.

As used herein, a "nanofluidic device" or "nanofluidic apparatus" is a type of microfluidic device having a microfluidic circuit that contains at least one circuit element configured to hold a volume of fluid of less than about 1 μL, e.g., less than about 750, 500, 250, 200, 150, 100, 75, 50, 25, 20, 15, 10, 9, 8, 7, 6, 5, 4, 3, 2, 1 nL or less. Typically, a nanofluidic device will comprise a plurality of circuit elements (e.g., at least 2, 3, 4, 5, 6, 7, 8, 9, 10, 15, 20, 25, 50, 75, 100, 150, 200, 250, 300, 400, 500, 600, 700, 800, 900, 1000, 1500, 2000, 2500, 3000, 3500, 4000, 4500, 5000, 6000, 7000, 8000, 9000, 10,000, or more). In certain embodiments, one or more (e.g., all) of the at least one circuit elements is configured to hold a volume of fluid of about 100 pL to 1 nL, 100 pL to 2 nL, 100 pL to 5 nL, 250 pL to 2 nL, 250 pL to 5 nL, 250 pL to 10 nL, 500 pL to 5 nL, 500 pL to 10 nL, 500 pL to 15 nL, 750 pL to 10 nL, 750 pL to 15 nL, 750 pL to 20 nL, 1 to 10 nL, 1 to 15 nL, 1 to 20 nL, 1 to 25 nL, or 1 to 50 nL. In other embodiments, one or more (e.g., all) of the at least one circuit elements is configured to hold a volume of fluid of about 100 to 200 nL, 100 to 300 nL, 100 to 400 nL, 100 to 500 nL, 200 to 300 nL, 200 to 400 nL, 200 to 500 nL, 200 to 600 nL, 200 to 700 nL, 250 to 400 nL, 250 to 500 nL, 250 to 600 nL, or 250 to 750 nL.

A "microfluidic channel" or "flow channel" as used herein refers to flow region of a microfluidic device having a length that is significantly longer than both the horizontal and vertical dimensions. For example, the flow channel can be at least 5 times the length of either the horizontal or vertical dimension, e.g., at least 10 times the length, at least 25 times the length, at least 100 times the length, at least 200 times the length, at least 500 times the length, at least 1,000 times the length, at least 5,000 times the length, or longer. In some embodiments, the length of a flow channel is in the range of from about 100,000 microns to about 500,000 microns, including any range therebetween. In some embodiments, the horizontal dimension is in the range of from about 100 microns to about 1000 microns (e.g., about 150 to about 500 microns) and the vertical dimension is in the range of from about 25 microns to about 200 microns, e.g., from about 40 to about 150 microns. It is noted that a flow channel may have a variety of different spatial configurations in a microfluidic device, and thus is not restricted to a perfectly linear element. For example, a flow channel may be, or include one or more sections having, the following configurations: curve, bend, spiral, incline, decline, fork (e.g., multiple different flow paths), and any combination thereof. In addition, a flow channel may have different cross-sectional areas along its path, widening and constricting to provide a desired fluid flow therein.

As used herein, the term "obstruction" refers generally to a bump or similar type of structure that is sufficiently large so as to partially (but not completely) impede movement of target micro-objects between two different regions or circuit elements in a microfluidic device. The two different regions/circuit elements can be, for example, a microfluidic sequestration pen and a microfluidic channel, or a connection region and an isolation region of a microfluidic sequestration pen.

As used herein, the term "constriction" refers generally to a narrowing of a width of a circuit element (or an interface between two circuit elements) in a microfluidic device. The constriction can be located, for example, at the interface between a microfluidic sequestration pen and a microfluidic channel, or at the interface between an isolation region and a connection region of a microfluidic sequestration pen.

As used herein, the term "transparent" refers to a material which allows visible light to pass through without substantially altering the light as is passes through.

As used herein, the term "micro-object" refers generally to any microscopic object that may be isolated and collected in accordance with the present invention. Non-limiting examples of micro-objects include: inanimate micro-objects such as microparticles; microbeads (e.g., polystyrene beads, Luminex™ beads, or the like); magnetic beads; microrods; microwires; quantum dots, and the like; biological micro-objects such as cells (e.g., embryos, oocytes, sperm cells, cells dissociated from a tissue, eukaryotic cells, protist cells, animal cells, mammalian cells, human cells, immunological cells, hybridomas, cultured cells, cells from a cell line, cancer cells, infected cells, transfected and/or transformed cells, reporter cells, prokaryotic cell, and the like); biological organelles; vesicles, or complexes; synthetic vesicles; liposomes (e.g., synthetic or derived from membrane preparations); lipid nanorafts (as described in Ritchie et al. (2009) "Reconstitution of Membrane Proteins in Phospholipid Bilayer Nanodiscs," Methods Enzymol., 464:211-231), and the like; or a combination of inanimate micro-objects and biological micro-objects (e.g., microbeads attached to cells, liposome-coated micro-beads, liposome-coated magnetic beads, or the like). Beads may further have other moieties/molecules covalently or non-covalently attached, such as fluorescent labels, proteins, small molecule signaling moieties, antigens, or chemical/biological species capable of use in an assay.

As used herein, the term "maintaining (a) cell(s)" refers to providing an environment comprising both fluidic and gaseous components and, optionally a surface, that provides the conditions necessary to keep the cells viable and/or expanding.

A "component" of a fluidic medium is any chemical or biochemical molecule present in the medium, including solvent molecules, ions, small molecules, antibiotics, nucleotides and nucleosides, nucleic acids, amino acids, peptides, proteins, sugars, carbohydrates, lipids, fatty acids, cholesterol, metabolites, or the like.

As used herein in reference to a fluidic medium, "diffuse" and "diffusion" refer to thermodynamic movement of a component of the fluidic medium down a concentration gradient.

The phrase "flow of a medium" means bulk movement of a fluidic medium primarily due to any mechanism other than diffusion. For example, flow of a medium can involve movement of the fluidic medium from one point to another point due to a pressure differential between the points. Such flow can include a continuous, pulsed, periodic, random, intermittent, or reciprocating flow of the liquid, or any combination thereof. When one fluidic medium flows into another fluidic medium, turbulence and mixing of the media can result.

The phrase "substantially no flow" refers to a rate of flow of a fluidic medium that, averaged over time, is less than the rate of diffusion of components of a material (e.g., an analyte of interest) into or within the fluidic medium. The rate of diffusion of components of such a material can depend on, for example, temperature, the size of the components, and the strength of interactions between the components and the fluidic medium.

As used herein in reference to different regions within a microfluidic device, the phrase "fluidically connected" means that, when the different regions are substantially filled with fluid, such as fluidic media, the fluid in each of the regions is connected so as to form a single body of fluid. This does not mean that the fluids (or fluidic media) in the different regions are necessarily identical in composition. Rather, the fluids in different fluidically connected regions of a microfluidic device can have different compositions (e.g., different concentrations of solutes, such as proteins, carbohydrates, ions, or other molecules) which are in flux as solutes move down their respective concentration gradients and/or fluids flow through the device.

A microfluidic (or nanofluidic) device can comprise "swept" regions and "unswept" regions. As used herein, a "swept" region is comprised of one or more fluidically interconnected circuit elements of a microfluidic circuit, each of which experiences a flow of medium when fluid is flowing through the microfluidic circuit. The circuit elements of a swept region can include, for example, regions, channels, and all or parts of chambers. As used herein, an "unswept" region is comprised of one or more fluidically interconnected circuit element of a microfluidic circuit, each of which experiences substantially no flux of fluid when fluid is flowing through the microfluidic circuit. An unswept region can be fluidically connected to a swept region, provided the fluidic connections are structured to enable diffusion but substantially no flow of media between the swept region and the unswept region. The microfluidic device can thus be structured to substantially isolate an unswept region from a flow of medium in a swept region, while enabling substantially only diffusive fluidic communication between the swept region and the unswept region. For example, a flow channel of a micro-fluidic device is an example of a swept region while an isolation region (described in further detail below) of a microfluidic device is an example of an unswept region.

As used herein, a "flow path" refers to one or more fluidically connected circuit elements (e.g. channel(s), region(s), chamber(s) and the like) that define, and are subject to, the trajectory of a flow of medium. A flow path is thus an example of a swept region of a microfluidic device. Other circuit elements (e.g., unswept regions) may be fluidically connected with the circuit elements that comprise the flow path without being subject to the flow of medium in the flow path.

A "localized flow" is a flow of medium within a microfluidic device that does not result in the medium exiting the microfluidic device. Examples of a localized flow include a flow of medium within a microfluidic element or between microfluidic elements in the microfluidic device.

As used herein: μm means micrometer, $\mu m^3$ means cubic micrometer, pL means picoliter, nL means nanoliter, and μL (or uL) means microliter.

The capability of biological micro-objects (e.g., biological cells) to produce specific biological materials (e.g., proteins, such as antibodies) can be assayed in such a microfluidic device. In a specific embodiment of an assay, sample material comprising biological micro-objects (e.g., cells) to be assayed for production of an analyte of interest can be loaded into a swept region of the microfluidic device. Ones of the biological micro-objects (e.g., mammalian cells, such as human cells) can be selected for particular characteristics and disposed in unswept regions. The remaining sample material can then be flowed out of the swept region and an assay material flowed into the swept region. Because the selected biological micro-objects are in unswept regions, the selected biological micro-objects are not substantially affected by the flowing out of the remaining sample material or the flowing in of the assay material. The selected biological micro-objects can be allowed to produce the analyte of interest, which can diffuse from the unswept regions into the swept region, where the analyte of interest can react with the assay material to produce localized detectable reactions, each of which can be correlated to a particular unswept region. Any unswept region associated with a detected reaction can be analyzed to determine which, if any, of the biological micro-objects in the unswept region are sufficient producers of the analyte of interest.

Microfluidic Devices and Systems for Operating and Observing Such Devices.

FIG. 1 illustrates an example of a microfluidic device 100 and a system 150 which can be used in the practice of the present invention. A perspective view of the microfluidic device 100 is shown having a partial cut-away of its cover 110 to provide a partial view into the microfluidic device 100. The microfluidic device 100 generally comprises a microfluidic circuit 120 comprising a flow path 106 through which a fluidic medium 180 can flow, optionally carrying one or more micro-objects (not shown) into and/or through the microfluidic circuit 120. Although a single microfluidic circuit 120 is illustrated in FIG. 1, suitable microfluidic devices can include a plurality (e.g., 2 or 3) of such microfluidic circuits. Regardless, the microfluidic device 100 can be configured to be a nanofluidic device. In the embodiment illustrated in FIG. 1, the microfluidic circuit 120 comprises a plurality of microfluidic sequestration pens 124, 126, 128, and 130, each having one or more openings in fluidic communication with flow path 106. As discussed further below, the microfluidic sequestration pens comprise various features and structures that have been optimized for retaining micro-objects in the microfluidic device, such as microfluidic device 100, even when a medium 180 is flowing through the flow path 106. Before turning to the foregoing, however, a brief description of microfluidic device 100 and system 150 is provided.

As generally illustrated in FIG. 1, the microfluidic circuit 120 is defined by an enclosure 102. Although the enclosure 102 can be physically structured in different configurations, in the example shown in FIG. 1 the enclosure 102 is depicted as comprising a support structure 104 (e.g., a base), a microfluidic circuit structure 108, and a cover 110. The support structure 104, microfluidic circuit structure 108, and cover 110 can be attached to each other. For example, the microfluidic circuit structure 108 can be disposed on an inner surface 109 of the support structure 104, and the cover 110 can be disposed over the microfluidic circuit structure 108. Together with the support structure 104 and cover 110, the microfluidic circuit structure 108 can define the elements of the microfluidic circuit 120.

The support structure 104 can be at the bottom and the cover 110 at the top of the microfluidic circuit 120 as illustrated in FIG. 1. Alternatively, the support structure 104 and the cover 110 can be configured in other orientations. For example, the support structure 104 can be at the top and the cover 110 at the bottom of the microfluidic circuit 120. Regardless, there can be one or more ports 107 each comprising a passage into or out of the enclosure 102. Examples of a passage include a valve, a gate, a pass-through hole, or the like. As illustrated, port 107 is a pass-through hole created by a gap in the microfluidic circuit structure 108. However, the port 107 can be situated in other components of the enclosure 102, such as the cover 110. Only one port 107 is illustrated in FIG. 1 but the microfluidic circuit 120 can have two or more ports 107. For example, there can be a first port 107 that functions as an inlet for fluid entering the microfluidic circuit 120, and there can be a second port 107 that functions as an outlet for fluid exiting the microfluidic circuit 120. Whether a port 107 function as an inlet or an outlet can depend upon the direction that fluid flows through flow path 106.

The support structure 104 can comprise one or more electrodes (not shown) and a substrate or a plurality of interconnected substrates. For example, the support structure 104 can comprise one or more semiconductor substrates, each of which is electrically connected to an electrode (e.g., all or a subset of the semiconductor substrates can be electrically connected to a single electrode). The support structure 104 can further comprise a printed circuit board assembly ("PCBA"). For example, the semiconductor substrate(s) can be mounted on a PCBA.

The microfluidic circuit structure 108 can define circuit elements of the microfluidic circuit 120. Such circuit elements can comprise spaces or regions that can be fluidly interconnected when microfluidic circuit 120 is filled with fluid, such as flow channels, chambers, pens, traps, and the like. In the microfluidic circuit 120 illustrated in FIG. 1, the microfluidic circuit structure 108 comprises a frame 114 and a microfluidic circuit material 116. The frame 114 can partially or completely enclose the microfluidic circuit material 116. The frame 114 can be, for example, a relatively rigid structure substantially surrounding the microfluidic circuit material 116. For example the frame 114 can comprise a metal material.

The microfluidic circuit material 116 can be patterned with cavities or the like to define circuit elements and interconnections of the microfluidic circuit 120. The microfluidic circuit material 116 can comprise a flexible material, such as a flexible polymer (e.g. rubber, plastic, elastomer, silicone, polydimethylsiloxane ("PDMS"), or the like), which can be gas permeable. Other examples of materials that can compose microfluidic circuit material 116 include molded glass, an etchable material such as silicone (e.g. photo-patternable silicone), photo-resist (e.g., SU8), or the like. In some embodiments, such materials—and thus the microfluidic circuit material 116—can be rigid and/or substantially impermeable to gas. Regardless, microfluidic circuit material 116 can be disposed on the support structure 104 and inside the frame 114.

The cover 110 can be an integral part of the frame 114 and/or the microfluidic circuit material 116. Alternatively, the cover 110 can be a structurally distinct element, as illustrated in FIG. 1. The cover 110 can comprise the same or different materials than the frame 114 and/or the microfluidic circuit material 116. Similarly, the support structure 104 can be a separate structure from the frame 114 or microfluidic circuit material 116 as illustrated, or an integral part of the frame 114 or microfluidic circuit material 116. Likewise the frame 114 and microfluidic circuit material 116 can be separate structures as shown in FIG. 1 or integral portions of the same structure.

In some embodiments, the cover 110 can comprise a rigid material. The rigid material may be glass or a material with similar properties. In some embodiments, the cover 110 can comprise a deformable material. The deformable material can be a polymer, such as PDMS. In some embodiments, the cover 110 can comprise both rigid and deformable materials. For example, one or more portions of cover 110 (e.g., one or more portions positioned over sequestration pens 124, 126, 128, 130) can comprise a deformable material that interfaces with rigid materials of the cover 110. In some embodiments, the cover 110 can further include one or more electrodes. The one or more electrodes can comprise a conductive oxide, such as indium-tin-oxide (ITO), which may be coated on glass or any similarly insulating material. Alternatively, the one or more electrodes can be flexible electrodes, such as single-walled nanotubes, multi-walled nanotubes, nanowires, clusters of electrically conductive nanoparticles, or combinations thereof, embedded in a deformable material, such as a polymer (e.g., PDMS). Flexible electrodes that can be used in microfluidic devices have been described, for example, in U.S. 2012/0325665 (Chiou et al.), the contents of which are incorporated herein by reference. In some embodiments, the cover 110 can be modified (e.g., by conditioning all or part of a surface that faces inward toward the microfluidic circuit 120) to support cell adhesion, viability and/or growth. The modification may include a coating of a synthetic or natural polymer. In some embodiments, the cover 110 and/or the support structure 104 can be transparent to light. The cover 110 may also include at least one material that is gas permeable (e.g., PDMS or PPS).

FIG. 1 also shows a system 150 for operating and controlling microfluidic devices, such as microfluidic device 100. System 150, as illustrated, includes an electrical power source 192, an imaging device 194, and a tilting device 190.

The electrical power source 192 can provide electric power to the microfluidic device 100 and/or tilting device 190, providing biasing voltages or currents as needed. The electrical power source 192 can, for example, comprise one or more alternating current (AC) and/or direct current (DC) voltage or current sources. The imaging device 194 can comprise a device, such as a digital camera, for capturing images inside microfluidic circuit 120. In some instances, the imaging device 194 further comprises a detector having a fast frame rate and/or high sensitivity (e.g. for low light applications). The imaging device 194 can also include a mechanism for directing stimulating radiation and/or light beams into the microfluidic circuit 120 and collecting radiation and/or light beams reflected or emitted from the microfluidic circuit 120 (or micro-objects contained therein). The emitted light beams may be in the visible spectrum and may, e.g., include fluorescent emissions. The reflected light beams may include reflected emissions originating from an LED or a wide spectrum lamp, such as a mercury lamp (e.g. a high pressure mercury lamp) or a Xenon arc lamp. As discussed with respect to FIG. 3, the imaging device 194 may further include a microscope (or an optical train), which may or may not include an eyepiece.

System 150 further comprises a tilting device 190 configured to rotate a microfluidic device 100 about one or more axes of rotation. In some embodiments, the tilting device 190 is configured to support and/or hold the enclosure 102 comprising the microfluidic circuit 120 about at least one axis such that the microfluidic device 100 (and thus the microfluidic circuit 120) can be held in a level orientation (i.e. at 0° relative to x- and y-axes), a vertical orientation (i.e. at 90° relative to the x-axis and/or the y-axis), or any orientation therebetween. The orientation of the microfluidic device 100 (and the microfluidic circuit 120) relative to an axis is referred to herein as the "tilt" of the microfluidic device 100 (and the microfluidic circuit 120). For example, the tilting device 190 can tilt the microfluidic device 100 at 0.1°, 0.2°, 0.3°, 0.4°, 0.5°, 0.6°, 0.7°, 0.8°, 0.9°, 1°, 2°, 3°, 4°, 5°, 10°, 15°, 20°, 25°, 30°, 35°, 40°, 45°, 50°, 55°, 60°, 65°, 70°, 75°, 80°, 90° relative to the x-axis or any degree therebetween. The level orientation (and thus the x- and y-axes) is defined as normal to a vertical axis defined by the force of gravity. The tilting device can also tilt the microfluidic device 100 (and the microfluidic circuit 120) to any degree greater than 90° relative to the x-axis and/or y-axis, or tilt the microfluidic device 100 (and the microfluidic circuit 120) 180° relative to the x-axis or the y-axis in order to fully invert the microfluidic device 100 (and the microfluidic circuit 120). Similarly, in some embodiments, the tilting device 190 tilts the microfluidic device 100 (and the microfluidic circuit 120) about an axis of rotation defined by flow path 106 or some other portion of microfluidic circuit 120.

In some instances, the microfluidic device 100 is tilted into a vertical orientation such that the flow path 106 is positioned above or below one or more sequestration pens. The term "above" as used herein denotes that the flow path 106 is positioned higher than the one or more sequestration pens on a vertical axis defined by the force of gravity (i.e. an object in a sequestration pen above a flow path 106 would have a higher gravitational potential energy than an object in the flow path). The term "below" as used herein denotes that the flow path 106 is positioned lower than the one or more sequestration pens on a vertical axis defined by the force of gravity (i.e. an object in a sequestration pen below a flow path 106 would have a lower gravitational potential energy than an object in the flow path).

In some instances, the tilting device 190 tilts the microfluidic device 100 about an axis that is parallel to the flow path 106. Moreover, the microfluidic device 100 can be tilted to an angle of less than 90° such that the flow path 106 is located above or below one or more sequestration pens without being located directly above or below the sequestration pens. In other instances, the tilting device 190 tilts the microfluidic device 100 about an axis perpendicular to the flow path 106. In still other instances, the tilting device 190 tilts the microfluidic device 100 about an axis that is neither parallel nor perpendicular to the flow path 106.

System 150 can further include a media source 178. The media source 178 (e.g., a container, reservoir, or the like) can comprise multiple sections or containers, each for holding a different fluidic medium 180. Thus, the media source 178 can be a device that is outside of and separate from the microfluidic device 100, as illustrated in FIG. 1. Alternatively, the media source 178 can be located in whole or in part inside the enclosure 102 of the microfluidic device 100. For example, the media source 178 can comprise reservoirs that are part of the microfluidic device 100.

FIG. 1 also illustrates simplified block diagram depictions of examples of control and monitoring equipment 152 that constitute part of system 150 and can be utilized in conjunction with a microfluidic device 100. As shown, examples of such control and monitoring equipment 152 include a master controller 154 comprising a media module 160 for controlling the media source 178, a motive module 162 for controlling movement and/or selection of micro-objects (not shown) and/or medium (e.g., droplets of medium) in the microfluidic circuit 120, an imaging module 164 for controlling an imaging device 194 (e.g., a camera, microscope, light source or any combination thereof) for capturing images (e.g., digital images), and a tilting module 166 for controlling a tilting device 190. The control equipment 152 can also include other modules 168 for controlling, monitoring, or performing other functions with respect to the microfluidic device 100. As shown, the equipment 152 can further include a display device 170 and an input/output device 172.

The master controller 154 can comprise a control module 156 and a digital memory 158. The control module 156 can comprise, for example, a digital processor configured to operate in accordance with machine executable instructions (e.g., software, firmware, source code, or the like) stored as non-transitory data or signals in the memory 158. Alternatively or in addition, the control module 156 can comprise hardwired digital circuitry and/or analog circuitry. The media module 160, motive module 162, imaging module 164, tilting module 166, and/or other modules 168 can be similarly configured. Thus, functions, processes acts, actions, or steps of a process discussed herein as being performed with respect to the microfluidic device 100 or any other microfluidic apparatus can be performed by any one or more of the master controller 154, media module 160, motive module 162, imaging module 164, tilting module 166, and/or other modules 168 configured as discussed above. Similarly, the master controller 154, media module 160, motive module 162, imaging module 164, tilting module 166, and/or other modules 168 may be communicatively coupled to transmit and receive data used in any function, process, act, action or step discussed herein.

The media module 160 controls the media source 178. For example, the media module 160 can control the media source 178 to input a selected fluidic medium 180 into the enclosure 102 (e.g., through an inlet port 107). The media module 160 can also control removal of media from the enclosure 102 (e.g., through an outlet port (not shown)). One or more media can thus be selectively input into and removed from the microfluidic circuit 120. The media module 160 can also control the flow of fluidic medium 180 in the flow path 106 inside the microfluidic circuit 120. For example, in some embodiments media module 160 stops the flow of media 180 in the flow path 106 and through the enclosure 102 prior to the tilting module 166 causing the tilting device 190 to tilt the microfluidic device 100 to a desired angle of incline.

The motive module 162 can be configured to control selection, trapping, and movement of micro-objects (not shown) in the microfluidic circuit 120. As discussed below with respect to FIGS. 2A and 2B, the enclosure 102 can comprise a dielectrophoresis (DEP), optoelectronic tweezers (OET) and/or opto-electrowetting (OEW) configuration (not shown in FIG. 1), and the motive module 162 can control the activation of electrodes and/or transistors (e.g., phototransistors) to select and move micro-objects (not shown) and/or droplets of medium (not shown) in the flow path 106 and/or sequestration pens 124, 126, 128, 130.

The imaging module 164 can control the imaging device 194. For example, the imaging module 164 can receive and process image data from the imaging device 194. Image data from the imaging device 194 can comprise any type of information captured by the imaging device 194 (e.g., the presence or absence of micro-objects, droplets of medium, accumulation of label, such as fluorescent label, etc.). Using the information captured by the imaging device 194, the imaging module 164 can further calculate the position of objects (e.g., micro-objects, droplets of medium) and/or the rate of motion of such objects within the microfluidic device 100.

The tilting module 166 can control the tilting motions of tilting device 190. Alternatively or in addition, the tilting module 166 can control the tilting rate and timing to optimize transfer of micro-objects to the one or more sequestration pens via gravitational forces. The tilting module 166 is communicatively coupled with the imaging module 164 to receive data describing the motion of micro-objects and/or droplets of medium in the microfluidic circuit 120. Using this data, the tilting module 166 may adjust the tilt of the microfluidic circuit 120 in order to adjust the rate at which micro-objects and/or droplets of medium move in the microfluidic circuit 120. The tilting module 166 may also use this data to iteratively adjust the position of a micro-object and/or droplet of medium in the microfluidic circuit 120.

In the example shown in FIG. 1, the microfluidic circuit 120 is illustrated as comprising a microfluidic channel 122 and sequestration pens 124, 126, 128, 130. Each pen comprises an opening to channel 122, but otherwise is enclosed such that the pens can substantially isolate micro-objects inside the pen from fluidic medium 180 and/or micro-objects in the flow path 106 of channel 122 or in other pens. In some instances, pens 124, 126, 128, 130 are configured to physically corral one or more micro-objects within the microfluidic circuit 120. Sequestration pens in accordance with the present invention can comprise various shapes, surfaces and features that are optimized for use with DEP, OET, OEW, localized fluidic flow, and/or gravitational forces, as will be discussed and shown in detail below.

The microfluidic circuit 120 may comprise any number of microfluidic sequestration pens. Although five sequestration pens are shown, microfluidic circuit 120 may have fewer or more sequestration pens. Sequestration pens in accordance with the instant invention also include sequestration pens 418 (e.g., of devices 420, 1500, 1700, 1800). As shown, microfluidic sequestration pens 124, 126, 128, and 130 of microfluidic circuit 120 each comprise differing features and shapes which may provide one or more benefits useful in utilizing localized flow to move micro-objects and/or to move fluidic media selectively within the enclosure of a microfluidic device. In some embodiments, the microfluidic circuit 120 comprises a plurality of identical microfluidic sequestration pens. In some embodiments, the microfluidic circuit 120 comprises a plurality of microfluidic sequestration pens, wherein two or more of the sequestration pens comprise differing structures and/or features. For example, the sequestration pens can provide differing benefits with regard to utilizing localized flow to move micro-objects and/or to move fluidic media selectively within the enclosure of a microfluidic device. Microfluidic sequestration pens in accordance with the present invention may be combined with other microfluidic circuit elements described herein to provide optimized localized flow to thereby move a micro-object into or out of a sequestration pen. Alternatively, the sequestration pens may provide selective assay sites within the enclosure of the microfluidic device for multiplex assay within multiple sites minimizing cross contamination between sites.

In the embodiment illustrated in FIG. 1, a single channel 122 and flow path 106 is shown. However, other embodiments may contain multiple channels 122, each configured to comprise a flow path 106. The microfluidic circuit 120 further comprises an inlet valve or port 107 in fluid communication with the flow path 106 and fluidic medium 180, whereby fluidic medium 180 can access channel 122 via the inlet port 107. In some instances, the flow path 106 comprises a single path. In some instances, the single path is arranged in a zigzag pattern whereby the flow path 106 travels across the microfluidic device 100 two or more times in alternating directions.

In some instances, microfluidic circuit 120 comprises a plurality of parallel channels 122 and flow paths 106, wherein the fluidic medium 180 within each flow path 106 flows in the same direction. In some instances, the fluidic medium within each flow path 106 flows in at least one of a forward or reverse direction. In some instances, a plurality of sequestration pens are configured (e.g., relative to a channel 122) such that they can be loaded with target micro-objects in parallel.

In some embodiments, microfluidic circuit 120 further comprises one or more micro-object traps 132. The traps 132 are generally formed in a wall forming the boundary of a channel 122, and may be positioned opposite an opening of one or more of the microfluidic sequestration pens 124, 126, 128, 130. In some embodiments, the traps 132 are configured to receive or capture a single micro-object from the flow path 106. In some embodiments, the traps 132 are configured to receive or capture a plurality of micro-objects from the flow path 106. In some instances, the traps 132 comprise a volume approximately equal to the volume of a single target micro-object.

The traps 132 may further comprise an opening which is configured to assist the flow of targeted micro-objects into the traps 132. In some instances, the traps 132 comprise an opening having a height and width that is approximately equal to the dimensions of a single target micro-object, whereby larger micro-objects are prevented from entering into the micro-object trap. The traps 132 may further comprise other features configured to assist in retention of targeted micro-objects within the trap 132. In some instances, the trap 132 is aligned with and situated on the opposite side of a channel 122 relative to the opening of a microfluidic sequestration pen, such that upon tilting the microfluidic device 100 about an axis parallel to the channel 122, the trapped micro-object exits the trap 132 at a trajectory that causes the micro-object to fall into the opening of the sequestration pen. In some instances, the trap 132 comprises a side passage 134 that is smaller than the target micro-object in order to facilitate flow through the trap 132 and thereby increase the likelihood of capturing a micro-object in the trap 132.

In some embodiments, dielectrophoretic (DEP) forces are applied across the fluidic medium 180 (e.g., in the flow path and/or in the sequestration pens) via one or more electrodes (not shown) to manipulate, transport, separate and sort micro-objects located therein. For example, in some embodiments, DEP forces are applied to one or more portions of microfluidic circuit 120 in order to transfer a single micro-object from the flow path 106 into a desired microfluidic sequestration pen. In some embodiments, DEP forces are used to prevent a micro-object within a sequestration pen (e.g., sequestration pen 124, 126, 128, or 130) from being displaced therefrom. Further, in some embodiments, DEP forces are used to selectively remove a micro-object from a sequestration pen that was previously collected in accordance with the teachings of the instant invention. In some embodiments, the DEP forces comprise optoelectronic tweezer (OET) forces.

In other embodiments, optoelectrowetting (OEW) forces are applied to one or more positions in the support structure 104 (and/or the cover 110) of the microfluidic device 100 (e.g., positions helping to define the flow path and/or the sequestration pens) via one or more electrodes (not shown) to manipulate, transport, separate and sort droplets located in the microfluidic circuit 120. For example, in some embodiments, OEW forces are applied to one or more positions in the support structure 104 (and/or the cover 110) in order to transfer a single droplet from the flow path 106 into a desired microfluidic sequestration pen. In some embodiments, OEW forces are used to prevent a droplet within a sequestration pen (e.g., sequestration pen 124, 126, 128, or 130) from being displaced therefrom. Further, in some embodiments, OEW forces are used to selectively remove a droplet from a sequestration pen that was previously collected in accordance with the teachings of the instant invention.

In some embodiments, DEP and/or OEW forces are combined with other forces, such as flow and/or gravitational force, so as to manipulate, transport, separate and sort micro-objects and/or droplets within the microfluidic circuit 120. For example, the enclosure 102 can be tilted (e.g., by tilting device 190) to position the flow path 106 and micro-objects located therein above the microfluidic sequestration pens, and the force of gravity can transport the micro-objects and/or droplets into the pens. In some embodiments, the DEP and/or OEW forces can be applied prior to the other forces. In other embodiments, the DEP and/or OEW forces can be applied after the other forces. In still other instances, the DEP and/or OEW forces can be applied at the same time as the other forces or in an alternating manner with the other forces.

Figure 2A:
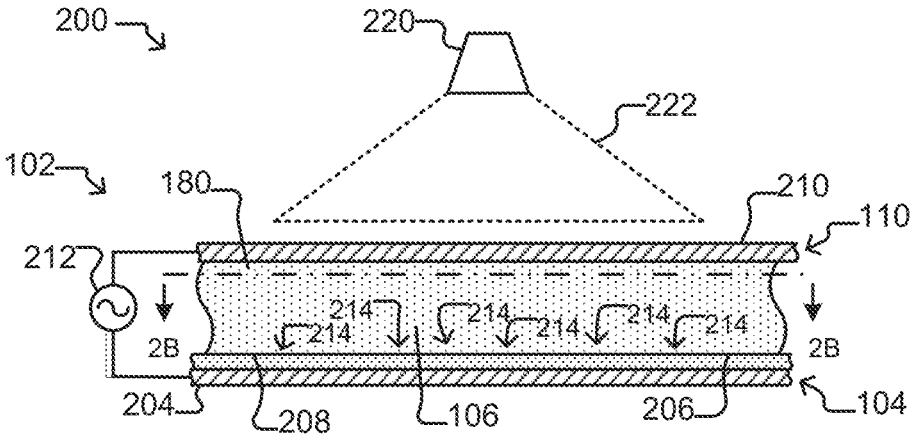
FIGS. 2A and 2B illustrate a microfluidic device according to some embodiments of the invention.

FIGS. 2A-2F illustrates various embodiments of microfluidic devices that can be used in the practice of the present invention. FIG. 2A depicts an embodiment in which the microfluidic device 200 is configured as an optically-actuated electrokinetic device. A variety of optically-actuated electrokinetic devices are known in the art, including devices having an optoelectronic tweezer (OET) configuration and devices having an opto-electrowetting (OEW) configuration. Examples of suitable OET configurations are illustrated in the following U.S. patent documents, each of which is incorporated herein by reference in its entirety: U.S. Pat. No. RE 44,711 (Wu et al.) (originally issued as U.S. Pat. No. 7,612,355); and U.S. Pat. No. 7,956,339 (Ohta et al.). Examples of OEW configurations are illustrated in U.S. Pat. No. 6,958,132 (Chiou et al.) and U.S. Patent Application Publication No. 2012/0024708 (Chiou et al.), both of which are incorporated by reference herein in their entirety. Yet another example of an optically-actuated electrokinetic device includes a combined OET/OEW configuration, examples of which are shown in U.S. Patent Publication Nos. 20150306598 (Khandros et al.) and 20150306599 (Khandros et al.) and their corresponding PCT Publications WO2015/164846 and WO2015/164847, all of which are incorporated herein by reference in their entirety.

Microfluidic Device Motive Configurations.

As described above, the control and monitoring equipment of the system can comprise a motive module for selecting and moving objects, such as micro-objects or droplets, in the microfluidic circuit of a microfluidic device. The microfluidic device can have a variety of motive configurations, depending upon the type of object being moved and other considerations. For example, a dielectrophoresis (DEP) configuration can be utilized to select and move micro-objects in the microfluidic circuit. Thus, the support structure 104 and/or cover 110 of the microfluidic device 100 can comprise a DEP configuration for selectively inducing DEP forces on micro-objects in a fluidic medium 180 in the microfluidic circuit 120 and thereby select, capture, and/or move individual micro-objects or groups of micro-objects. Alternatively, the support structure 104 and/or cover 110 of the microfluidic device 100 can comprise an electrowetting (EW) configuration for selectively inducing EW forces on droplets in a fluidic medium 180 in the microfluidic circuit 120 and thereby select, capture, and/or move individual droplets or groups of droplets.

Figure 2B:
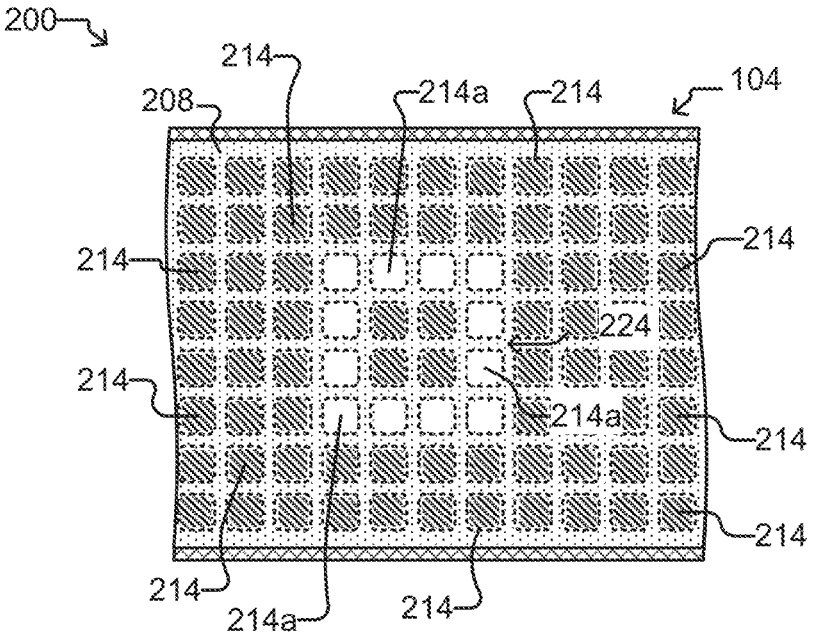

One example of a microfluidic device 200 comprising a DEP configuration is illustrated in FIGS. 2A and 2B. While for purposes of simplicity FIGS. 2A and 2B show a side cross-sectional view and a top cross-sectional view, respectively, of a portion of an enclosure 102 of the microfluidic device 200 having an open region/chamber 202, it should be understood that the region/chamber 202 may be part of a fluidic circuit element having a more detailed structure, such as a growth chamber, a sequestration pen, a flow region, or a flow channel. Furthermore, the microfluidic device 200 may include other fluidic circuit elements. For example, the microfluidic device 200 can include a plurality of growth chambers or sequestration pens and/or one or more flow regions or flow channels, such as those described herein with respect to microfluidic device 100. A DEP configuration may be incorporated into any such fluidic circuit elements of the microfluidic device 200, or select portions thereof. It should be further appreciated that any of the above or below described microfluidic device components and system components may be incorporated in and/or used in combination with the microfluidic device 200. For example, system 150 including control and monitoring equipment 152, described above, may be used with microfluidic device 200, including one or more of the media module 160, motive module 162, imaging module 164, tilting module 166, and other modules 168.

As seen in FIG. 2A, the microfluidic device 200 includes a support structure 104 having a bottom electrode 204 and an electrode activation substrate 206 overlying the bottom electrode 204, and a cover 110 having a top electrode 210, with the top electrode 210 spaced apart from the bottom electrode 204. The top electrode 210 and the electrode activation substrate 206 define opposing surfaces of the region/chamber 202. A medium 180 contained in the region/chamber 202 thus provides a resistive connection between the top electrode 210 and the electrode activation substrate 206. A power source 212 configured to be connected to the bottom electrode 204 and the top electrode 210 and create a biasing voltage between the electrodes, as required for the generation of DEP forces in the region/chamber 202, is also shown. The power source 212 can be, for example, an alternating current (AC) power source.

In certain embodiments, the microfluidic device 200 illustrated in FIGS. 2A and 2B can have an optically-actuated DEP configuration. Accordingly, changing patterns of light 222 from the light source 220, which may be controlled by the motive module 162, can selectively activate and deactivate changing patterns of DEP electrodes at regions 214 of the inner surface 208 of the electrode activation substrate 206. (Hereinafter the regions 214 of a microfluidic device having a DEP configuration are referred to as "DEP electrode regions.") As illustrated in FIG. 2B, a light pattern 222 directed onto the inner surface 208 of the electrode activation substrate 206 can illuminate select DEP electrode regions 214*a* (shown in white) in a pattern, such as a square. The non-illuminated DEP electrode regions 214 (cross-hatched) are hereinafter referred to as "dark" DEP electrode regions 214. The relative electrical impedance through the DEP electrode activation substrate 206 (i.e., from the bottom electrode 204 up to the inner surface 208 of the electrode activation substrate 206 which interfaces with the medium 180 in the flow region 106) is greater than the relative electrical impedance through the medium 180 in the region/chamber 202 (i.e., from the inner surface 208 of the electrode activation substrate 206 to the top electrode 210 of the cover 110) at each dark DEP electrode region 214. An illuminated DEP electrode region 214*a*, however, exhibits a reduced relative impedance through the electrode activation substrate 206 that is less than the relative impedance through the medium 180 in the region/chamber 202 at each illuminated DEP electrode region 214*a*.

With the power source 212 activated, the foregoing DEP configuration creates an electric field gradient in the fluidic medium 180 between illuminated DEP electrode regions 214*a* and adjacent dark DEP electrode regions 214, which in turn creates local DEP forces that attract or repel nearby micro-objects (not shown) in the fluidic medium 180. DEP electrodes that attract or repel micro-objects in the fluidic medium 180 can thus be selectively activated and deactivated at many different such DEP electrode regions 214 at the inner surface 208 of the region/chamber 202 by changing light patterns 222 projected from a light source 220 into the microfluidic device 200. Whether the DEP forces attract or repel nearby micro-objects can depend on such parameters as the frequency of the power source 212 and the dielectric properties of the medium 180 and/or micro-objects (not shown).

The square pattern 224 of illuminated DEP electrode regions 214*a* illustrated in FIG. 2B is an example only. Any pattern of the DEP electrode regions 214 can be illuminated (and thereby activated) by the pattern of light 222 projected into the device 200, and the pattern of illuminated/activated DEP electrode regions 214 can be repeatedly changed by changing or moving the light pattern 222.

In some embodiments, the electrode activation substrate 206 can comprise or consist of a photoconductive material. In such embodiments, the inner surface 208 of the electrode activation substrate 206 can be featureless. For example, the electrode activation substrate 206 can comprise or consist of a layer of hydrogenated amorphous silicon (a-Si:H). The a-Si:H can comprise, for example, about 8% to 40% hydrogen (calculated as 100*the number of hydrogen atoms/the total number of hydrogen and silicon atoms). The layer of a-Si:H can have a thickness of about 500 nm to about 2.0 μm. In such embodiments, the DEP electrode regions 214 can be created anywhere and in any pattern on the inner surface 208 of the electrode activation substrate 208, in accordance with the light pattern 222. The number and pattern of the DEP electrode regions 214 thus need not be fixed, but can correspond to the light pattern 222. Examples of microfluidic devices having a DEP configuration comprising a photoconductive layer such as discussed above have been described, for example, in U.S. Pat. No. RE 44,711 (Wu et al.) (Originally issued as U.S. Pat. No. 7,612,355), the entire contents of which are incorporated herein by reference.

In other embodiments, the electrode activation substrate 206 can comprise a substrate comprising a plurality of doped layers, electrically insulating layers (or regions), and electrically conductive layers that form semiconductor integrated circuits, such as is known in semiconductor fields. For example, the electrode activation substrate 206 can comprise a plurality of phototransistors, including, for example, lateral bipolar phototransistors, each phototransistor corresponding to a DEP electrode region 214. Alternatively, the electrode activation substrate 206 can comprise electrodes (e.g., conductive metal electrodes) controlled by phototransistor switches, with each such electrode corresponding to a DEP electrode region 214. The electrode activation substrate 206 can include a pattern of such phototransistors or phototransistor-controlled electrodes. The pattern, for example, can be an array of substantially square phototransistors or phototransistor-controlled electrodes arranged in rows and columns, such as shown in FIG. 2B. Alternatively, the pattern can be an array of substantially hexagonal phototransistors or phototransistor-controlled electrodes that form a hexagonal lattice. Regardless of the pattern, electric circuit elements can form electrical connections between the DEP electrode regions 214 at the inner surface 208 of the electrode activation substrate 206 and the bottom electrode 210, and those electrical connections (i.e., phototransistors or electrodes) can be selectively activated and deactivated by the light pattern 222. When not activated, each electrical connection can have high impedance such that the relative impedance through the electrode activation substrate 206 (i.e., from the bottom electrode 204 to the inner surface 208 of the electrode activation substrate 206 which interfaces with the medium 180 in the region/chamber 202) is greater than the relative impedance through the medium 180 (i.e., from the inner surface 208 of the electrode activation substrate 206 to the top electrode 210 of the cover 110) at the corresponding DEP electrode region 214. When activated by light in the light pattern 222, however, the relative impedance through the electrode activation substrate 206 is less than the relative impedance through the medium 180 at each illuminated DEP electrode region 214, thereby activating the DEP electrode at the corresponding DEP electrode region 214 as discussed above. DEP electrodes that attract or repel micro-objects (not shown) in the medium 180 can thus be selectively activated and deactivated at many different DEP electrode regions 214 at the inner surface 208 of the electrode activation substrate 206 in the region/chamber 202 in a manner determined by the light pattern 222.

Examples of microfluidic devices having electrode activation substrates that comprise phototransistors have been described, for example, in U.S. Pat. No. 7,956,339 (Ohta et al.) (See, e.g., device 300 illustrated in FIGS. 21 and 22, and descriptions thereof), the entire contents of which are incorporated herein by reference. Examples of microfluidic devices having electrode activation substrates that comprise electrodes controlled by phototransistor switches have been described, for example, in U.S. Patent Publication No. 2014/0124370 (Short et al.) (See, e.g., devices 200, 400, 500, 600, and 900 illustrated throughout the drawings, and descriptions thereof), the entire contents of which are incorporated herein by reference.

In some embodiments of a DEP configured microfluidic device, the top electrode 210 is part of a first wall (or cover 110) of the enclosure 102, and the electrode activation substrate 206 and bottom electrode 204 are part of a second wall (or support structure 104) of the enclosure 102. The region/chamber 202 can be between the first wall and the second wall. In other embodiments, the electrode 210 is part of the second wall (or support structure 104) and one or both of the electrode activation substrate 206 and/or the electrode 210 are part of the first wall (or cover 110). Moreover, the light source 220 can alternatively be used to illuminate the enclosure 102 from below.

With the microfluidic device 200 of FIGS. 2A-2B having a DEP configuration, the motive module 162 can select a micro-object (not shown) in the medium 180 in the region/chamber 202 by projecting a light pattern 222 into the device 200 to activate a first set of one or more DEP electrodes at DEP electrode regions 214*a* of the inner surface 208 of the electrode activation substrate 206 in a pattern (e.g., square pattern 224) that surrounds and captures the micro-object. The motive module 162 can then move the captured micro-object by moving the light pattern 222 relative to the device 200 to activate a second set of one or more DEP electrodes at DEP electrode regions 214. Alternatively, the device 200 can be moved relative to the light pattern 222.

In other embodiments, the microfluidic device 200 can have a DEP configuration that does not rely upon light activation of DEP electrodes at the inner surface 208 of the electrode activation substrate 206. For example, the electrode activation substrate 206 can comprise selectively addressable and energizable electrodes positioned opposite to a surface including at least one electrode (e.g., cover 110). Switches (e.g., transistor switches in a semiconductor substrate) may be selectively opened and closed to activate or inactivate DEP electrodes at DEP electrode regions 214, thereby creating a net DEP force on a micro-object (not shown) in region/chamber 202 in the vicinity of the activated DEP electrodes. Depending on such characteristics as the frequency of the power source 212 and the dielectric properties of the medium (not shown) and/or micro-objects in the region/chamber 202, the DEP force can attract or repel a nearby micro-object. By selectively activating and deactivating a set of DEP electrodes (e.g., at a set of DEP electrodes regions 214 that forms a square pattern 224), one or more micro-objects in region/chamber 202 can be trapped and moved within the region/chamber 202. The motive module 162 in FIG. 1 can control such switches and thus activate and deactivate individual ones of the DEP electrodes to select, trap, and move particular micro-objects (not shown) around the region/chamber 202. Microfluidic devices having a DEP configuration that includes selectively addressable and energizable electrodes are known in the art and have been described, for example, in U.S. Pat. No. 6,294,063 (Becker et al.) and U.S. Pat. No. 6,942,776 (Medoro), the entire contents of which are incorporated herein by reference.

As yet another example, the microfluidic device 200 can have an electrowetting (EW) configuration, which can be in place of the DEP configuration or can be located in a portion of the microfluidic device 200 that is separate from the portion which has the DEP configuration. The EW configuration can be an opto-electrowetting configuration or an electrowetting on dielectric (EWOD) configuration, both of which are known in the art. In some EW configurations, the support structure 104 has an electrode activation substrate 206 sandwiched between a dielectric layer (not shown) and the bottom electrode 204. The dielectric layer can comprise a hydrophobic material and/or can be coated with a hydrophobic material. For microfluidic devices 200 that have an EW configuration, the inner surface 208 of the support structure 104 is the inner surface of the dielectric layer or its hydrophobic coating.

The dielectric layer (not shown) can comprise one or more oxide layers, and can have a thickness of about 50 nm to about 250 nm (e.g., about 125 nm to about 175 nm). In certain embodiments, the dielectric layer may comprise a layer of oxide, such as a metal oxide (e.g., aluminum oxide or hafnium oxide). In certain embodiments, the dielectric layer can comprise a dielectric material other than a metal oxide, such as silicon oxide or a nitride. Regardless of the exact composition and thickness, the dielectric layer can have an impedance of about 10 kOhms to about 50 kOhms.

In some embodiments, the surface of the dielectric layer that faces inward toward region/chamber 202 is coated with a hydrophobic material. The hydrophobic material can comprise, for example, fluorinated carbon molecules. Examples of fluorinated carbon molecules include perfluoro-polymers such as polytetrafluoroethylene (e.g., TEFLON®) or poly (2,3-difluoromethylenyl-perfluorotetrahydrofuran) (e.g., CYTOP™). Molecules that make up the hydrophobic material can be covalently bonded to the surface of the dielectric layer. For example, molecules of the hydrophobic material can be covalently bound to the surface of the dielectric layer by means of a linker, such as a siloxane group, a phosphonic acid group, or a thiol group. Thus, in some embodiments, the hydrophobic material can comprise alkyl-terminated siloxane, alkyl-termination phosphonic acid, or alkyl-terminated thiol. The alkyl group can be long-chain hydrocarbons (e.g., having a chain of at least 10 carbons, or at least 16, 18, 20, 22, or more carbons). Alternatively, fluorinated (or perfluorinated) carbon chains can be used in place of the alkyl groups. Thus, for example, the hydrophobic material can comprise fluoroalkyl-terminated siloxane, fluoroalkyl-terminated phosphonic acid, or fluoroalkyl-terminated thiol. In some embodiments, the hydrophobic coating has a thickness of about 10 nm to about 50 nm. In other embodiments, the hydrophobic coating has a thickness of less than 10 nm (e.g., less than 5 nm, or about 1.5 to 3.0 nm).

In some embodiments, the cover 110 of a microfluidic device 200 having an electrowetting configuration is coated with a hydrophobic material (not shown) as well. The hydrophobic material can be the same hydrophobic material used to coat the dielectric layer of the support structure 104, and the hydrophobic coating can have a thickness that is substantially the same as the thickness of the hydrophobic coating on the dielectric layer of the support structure 104. Moreover, the cover 110 can comprise an electrode activation substrate 206 sandwiched between a dielectric layer and the top electrode 210, in the manner of the support structure 104. The electrode activation substrate 206 and the dielectric layer of the cover 110 can have the same composition and/or dimensions as the electrode activation substrate 206 and the dielectric layer of the support structure 104. Thus, the microfluidic device 200 can have two electrowetting surfaces.

In some embodiments, the electrode activation substrate 206 can comprise a photoconductive material, such as described above. Accordingly, in certain embodiments, the electrode activation substrate 206 can comprise or consist of a layer of hydrogenated amorphous silicon (a-Si:H). The a-Si:H can comprise, for example, about 8% to 40% hydrogen (calculated as 100*(the number of hydrogen atoms)/(the total number of hydrogen and silicon atoms)). The layer of a-Si:H can have a thickness of about 500 nm to about 2.0 μm. Alternatively, the electrode activation substrate 206 can comprise electrodes (e.g., conductive metal electrodes) controlled by phototransistor switches, as described above. Microfluidic devices having an opto-electrowetting configuration are known in the art and/or can be constructed with electrode activation substrates known in the art. For example, U.S. Pat. No. 6,958,132 (Chiou et al.), the entire contents of which are incorporated herein by reference, discloses opto-electrowetting configurations having a photoconductive material such as a-Si:H, while U.S. Patent Publication No. 2014/0124370 (Short et al.), referenced above, discloses electrode activation substrates having electrodes controlled by phototransistor switches.

The microfluidic device 200 thus can have an opto-electrowetting configuration, and light patterns 222 can be used to activate photoconductive EW regions or photoresponsive EW electrodes in the electrode activation substrate 206. Such activated EW regions or EW electrodes of the electrode activation substrate 206 can generate an electrowetting force at the inner surface 208 of the support structure 104 (i.e., the inner surface of the overlaying dielectric layer or its hydrophobic coating). By changing the light patterns 222 (or moving microfluidic device 200 relative to the light source 220) incident on the electrode activation substrate 206, droplets (e.g., containing an aqueous medium, solution, or solvent) contacting the inner surface 208 of the support structure 104 can be moved through an immiscible fluid (e.g., an oil medium) present in the region/chamber 202.

In other embodiments, microfluidic devices 200 can have an EWOD configuration, and the electrode activation substrate 206 can comprise selectively addressable and energizable electrodes that do not rely upon light for activation. The electrode activation substrate 206 thus can include a pattern of such electrowetting (EW) electrodes. The pattern, for example, can be an array of substantially square EW electrodes arranged in rows and columns, such as shown in FIG. 2B. Alternatively, the pattern can be an array of substantially hexagonal EW electrodes that form a hexagonal lattice. Regardless of the pattern, the EW electrodes can be selectively activated (or deactivated) by electrical switches (e.g., transistor switches in a semiconductor substrate). By selectively activating and deactivating EW electrodes in the electrode activation substrate 206, droplets (not shown) contacting the inner surface 208 of the overlaying dielectric layer or its hydrophobic coating can be moved within the region/chamber 202. The motive module 162 in FIG. 1 can control such switches and thus activate and deactivate individual EW electrodes to select and move particular droplets around region/chamber 202. Microfluidic devices having a EWOD configuration with selectively addressable and energizable electrodes are known in the art and have been described, for example, in U.S. Pat. No. 8,685,344 (Sundarsan et al.), the entire contents of which are incorporated herein by reference.

Regardless of the configuration of the microfluidic device 200, a power source 212 can be used to provide a potential (e.g., an AC voltage potential) that powers the electrical circuits of the microfluidic device 200. The power source 212 can be the same as, or a component of, the power source 192 referenced in FIG. 1. Power source 212 can be configured to provide an AC voltage and/or current to the top electrode 210 and the bottom electrode 204. For an AC voltage, the power source 212 can provide a frequency range and an average or peak power (e.g., voltage or current) range sufficient to generate net DEP forces (or electrowetting forces) strong enough to trap and move individual microobjects (not shown) in the region/chamber 202, as discussed above, and/or to change the wetting properties of the inner surface 208 of the support structure 104 (i.e., the dielectric layer and/or the hydrophobic coating on the dielectric layer) in the region/chamber 202, as also discussed above. Such frequency ranges and average or peak power ranges are known in the art. See, e.g., U.S. Pat. No. 6,958,132 (Chiou et al.), U.S. Pat. No. RE44,711 (Wu et al.) (originally issued as U.S. Pat. No. 7,612,355), and US Patent Publication Nos. 2014/0124370 (Short et al.), 2015/0306598 (Khandros et al.), and 20150306599 (Khandros et al.).

Sequestration Pens.

Figure 2C:
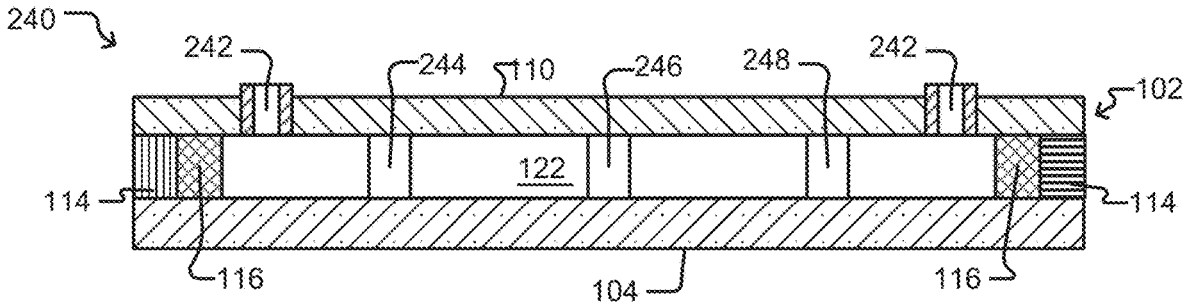
FIGS. 2C and 2D illustrate sequestration pens according to some embodiments of the invention.
Figure 2D:
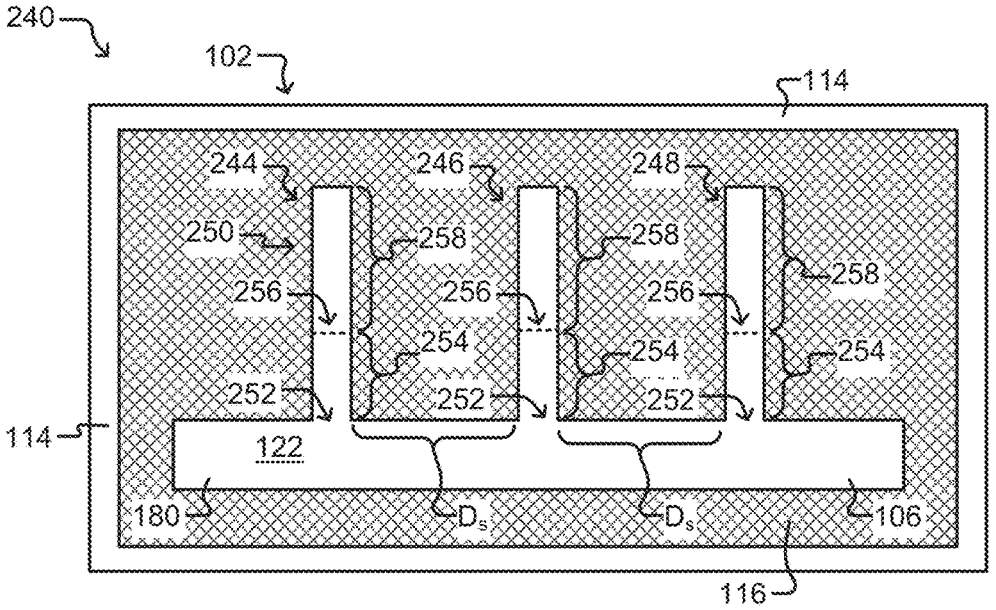

Non-limiting examples of generic sequestration pens 244, 246, and 248 are shown within the microfluidic device 240 depicted in FIGS. 2C and 2D. Each sequestration pen 244, 246, and 248 can comprise an isolation structure 250 defining an isolation region 258 and a connection region 254 fluidically connecting the isolation region 258 to a channel 122. The connection region 254 can comprise a proximal opening 252 to the channel 122 and a distal opening 256 to the isolation region 258. The connection region 254 can be configured so that the maximum penetration depth of a flow of a fluidic medium (not shown) flowing from the channel 122 into the sequestration pen 244, 246, 248 does not extend into the isolation region 258. Thus, due to the connection region 254, a micro-object (not shown) or other material (not shown) disposed in an isolation region 258 of a sequestration pen 244, 246, 248 can thus be isolated from, and not substantially affected by, a flow of medium 180 in the channel 122.

The channel 122 can thus be an example of a swept region, and the isolation regions 258 of the sequestration pens 244, 246, 248 can be examples of unswept regions. As noted, the channel 122 and sequestration pens 244, 246, 248 can be configured to contain one or more fluidic media 180. In the example shown in FIGS. 2C-2D, the ports 242 are connected to the channel 122 and allow a fluidic medium 180 to be introduced into or removed from the microfluidic device 240. Prior to introduction of the fluidic medium 180, the microfluidic device may be primed with a gas such as carbon dioxide gas. Once the microfluidic device 240 contains the fluidic medium 180, the flow 260 of fluidic medium 180 in the channel 122 can be selectively generated and stopped. For example, as shown, the ports 242 can be disposed at different locations (e.g., opposite ends) of the channel 122, and a flow 260 of medium can be created from one port 242 functioning as an inlet to another port 242 functioning as an outlet.

Figure 2E:
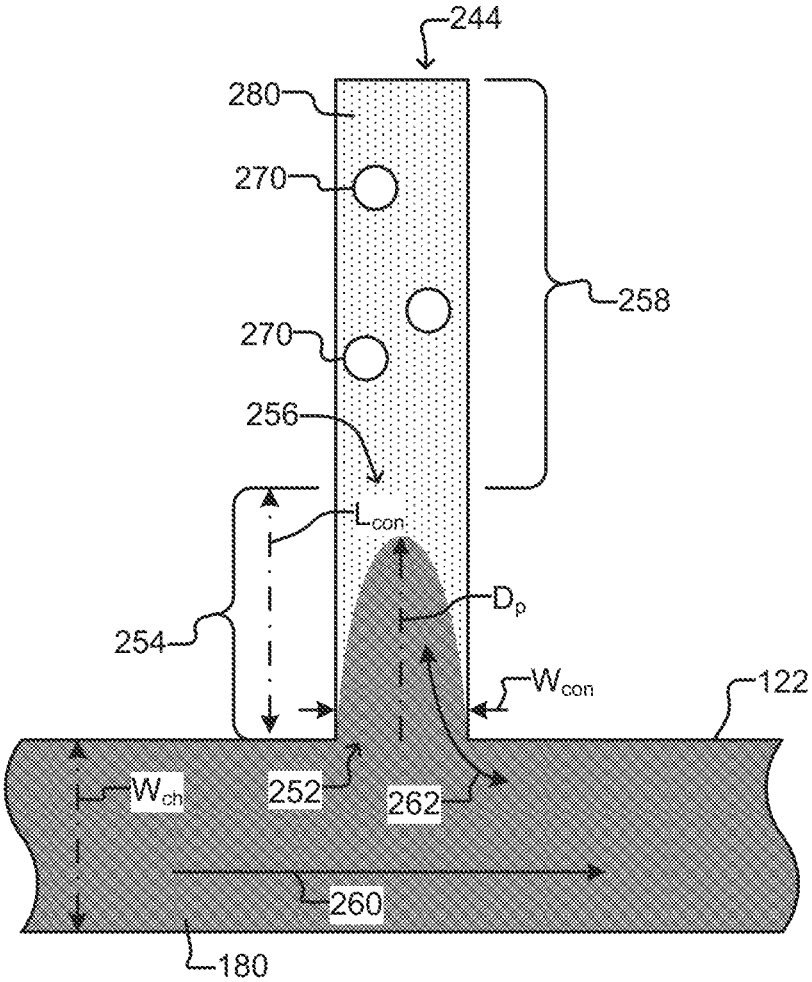
FIG. 2E illustrates a detailed sequestration pen according to some embodiments of the invention.

FIG. 2E illustrates a detailed view of an example of a sequestration pen 244 according to the present invention. Examples of micro-objects 270 are also shown.

As is known, a flow 260 of fluidic medium 180 in a microfluidic channel 122 past a proximal opening 252 of sequestration pen 244 can cause a secondary flow 262 of the medium 180 into and/or out of the sequestration pen 244. To isolate micro-objects 270 in the isolation region 258 of a sequestration pen 244 from the secondary flow 262, the length $L_{con}$ of the connection region 254 of the sequestration pen 244 (i.e., from the proximal opening 252 to the distal opening 256) should be greater than the penetration depth $D_p$ of the secondary flow 262 into the connection region 254. The penetration depth $D_p$ of the secondary flow 262 depends upon the velocity of the fluidic medium 180 flowing in the channel 122 and various parameters relating to the configuration of the channel 122 and the proximal opening 252 of the connection region 254 to the channel 122. For a given microfluidic device, the configurations of the channel 122 and the opening 252 will be fixed, whereas the rate of flow 260 of fluidic medium 180 in the channel 122 will be variable. Accordingly, for each sequestration pen 244, a maximal velocity $V_{max}$ for the flow 260 of fluidic medium 180 in channel 122 can be identified that ensures that the penetration depth $D_p$ of the secondary flow 262 does not exceed the length $L_{con}$ of the connection region 254. As long as the rate of the flow 260 of fluidic medium 180 in the channel 122 does not exceed the maximum velocity $V_{max}$, the resulting secondary flow 262 can be limited to the channel 122 and the connection region 254 and kept out of the isolation region 258. The flow 260 of medium 180 in the channel 122 will thus not draw micro-objects 270 out of the isolation region 258. Rather, micro-objects 270 located in the isolation region 258 will stay in the isolation region 258 regardless of the flow 260 of fluidic medium 180 in the channel 122.

Moreover, as long as the rate of flow 260 of medium 180 in the channel 122 does not exceed $V_{max}$, the flow 260 of fluidic medium 180 in the channel 122 will not move miscellaneous particles (e.g., microparticles and/or nanoparticles) from the channel 122 into the isolation region 258 of a sequestration pen 244. Having the length $L_{con}$ of the connection region 254 be greater than the maximum penetration depth $D_p$ of the secondary flow 262 can thus prevent contamination of one sequestration pen 244 with miscellaneous particles from the channel 122 or another sequestration pen (e.g., sequestration pens 246, 248 in FIG. 2D).

Because the channel 122 and the connection regions 254 of the sequestration pens 244, 246, 248 can be affected by the flow 260 of medium 180 in the channel 122, the channel 122 and connection regions 254 can be deemed swept (or flow) regions of the microfluidic device 240. The isolation regions 258 of the sequestration pens 244, 246, 248, on the other hand, can be deemed unswept (or non-flow) regions. For example, components (not shown) in a first fluidic medium 180 in the channel 122 can mix with a second fluidic medium 280 in the isolation region 258 substantially only by diffusion of components of the first medium 180 from the channel 122 through the connection region 254 and into the second fluidic medium 280 in the isolation region 258. Similarly, components (not shown) of the second medium 280 in the isolation region 258 can mix with the first medium 180 in the channel 122 substantially only by diffusion of components of the second medium 280 from the isolation region 258 through the connection region 254 and into the first medium 180 in the channel 122. The first medium 180 can be the same medium or a different medium than the second medium 280. Moreover, the first medium 180 and the second medium 280 can start out being the same, then become different (e.g., through conditioning of the second medium 280 by one or more cells in the isolation region 258, or by changing the medium 180 flowing through the channel 122).

The maximum penetration depth $D_p$ of the secondary flow 262 caused by the flow 260 of fluidic medium 180 in the channel 122 can depend on a number of parameters, as mentioned above. Examples of such parameters include: the shape of the channel 122 (e.g., the channel can direct medium into the connection region 254, divert medium away from the connection region 254, or direct medium in a direction substantially perpendicular to the proximal opening 252 of the connection region 254 to the channel 122); a width $W_{ch}$ (or cross-sectional area) of the channel 122 at the proximal opening 252; and a width $W_{con}$ (or cross-sectional area) of the connection region 254 at the proximal opening 252; the velocity V of the flow 260 of fluidic medium 180 in the channel 122; the viscosity of the first medium 180 and/or the second medium 280, or the like.

In some embodiments, the dimensions of the channel 122 and sequestration pens 244, 246, 248 can be oriented as follows with respect to the vector of the flow 260 of fluidic medium 180 in the channel 122: the channel width $W_{ch}$ (or cross-sectional area of the channel 122) can be substantially perpendicular to the flow 260 of medium 180; the width $W_{con}$ (or cross-sectional area) of the connection region 254 at opening 252 can be substantially parallel to the flow 260 of medium 180 in the channel 122; and/or the length $L_{con}$ of the connection region can be substantially perpendicular to the flow 260 of medium 180 in the channel 122. The foregoing are examples only, and the relative position of the channel 122 and sequestration pens 244, 246, 248 can be in other orientations with respect to each other.

As illustrated in FIG. 2E, the width $W_{con}$ of the connection region 254 can be uniform from the proximal opening 252 to the distal opening 256. The width $W_{con}$ of the connection region 254 at the distal opening 256 can thus be in any of the ranges identified herein for the width $W_{con}$ of the connection region 254 at the proximal opening 252.

Alternatively, the width $W_{con}$ of the connection region 254 at the distal opening 256 can be larger than the width $W_{con}$ of the connection region 254 at the proximal opening 252.

As illustrated in FIG. 2E, the width of the isolation region 258 at the distal opening 256 can be substantially the same as the width $W_{con}$ of the connection region 254 at the proximal opening 252. The width of the isolation region 258 at the distal opening 256 can thus be in any of the ranges identified herein for the width $W_{con}$ of the connection region 254 at the proximal opening 252. Alternatively, the width of the isolation region 258 at the distal opening 256 can be larger or smaller than the width $W_{con}$ of the connection region 254 at the proximal opening 252. Moreover, the distal opening 256 may be smaller than the proximal opening 252 and the width $W_{con}$ of the connection region 254 may be narrowed between the proximal opening 252 and distal opening 256. For example, the connection region 254 may be narrowed between the proximal opening and the distal opening, using a variety of different geometries (e.g. chamfering the connection region, beveling the connection region). Further, any part or subpart of the connection region 254 may be narrowed (e.g. a portion of the connection region adjacent to the proximal opening 252).

In various embodiments of sequestration pens (e.g. 124, 126, 128, 130, 244, 246 or 248), the isolation region (e.g. 258) is configured to contain a plurality of micro-objects. In other embodiments, the isolation region can be configured to contain only one, two, three, four, five, or a similar relatively small number of micro-objects. Accordingly, the volume of an isolation region can be, for example, at least $3\times10^3$, $6\times10^3$, $9\times10^3$, $1\times10^4$, $2\times10^4$, $4\times10^4$, $8\times10^4$, $1\times10^5$, $2\times10^5$, $4\times10^5$, $8\times10^5$, $1\times10^6$, $2\times10^6$, $4\times10^6$, $6\times10^6$ cubic microns, or more.

In various embodiments of sequestration pens, the width $W_c$h of the channel 122 at a proximal opening (e.g. 252) can be within any of the following ranges: 50-1000 microns, 50-500 microns, 50-400 microns, 50-300 microns, 50-250 microns, 50-200 microns, 50-150 microns, 50-100 microns, 70-500 microns, 70-400 microns, 70-300 microns, 70-250 microns, 70-200 microns, 70-150 microns, 90-400 microns, 90-300 microns, 90-250 microns, 90-200 microns, 90-150 microns, 100-300 microns, 100-250 microns, 100-200 microns, 100-150 microns, and 100-120 microns. The foregoing are examples only, and the width $W_c$h of the channel 122 can be in other ranges (e.g., a range defined by any of the endpoints listed above). Moreover, the $W_c$h of the channel 122 can be selected to be in any of these ranges in regions of the channel other than at a proximal opening of a sequestration pen.

In some embodiments, a sequestration pen has a cross-sectional height of about 30 to about 200 microns, or about 50 to about 150 microns. In some embodiments, the sequestration pen has a cross-sectional area of about 100,000 to about 2,500,000 square microns, or about 200,000 to about 2,000,000 square microns. In some embodiments, a connection region has a cross-sectional height that matches the cross-sectional height of the corresponding sequestration pen. In some embodiments, the connection region has a cross-sectional width of about 50 to about 500 microns, or about 100 to about 300 microns.

In various embodiments of sequestration pens the height $H_{ch}$ of the channel 122 at a proximal opening 252 can be within any of the following ranges: 20-100 microns, 20-90 microns, 20-80 microns, 20-70 microns, 20-60 microns, 20-50 microns, 30-100 microns, 30-90 microns, 30-80 microns, 30-70 microns, 30-60 microns, 30-50 microns, 40-100 microns, 40-90 microns, 40-80 microns, 40-70 microns, 40-60 microns, or 40-50 microns. The foregoing are examples only, and the height $H_{ch}$ of the channel 122 can be in other ranges (e.g., a range defined by any of the endpoints listed above). The height $H_{ch}$ of the channel 122 can be selected to be in any of these ranges in regions of the channel other than at a proximal opening of a sequestration pen.

In various embodiments of sequestration pens a cross-sectional area of the channel 122 at a proximal opening 252 can be within any of the following ranges: 500-50,000 square microns, 500-40,000 square microns, 500-30,000 square microns, 500-25,000 square microns, 500-20,000 square microns, 500-15,000 square microns, 500-10,000 square microns, 500-7,500 square microns, 500-5,000 square microns, 1,000-25,000 square microns, 1,000-20,000 square microns, 1,000-15,000 square microns, 1,000-10,000 square microns, 1,000-7,500 square microns, 1,000-5,000 square microns, 2,000-20,000 square microns, 2,000-15,000 square microns, 2,000-10,000 square microns, 2,000-7,500 square microns, 2,000-6,000 square microns, 3,000-20,000 square microns, 3,000-15,000 square microns, 3,000-10,000 square microns, 3,000-7,500 square microns, or 3,000 to 6,000 square microns. The foregoing are examples only, and the cross-sectional area of the channel 122 at a proximal opening 252 can be in other ranges (e.g., a range defined by any of the endpoints listed above).

In various embodiments of sequestration pens, the length L. of the connection region 254 can be in any of the following ranges: 1-200 microns, 5-150 microns, 10-100 microns, 15-80 microns, 20-60 microns, 20-500 microns, 40-400 microns, 60-300 microns, 80-200 microns, and 100-150 microns. The foregoing are examples only, and length L. of a connection region 254 can be in a different ranges than the foregoing examples (e.g., a range defined by any of the endpoints listed above).

In various embodiments of sequestration pens the width $W_{con}$ of a connection region 254 at a proximal opening 252 can be in any of the follow ranges: 20-500 microns, 20-400 microns, 20-300 microns, 20-200 microns, 20-150 microns, 20-100 microns, 20-80 microns, 20-60 microns, 30-400 microns, 30-300 microns, 30-200 microns, 30-150 microns, 30-100 microns, 30-80 microns, 30-60 microns, 40-300 microns, 40-200 microns, 40-150 microns, 40-100 microns, 40-80 microns, 40-60 microns, 50-250 microns, 50-200 microns, 50-150 microns, 50-100 microns, 50-80 microns, 60-200 microns, 60-150 microns, 60-100 microns, 60-80 microns, 70-150 microns, 70-100 microns, and 80-100 microns. The foregoing are examples only, and the width $W_{con}$ of a connection region 254 at a proximal opening 252 can be different than the foregoing examples (e.g., a range defined by any of the endpoints listed above).

In various embodiments of sequestration pens the width $W_{con}$ of a connection region 254 at a proximal opening 252 can be in any of the following ranges: 2-35 m 2-25 microns, microns, 2-20 microns, 2-15 microns, 2-10 microns, 2-7 microns, 2-5 microns, 2-3 microns, 3-25 microns, 3-20 microns, 3-15 microns, 3-10 microns, 3-7 microns, 3-5 microns, 3-4 microns, 4-20 microns, 4-15 microns, 4-10 microns, 4-7 microns, 4-5 microns, 5-15 microns, 5-10 microns, 5-7 microns, 6-15 microns, 6-10 microns, 6-7 microns, 7-15 microns, 7-10 microns, 8-15 microns, and 8-10 microns. The foregoing are examples only, and the width $W_{con}$ of a connection region 254 at a proximal opening 252 can be different than the foregoing examples (e.g., a range defined by any of the endpoints listed above).

In various embodiments of sequestration pens, a ratio of the length $L_{con}$ of a connection region 254 to a width $W_{con}$ of the connection region 254 at the proximal opening 252 can be greater than or equal to any of the following ratios: 0.5, 1.0, 1.5, 2.0, 2.5, 3.0, 3.5, 4.0, 4.5, 5.0, 6.0, 7.0, 8.0, 9.0, 10.0, or more. The foregoing are examples only, and the ratio of the length $L_{con}$ of a connection region 254 to a width $W_{con}$ of the connection region 254 at the proximal opening 252 can be different than the foregoing examples.

In various embodiments of microfluidic devices 100, 200, 240, 290, 420, 1500, 1700, 1800, $V_{max}$ can be set around 0.2, 0.3, 0.4, 0.5, 0.6, 0.7, 0.8, 0.9, 1.0, 1.1, 1.2, 1.3, 1.4, or 1.5 μL/sec.

In various embodiments of microfluidic devices having sequestration pens, the volume of an isolation region 258 can be, for example, at least $3\times10^3$, $6\times10^3$, $9\times10^3$, $1\times10^4$, $2\times10^4$, $4\times10^4$, $8\times10^4$, $1\times10^5$, $2\times10^5$, $4\times10^5$, $8\times10^5$, $1\times10^6$, $2\times10^6$, $4\times10^6$, $6\times10^6$ cubic microns, or more.

In various embodiments of microfluidic devices having sequestration pens, the volume of a sequestration pen may be about $5\times10^3$, $7\times10^3$, $1\times10^4$, $3\times10^4$, $5\times10^4$, $8\times10^4$, $1\times10^5$, $2\times10^5$, $4\times10^5$, $6\times10^5$, $8\times10^5$, $1\times10^6$, $2\times10^6$, $4\times10^6$, $8\times10^6$, $1\times10^7$, $3\times10^7$, $5\times10^7$, or about $8\times10^7$ cubic microns, or more. In some embodiments, the microfluidic device has sequestration pens wherein no more than $1\times10^2$ biological cells may be maintained, and the volume of a sequestration pen may be no more than $2\times10^6$ cubic microns. In some embodiments, the microfluidic device has sequestration pens wherein no more than $1\times10^2$ biological cells may be maintained, and a sequestration pen may be no more than $4\times10^5$ cubic microns. In yet other embodiments, the microfluidic device has sequestration pens wherein no more than 50 biological cells may be maintained, a sequestration pen may be no more than $4\times10^5$ cubic microns.

In various embodiment, the microfluidic device has sequestration pens configured as in any of the embodiments discussed herein where the microfluidic device has about 100 to about 500 sequestration pens; about 200 to about 1000 sequestration pens, about 500 to about 1500 sequestration pens, about 1000 to about 2000 sequestration pens, or about 1000 to about 3500 sequestration pens.

In some other embodiments, the microfluidic device has sequestration pens configured as in any of the embodiments discussed herein where the microfluidic device has about 1500 to about 3000 sequestration pens, about 2000 to about 3500 sequestration pens, about 2500 to about 4000 sequestration pens, about 3000 to about 4500 sequestration pens, about 3500 to about 5000 sequestration pens, about 4000 to about 5500 sequestration pens, about 4500 to about 6000 sequestration pens, about 5000 to about 6500 sequestration pens, about 5500 to about 7000 sequestration pens, about 6000 to about 7500 sequestration pens, about 6500 to about 8000 sequestration pens, about 7000 to about 8500 sequestration pens, about 7500 to about 9000 sequestration pens, about 8000 to about 9500 sequestration pens, about 8500 to about 10,000 sequestration pens, about 9000 to about 10,500 sequestration pens, about 9500 to about 11,000 sequestration pens, about 10,000 to about 11,500 sequestration pens, about 10,500 to about 12,000 sequestration pens, about 11,000 to about 12,500 sequestration pens, about 11,500 to about 13,000 sequestration pens, about 12,000 to about 13,500 sequestration pens, about 12,500 to about 14,000 sequestration pens, about 13,000 to about 14,500 sequestration pens, about 13,500 to about 15,000 sequestration pens, about 14,000 to about 15,500 sequestration pens, about 14,500 to about 16,000 sequestration pens, about 15,000 to about 16,500 sequestration pens, about 15,500 to about 17,000 sequestration pens, about 16,000 to about 17,500 sequestration pens, about 16,500 to about 18,000 sequestration pens, about 17,000 to about 18,500 sequestration pens, about 17,500 to about 19,000 sequestration pens, about 18,000 to about 19,500 sequestration pens, about 18,500 to about 20,000 sequestration pens, about 19,000 to about 20,500 sequestration pens, about 19,500 to about 21,000 sequestration pens, or about 20,000 to about 21,500 sequestration pens.

Figure 2F:
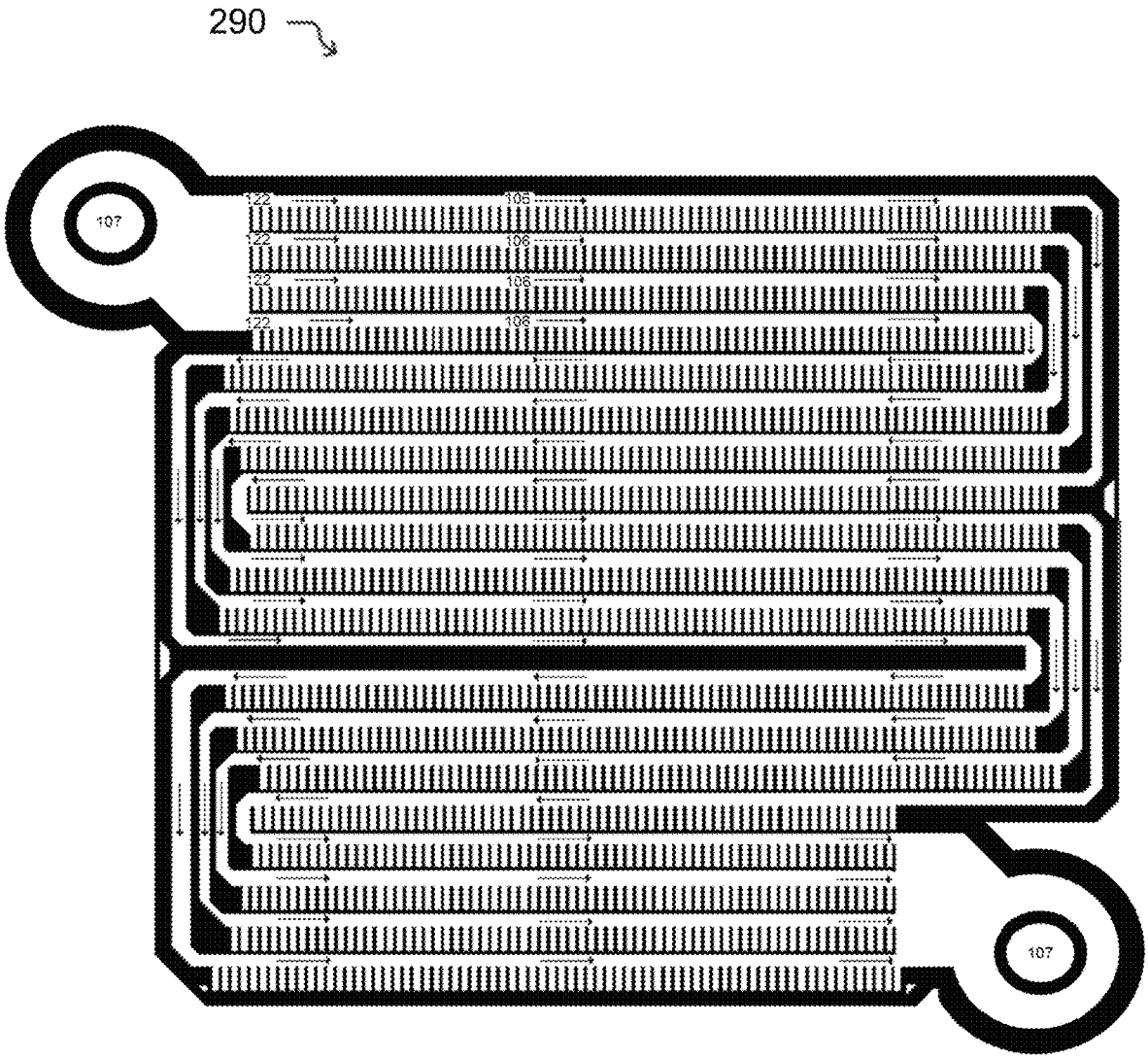
FIG. 2F illustrates a microfluidic device according to an embodiment of the invention.

FIG. 2F illustrates a microfluidic device 290 according to one embodiment. The microfluidic device 290 is illustrated in FIG. 2F is a stylized diagram of a microfluidic device 100. In practice the microfluidic device 290 and its constituent circuit elements (e.g. channels 122 and sequestration pens 128) would have the dimensions discussed herein. The microfluidic circuit 120 illustrated in FIG. 2F has two ports 107, four distinct channels 122 and four distinct flow paths 106. The microfluidic device 290 further comprises a plurality of sequestration pens opening off of each channel 122. In the microfluidic device illustrated in FIG. 2F, the sequestration pens have a geometry similar to the pens illustrated in FIG. 2E and thus, have both connection regions and isolation regions. Accordingly, the microfluidic circuit 120 includes both swept regions (e.g. channels 122 and portions of the connection regions 254 within the maximum penetration depth $D_p$ of the secondary flow 262) and non-swept regions (e.g. isolation regions 258 and portions of the connection regions 254 not within the maximum penetration depth $D_p$ of the secondary flow 262).

Figure 3A:
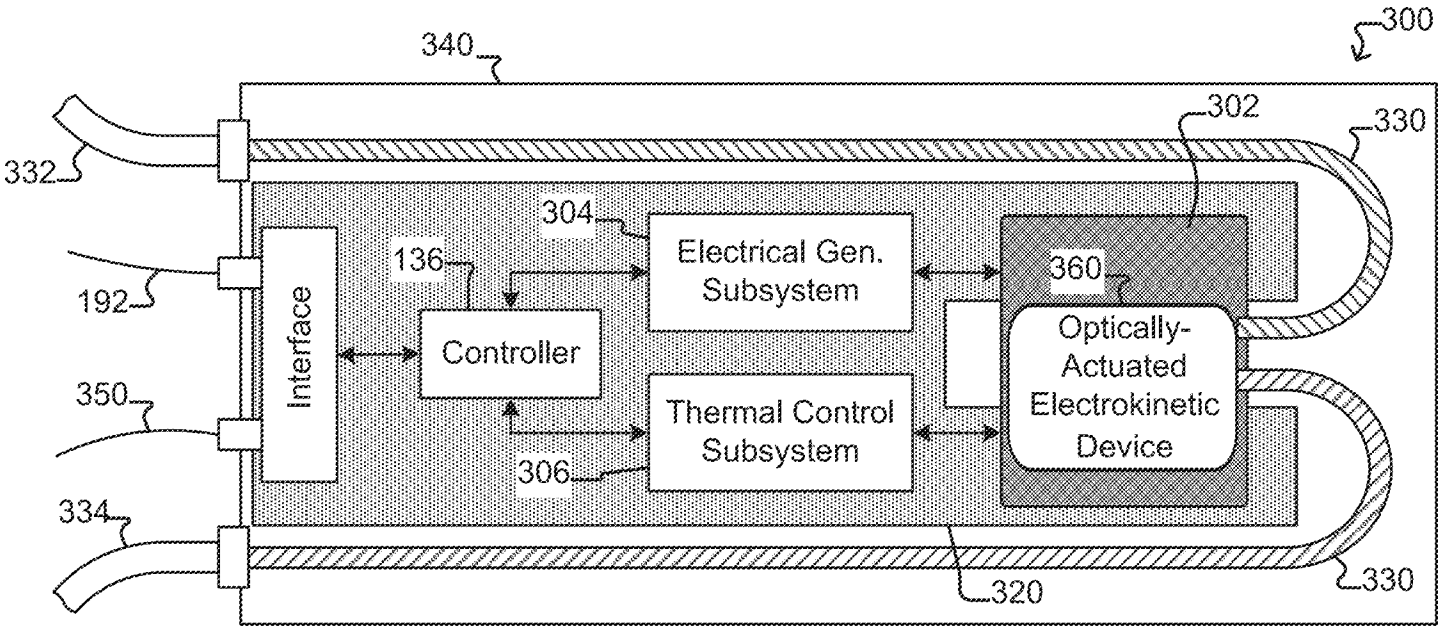
FIG. 3A illustrates a specific example of a system for use with a microfluidic device and associated control equipment according to some embodiments of the invention.
Figure 3B:
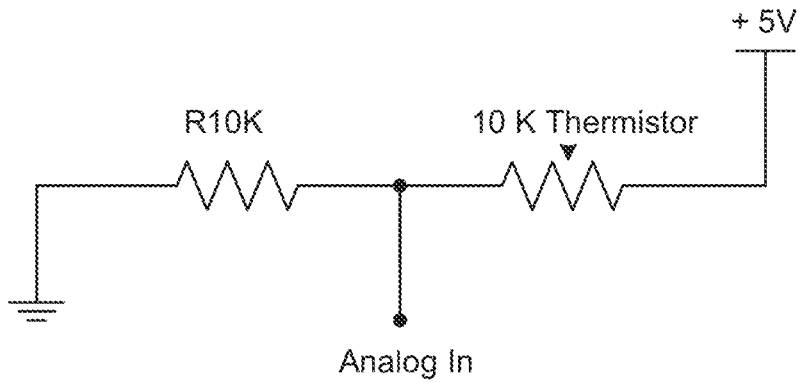
FIG. 3B illustrates an exemplary analog voltage divider circuit according to some embodiments of the invention.

FIGS. 3A through 3D shows various embodiments of system 150 which can be used to operate and observe microfluidic devices (e.g. 100, 200, 240, 290) according to the present invention. As illustrated in FIG. 3A, the system 150 can include a structure ("nest") 300 configured to hold a microfluidic device 100 (not shown), or any other microfluidic device described herein. The nest 300 can include a socket 302 capable of interfacing with the microfluidic device 360 (e.g., an optically-actuated electrokinetic device 100) and providing electrical connections from power source 192 to microfluidic device 360. The nest 300 can further include an integrated electrical signal generation subsystem 304. The electrical signal generation subsystem 304 can be configured to supply a biasing voltage to socket 302 such that the biasing voltage is applied across a pair of electrodes in the microfluidic device 360 when it is being held by socket 302. Thus, the electrical signal generation subsystem 304 can be part of power source 192. The ability to apply a biasing voltage to microfluidic device 360 does not mean that a biasing voltage will be applied at all times when the microfluidic device 360 is held by the socket 302. Rather, in most cases, the biasing voltage will be applied intermittently, e.g., only as needed to facilitate the generation of electrokinetic forces, such as dielectrophoresis or electro-wetting, in the microfluidic device 360.

As illustrated in FIG. 3A, the nest 300 can include a printed circuit board assembly (PCBA) 320. The electrical signal generation subsystem 304 can be mounted on and electrically integrated into the PCBA 320. The exemplary support includes socket 302 mounted on PCBA 320, as well.

Typically, the electrical signal generation subsystem 304 will include a waveform generator (not shown). The electrical signal generation subsystem 304 can further include an oscilloscope (not shown) and/or a waveform amplification circuit (not shown) configured to amplify a waveform received from the waveform generator. The oscilloscope, if present, can be configured to measure the waveform supplied to the microfluidic device 360 held by the socket 302. In certain embodiments, the oscilloscope measures the waveform at a location proximal to the microfluidic device 360 (and distal to the waveform generator), thus ensuring greater accuracy in measuring the waveform actually applied to the device. Data obtained from the oscilloscope measurement can be, for example, provided as feedback to the waveform generator, and the waveform generator can be configured to adjust its output based on such feedback. An example of a suitable combined waveform generator and oscilloscope is the Red Pitaya™.

In certain embodiments, the nest 300 further comprises a controller 308, such as a microprocessor used to sense and/or control the electrical signal generation subsystem 304. Examples of suitable microprocessors include the Arduino™ microprocessors, such as the Arduino Nano™. The controller 308 may be used to perform functions and analysis or may communicate with an external master controller 154 (shown in FIG. 1) to perform functions and analysis. In the embodiment illustrated in FIG. 3A the controller 308 communicates with a master controller 154 through an interface 310 (e.g., a plug or connector).

In some embodiments, the nest 300 can comprise an electrical signal generation subsystem 304 comprising a Red Pitaya™ waveform generator/oscilloscope unit ("Red Pitaya™ unit") and a waveform amplification circuit that amplifies the waveform generated by the Red Pitaya™ unit and passes the amplified voltage to the microfluidic device 100. In some embodiments, the Red Pitaya™ unit is configured to measure the amplified voltage at the microfluidic device 360 and then adjust its own output voltage as needed such that the measured voltage at the microfluidic device 360 is the desired value. In some embodiments, the waveform amplification circuit can have a +6.5V to −6.5V power supply generated by a pair of DC-DC converters mounted on the PCBA 320, resulting in a signal of up to 13 Vpp at the microfluidic device 360.

As illustrated in FIG. 3A, the nest 300 can further include a thermal control subsystem 306. The thermal control subsystem 306 can be configured to regulate the temperature of microfluidic device 360 held by the support structure 300. For example, the thermal control subsystem 306 can include a Peltier thermoelectric device (not shown) and a cooling unit (not shown). The Peltier thermoelectric device can have a first surface configured to interface with at least one surface of the microfluidic device 360. The cooling unit can be, for example, a cooling block (not shown), such as a liquid-cooled aluminum block. A second surface of the Peltier thermoelectric device (e.g., a surface opposite the first surface) can be configured to interface with a surface of such a cooling block. The cooling block can be connected to a fluidic path 330 configured to circulate cooled fluid through the cooling block. In the embodiment illustrated in FIG. 3A, the support structure 300 comprises an inlet 332 and an outlet 334 to receive cooled fluid from an external reservoir (not shown), introduce the cooled fluid into the fluidic path 330 and through the cooling block, and then return the cooled fluid to the external reservoir. In some embodiments, the Peltier thermoelectric device, the cooling unit, and/or the fluidic path 330 can be mounted on a casing 340 of the support structure 300. In some embodiments, the thermal control subsystem 306 is configured to regulate the temperature of the Peltier thermoelectric device so as to achieve a target temperature for the microfluidic device 360. Temperature regulation of the Peltier thermoelectric device can be achieved, for example, by a thermoelectric power supply, such as a Pololu™ thermoelectric power supply (Pololu Robotics and Electronics Corp.). The thermal control subsystem 306 can include a feedback circuit, such as a temperature value provided by an analog circuit. Alternatively, the feedback circuit can be provided by a digital circuit.

In some embodiments, the nest 300 can include a thermal control subsystem 306 with a feedback circuit that is an analog voltage divider circuit (shown in FIG. 3B) which includes a resistor (e.g., with resistance 1 kOhm+/−0.1%, temperature coefficient+/−0.02 ppm/C0) and a NTC thermistor (e.g., with nominal resistance 1 kOhm+/−0.01%). In some instances, the thermal control subsystem 306 measures the voltage from the feedback circuit and then uses the calculated temperature value as input to an on-board PID control loop algorithm. Output from the PID control loop algorithm can drive, for example, both a directional and a pulse-width-modulated signal pin on a Pololu™ motor drive (not shown) to actuate the thermoelectric power supply, thereby controlling the Peltier thermoelectric device.

Figure 3C:
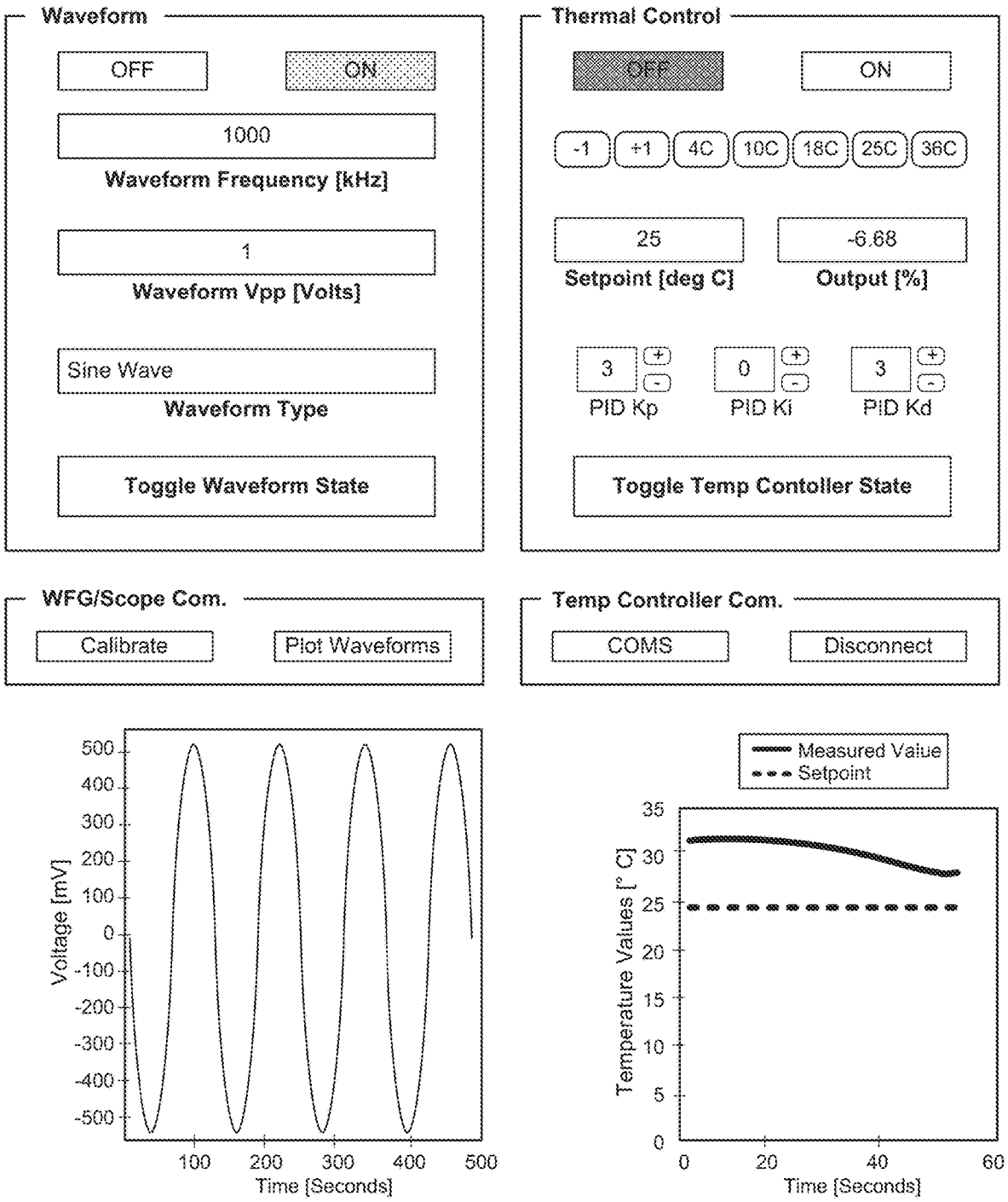
FIG. 3C illustrates an exemplary GUI configured to plot temperature and waveform data according to some embodiments of the invention.

The nest 300 can include a serial port 350 which allows the microprocessor of the controller 308 to communicate with an external master controller 154 via the interface 310. In addition, the microprocessor of the controller 308 can communicate (e.g., via a Plink tool (not shown)) with the electrical signal generation subsystem 304 and thermal control subsystem 306. Thus, via the combination of the controller 308, the interface 310, and the serial port 350, the electrical signal generation subsystem 308 and the thermal control subsystem 306 can communicate with the external master controller 154. In this manner, the master controller 154 can, among other things, assist the electrical signal generation subsystem 308 by performing scaling calculations for output voltage adjustments. A Graphical User Interface (GUI), one example of which is shown in FIG. 3C, provided via a display device 170 coupled to the external master controller 154, can be configured to plot temperature and waveform data obtained from the thermal control subsystem 306 and the electrical signal generation subsystem 308, respectively. Alternatively, or in addition, the GUI can allow for updates to the controller 308, the thermal control subsystem 306, and the electrical signal generation subsystem 304.

As discussed above, system 150 can include an imaging device 194. In some embodiments, the imaging device 194 comprises a light modulating subsystem 404. The light modulating subsystem 404 can include a digital mirror device (DMD) or a microshutter array system (MSA), either of which can be configured to receive light from a light source 402 and transmits a subset of the received light into an optical train of microscope 400. Alternatively, the light modulating subsystem 404 can include a device that produces its own light (and thus dispenses with the need for a light source 402), such as an organic light emitting diode display (OLED), a liquid crystal on silicon (LCOS) device, a ferroelectric liquid crystal on silicon device (FLCOS), or a transmissive liquid crystal display (LCD). The light modulating subsystem 404 can be, for example, a projector. Thus, the light modulating subsystem 404 can be capable of emitting both structured and unstructured light. One example of a suitable light modulating subsystem 404 is the Mosaic™ system from Andor Technologies™. In certain embodiments, imaging module 164 and/or motive module 162 of system 150 can control the light modulating subsystem 404.

In certain embodiments, the imaging device 194 further comprises a microscope 400. In such embodiments, the nest 300 and light modulating subsystem 404 can be individually configured to be mounted on the microscope 400. The microscope 400 can be, for example, a standard researchgrade light microscope or fluorescence microscope. Thus, the nest 300 can be configured to be mounted on the stage 410 of the microscope 400 and/or the light modulating subsystem 404 can be configured to mount on a port of microscope 400. In other embodiments, the nest 300 and the light modulating subsystem 404 described herein can be integral components of microscope 400.

In certain embodiments, the microscope 400 can further include one or more detectors 422. In some embodiments, the detector 422 is controlled by the imaging module 164. The detector 422 can include an eye piece, a charge-coupled device (CCD), a camera (e.g., a digital camera), or any combination thereof. If at least two detectors 422 are present, one detector can be, for example, a fast-frame-rate camera while the other detector can be a high sensitivity camera. Furthermore, the microscope 400 can include an optical train configured to receive reflected and/or emitted light from the microfluidic device 360 and focus at least a portion of the reflected and/or emitted light on the one or more detectors 422. The optical train of the microscope can also include different tube lenses (not shown) for the different detectors, such that the final magnification on each detector can be different.

In certain embodiments, imaging device 194 is configured to use at least two light sources. For example, a first light source 402 can be used to produce structured light (e.g., via the light modulating subsystem 404) and a second light source 432 can be used to provide unstructured light. The first light source 402 can produce structured light for optically-actuated electrokinesis and/or fluorescent excitation, and the second light source 432 can be used to provide bright field illumination. In these embodiments, the motive module 162 can be used to control the first light source 404 and the imaging module 164 can be used to control the second light source 432. The optical train of the microscope 400 can be configured to (1) receive structured light from the light modulating subsystem 404 and focus the structured light on at least a first region in a microfluidic device, such as an optically-actuated electrokinetic device, when the device is being held by the support structure 200, and (2) receive reflected and/or emitted light from the microfluidic device and focus at least a portion of such reflected and/or emitted light onto detector 422. The optical train can be further configured to receive unstructured light from a second light source and focus the unstructured light on at least a second region of the microfluidic device, when the device is held by the support structure 300. In certain embodiments, the first and second regions of the microfluidic device can be overlapping regions. For example, the first region can be a subset of the second region.

Figure 3D:
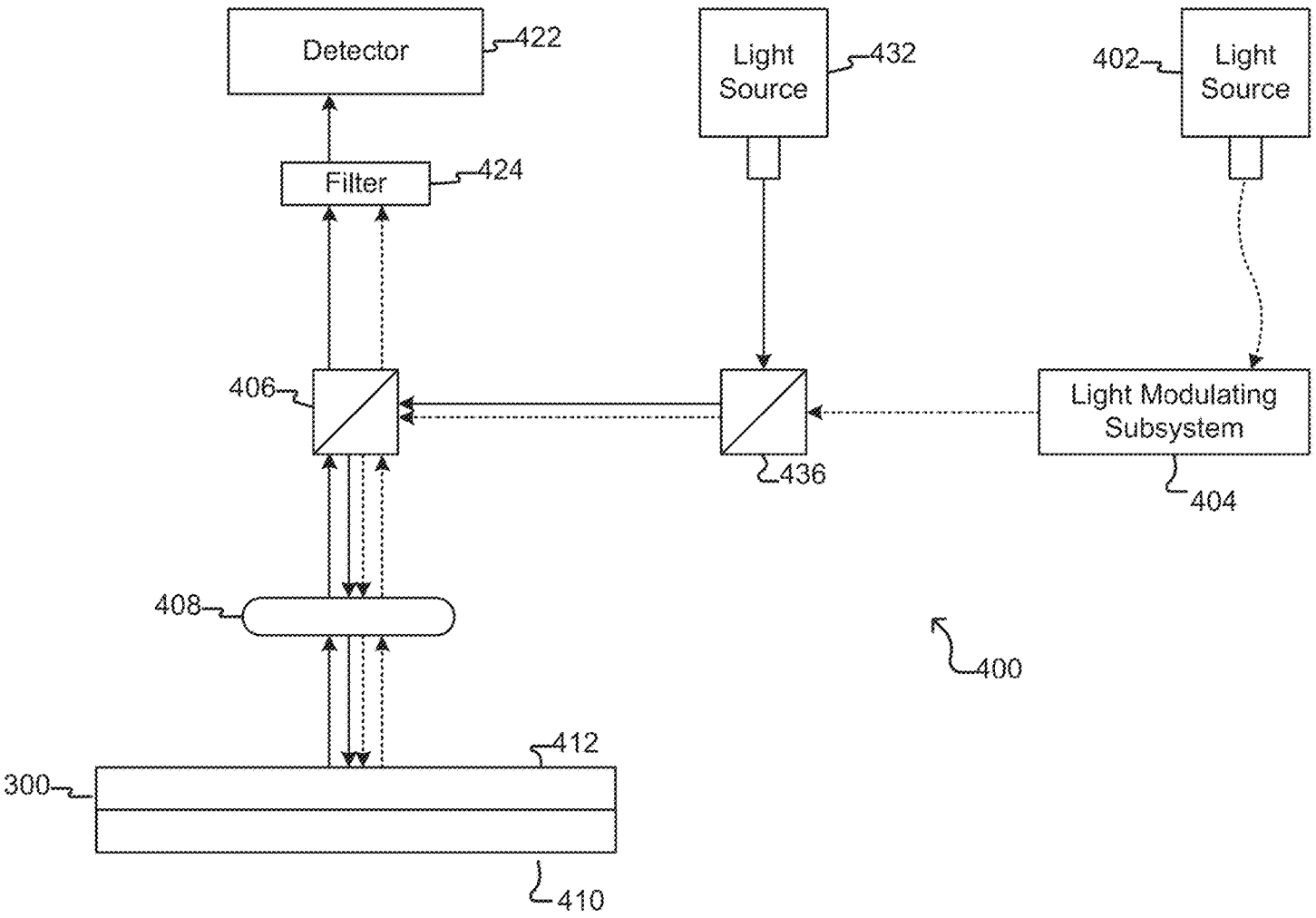
FIG. 3D illustrates an imaging device according to some embodiments of the invention.

In FIG. 3D, the first light source 402 is shown supplying light to a light modulating subsystem 404, which provides structured light to the optical train of the microscope 400. The second light source 432 is shown providing unstructured light to the optical train via a beam splitter 436. Structured light from the light modulating subsystem 404 and unstructured light from the second light source 432 travel from the beam splitter 436 through the optical train together to reach a second beam splitter 436 (or dichroic filter 406 depending on the light provided by the light modulating subsystem 404), where the light gets reflected down through the objective 408 to the sample plane 412. Reflected and/or emitted light from the sample plane 412 then travels back up through the objective 408, through the beam splitter and/or dichroic filter 406, and to a dichroic filter 424. Only a fraction of the light reaching dichroic filter 424 passes through and reaches the detector 422.

In some embodiments, the second light source 432 emits blue light. With an appropriate dichroic filter 424, blue light reflected from the sample plane 412 is able to pass through dichroic filter 424 and reach the detector 422. In contrast, structured light coming from the light modulating subsystem 404 gets reflected from the sample plane 412, but does not pass through the dichroic filter 424. In this example, the dichroic filter 424 is filtering out visible light having a wavelength longer than 495 nm. Such filtering out of the light from the light modulating subsystem 404 would only be complete (as shown) if the light emitted from the light modulating subsystem did not include any wavelengths shorter than 495 nm. In practice, if the light coming from the light modulating subsystem 404 includes wavelengths shorter than 495 nm (e.g., blue wavelengths), then some of the light from the light modulating subsystem would pass through filter 424 to reach the detector 422. In such an embodiment, the filter 424 acts to change the balance between the amount of light that reaches the detector 422 from the first light source 402 and the second light source 432. This can be beneficial if the first light source 402 is significantly stronger than the second light source 432. In other embodiments, the second light source 432 can emit red light, and the dichroic filter 424 can filter out visible light other than red light (e.g., visible light having a wavelength shorter than 650 nm).

Actuated Microfluidic Structures for Directed Flow in a Microfluidic Device and Methods of Use.

In some embodiments of the invention, a microfluidic device can comprise a plurality of interconnected microfluidic elements such as a microfluidic channel and microfluidic chambers connected to the channel. A plurality of actuators can abut or be positioned immediately adjacent to deformable surfaces of the microfluidic elements. The actuators can be selectively actuated and de-actuated to create localized flows of a fluidic medium in the microfluidic device, which can be an efficient manner of moving micro-objects in the device.

Figure 4A:
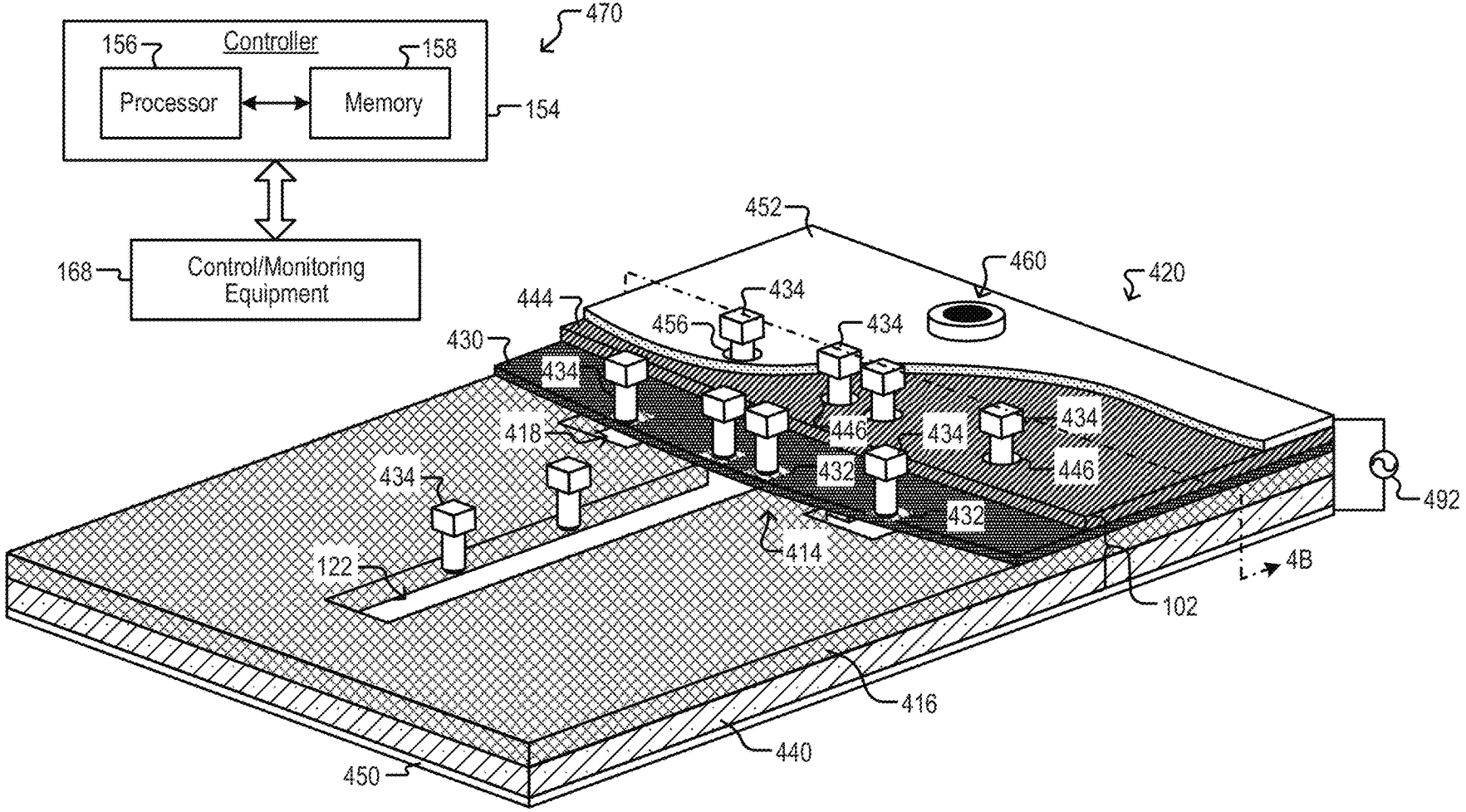
FIG. 4A is a perspective view of a microfluidic device and a plurality of individually controllable actuators according to some embodiments of the invention. An enclosure layer, a cover, and a biasing electrode of the device are shown in a cutout view.
Figure 4B:
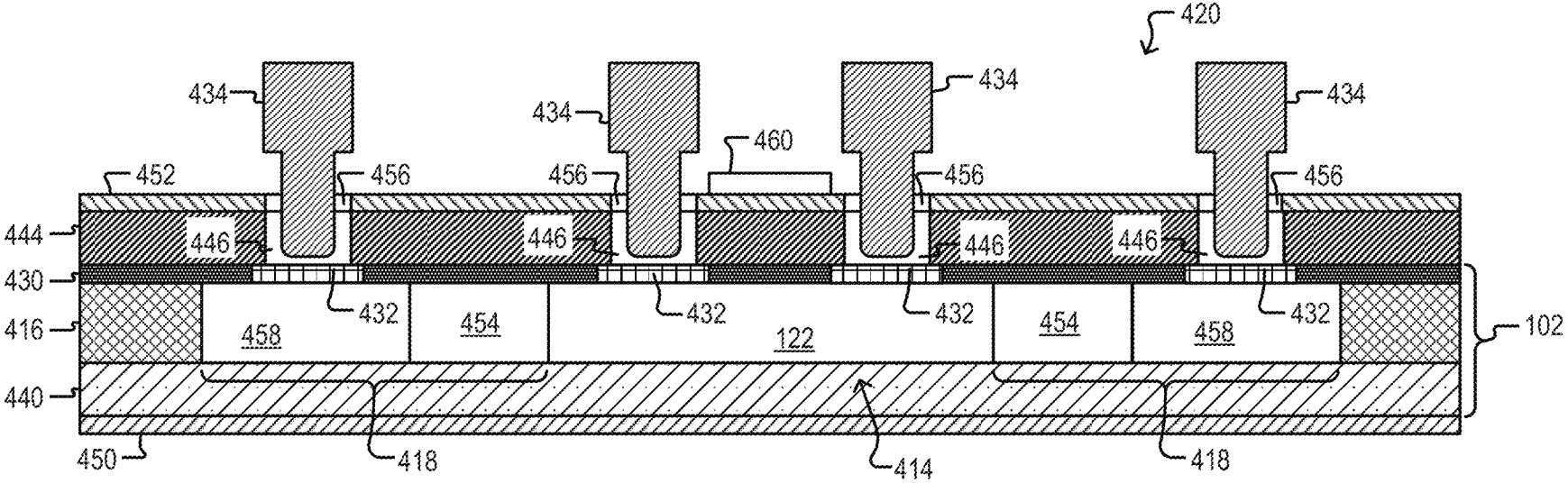
FIG. 4B is a cross-sectional side view with otherwise complete views of the enclosure layer, the cover, and the biasing electrode of the microfluidic device of FIG. 4A.
Figure 5:
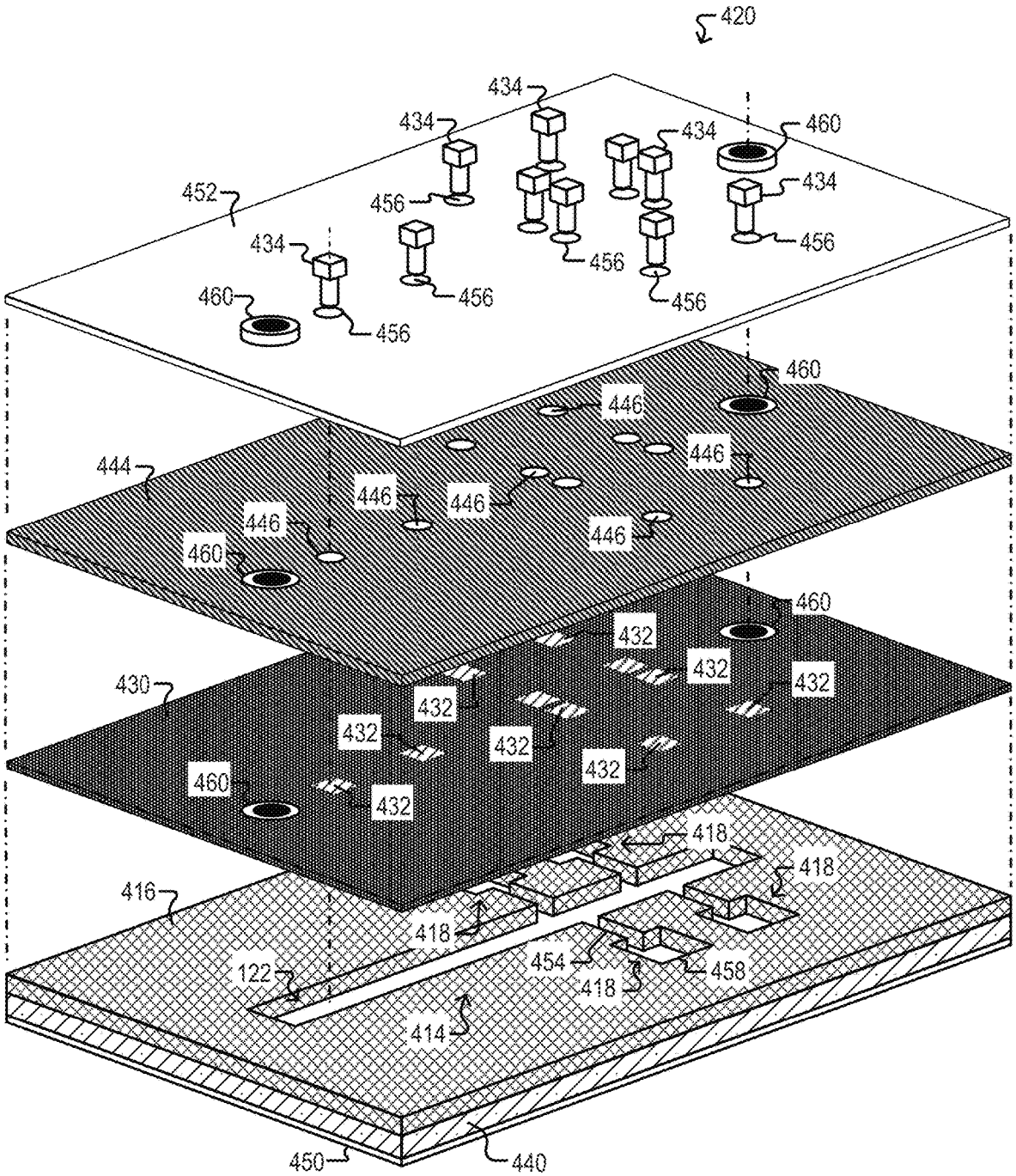
FIG. 5 is an exploded view of the microfluidic device of FIG. 4A.

FIGS. 4A, 4B, and 5 illustrate an example of a microfluidic system comprising a microfluidic device 420, actuators 434, and a control system 470. The microfluidic device 420 can comprise an enclosure 102, which can comprise one or more microfluidic circuit elements 414. Examples of such microfluidic elements 414 illustrated in FIGS. 4A, 4B, and 5 include a microfluidic channel 122 and microfluidic chambers 418. Other examples of microfluidic elements 414 include microfluidic reservoirs, microfluidic wells (e.g., like 1318 of FIG. 13), and the like.

The microfluidic circuit elements 414 can be configured to contain one or more fluidic media (not show). One or more of the microfluidic elements 414 can comprise at least one deformable surface 432 located at a region or regions of the microfluidic element 414. A plurality of actuators 434 can be configured to selectively deform the deformable surfaces 432 and thereby effect localized, temporary volumetric changes at specific regions in the microfluidic elements 414. Micro-objects (not shown) in the enclosure 102 can be selectively moved in the enclosure 102 by selectively activating the actuators 434. Although the enclosure 102 can be configured in a variety of ways, the enclosure 102 is illustrated in FIGS. 4A, 4B, and 5 as comprising a base 440, a microfluidic structure 416, an enclosure layer 430, and a cover 444. As will be seen, each microfluidic element 414, including any region of the microfluidic element 414 configured to contain media (not shown), can be bounded at least in part by one or more of the deformable surfaces 432, the base 440, the enclosure layer 430, and/or the cover 444.

The base 440, the microfluidic structure 416, the enclosure layer 430, and the cover 444 can be attached to each other. For example, the microfluidic structure 416 can be disposed on the base 440, and the enclosure layer 430 and cover 444 can be disposed over the microfluidic structure 416. With the base 440, the enclosure layer 430, and the cover 444, the microfluidic structure 416 can define the microfluidic elements 414. One or more ports 460 can provide an inlet into and/or an outlet from the enclosure 102. There can be more than one port 460, each of which can be an inlet, an outlet, or an inlet/outlet port. Alternatively, there can be one port 460, which can be an inlet/outlet port. The port or ports 460 can comprise, for example, a through passage, a valve, or the like.

As mentioned, the microfluidic circuit elements 414 shown in FIGS. 4A, 4B, and 5 can include a microfluidic channel 122 (which can be an example of a flow path) to which a plurality of chambers 418 are fluidically connected. Each chamber 418 can comprise an isolation region 458 and a connection region 454 fluidically connecting the isolation region 458 to the channel 122. The connection region 454 can be configured so that the maximum penetration depth of a flow of medium (not shown) in the channel 122 extends into the connection region 454 but not into the isolation region 458. For example, the chamber 418 and its connection region 454 and isolation region 458 can be like any of the sequestration pens described above or the isolation pens and their connection regions and isolation regions disclosed in US Patent Publication No. US2015/0151298 (filed Oct. 22, 2014), which is incorporated by reference herein in its entirety.

The volume of any of the chambers 418 (or the isolation region 458 of any of the chambers 418) can be at least $1.0\times10^5$ $\mu m^3$; at least $2.0\times10^5$ $\mu m^3$; at least $3.0\times10^5$ $\mu m^3$; at least $4.0\times10^5$ $\mu m^3$; at least $5.0\times10^5$ $\mu m^3$; at least $6.0\times10^5$ $\mu m^3$; at least $7.0\times10^5$ $\mu m^3$; at least $8.0\times10^5$ $\mu m^3$; at least $9.0\times10^5$ $\mu m^3$; at least $1.0\times10^6$ $\mu m^3$, or greater. The volume of any of the chambers 418 (or the isolation region 458 of any of the chambers 418) can additionally or alternatively be less than or equal to $1.0\times10^6$ $\mu m^3$; less than or equal to $2.0\times10^6$ $\mu m^3$; less than or equal to $3.0\times10^6$ $\mu m^3$; less than or equal to $4.0\times10^6$ $\mu m^3$; less than or equal to $5.0\times10^6$ $\mu m^3$; less than or equal to $6.0\times10^6$ $\mu m^3$; less than or equal to $7.0\times10^6$ $\mu m^3$; less than or equal to $8.0\times10^6$ $\mu m^3$; less than or equal to $9.0\times10^6$ $\mu m^3$, or less than $1.0\times10^7$ $\mu m^3$. In other embodiments, the chamber 418 (or the isolation region 458) may have a volume as described above, generally for a sequestration pen (or an isolation region thereof). The foregoing numerical values and ranges are examples only and not intended to be limiting.

The base 440 can comprise a substrate or a plurality of substrates, which may be interconnected. For example, the base 440 can comprise one or more semiconductor substrates. The base 440 can further comprise a printed circuit board assembly (PCBA). For example, the substrate(s) can be mounted on the PCBA. As noted, the microfluidic structure 416 can be disposed on the base 440. A surface of the base 440 (or the semiconductor substrate(s)) can thus provide some of the walls (e.g., floor walls) of the microfluidic circuit elements 414. In some embodiments, the base 440 is substantially rigid and thus not significantly deformable. The foregoing surface of the base 440 can thus provide substantially rigid, non-deformable walls of the microfluidic elements 414.

In some embodiments, the base 440 can be configured to selectively induce localized dielectrophoresis (DEP) forces on micro-objects (not shown) in the enclosure 102. As part of such a DEP configuration of the base 440, the microfluidic device 420 can comprise biasing electrodes 450, 452 to which a biasing power source 492 can be connected. In some embodiments, the biasing electrodes 450, 452 can be disposed on opposite sides of the enclosure 102. The upper biasing electrode 452 may alternatively be incorporated within the cover 444 or within the enclosure layer 430, and may be fabricated using any of the electrically conductive materials described above. For example, an ITO conductive electrode may be incorporated within a glass cover 444.

An example of a DEP configuration of the base 440 is an optoelectronic tweezers (OET) configuration. Examples of suitable OET configurations of the base 440 are illustrated in the following US patent documents each of which is incorporated herein by reference in its entirety: U.S. Pat. No. RE44,711 (Wu et al.); and U.S. Pat. No. 7,956,339 (Ohta et al.). Alternatively, the base 440 can have an optoelectronic wetting configuration (OEW). Examples of OEW configurations are illustrated in U.S. Pat. No. 6,958,132 (Chiou et al.) and US Patent Application Publication No. 2012/0024708 (Chiou et al.), both of which are incorporated by reference herein in their entirety. As yet another example, the base 440 can have a combined OET/OEW configuration, examples of which are shown in US Patent Publication No. 2015/0306598 (Khandros et al.) and US Patent Publication No. 2015/0306599 (Khandros et al.), and their corresponding PCT Publications WO2015/164846 and WO2015/164847, all of which are incorporated herein by reference in their entirety.

The microfluidic structure 416 can comprise cavities or the like that provide some of the walls of the microfluidic circuit elements 414. For example, the microfluidic structure 416 can provide the sidewalls of the microfluidic elements 414. The microfluidic structure 416 can comprise a flexible and/or resilient material such as rubber, plastic, elastomer, silicone (e.g., photo-patternable silicone or "PPS"), polydimethylsiloxane ("PDMS"), or the like, any of which can be gas permeable. Other examples of materials that can compose the microfluidic structure 416 include rigid materials such as molded glass, an etchable material such as silicon, photoresist (e.g., SU8), or the like. The foregoing materials can be substantially impermeable to gas.

The enclosure layer 430 can provide walls (e.g., ceiling walls) of the microfluidic circuit elements 414. The enclosure layer 430 can comprise deformable surfaces 432 that correspond to predetermined regions in one or more of the microfluidic elements 414 where a localized flow of medium (not shown) can be selectively generated. In the example shown in FIGS. 4A, 4B, and 5, deformable surfaces 432 are illustrated corresponding to various regions in the channel 122 and the chambers 418. The deformable surfaces 432, however, can be positioned to correspond to any region in any of the microfluidic elements 414. In some embodiments, the enclosure layer 430 can comprise deformable surfaces 432 corresponding to all of the microfluidic elements 414. In other embodiments, the enclosure layer 430 can comprise deformable surfaces 432 corresponding to some microfluidic elements 414 but not other microfluidic elements 414. For example, the enclosure layer 430 can comprise deformable surfaces 432 corresponding to the channel 122 but not one or more of the chambers 418. As another example, the enclosure layer 430 can comprise deformable surfaces 432 corresponding to one or more of the chambers 418 but not the channel 122.

The enclosure layer 430 can comprise deformable and resilient material substantially only at the locations of the deformable surfaces 432. The enclosure layer 430 can thus be deformable and resilient (e.g., elastic) substantially only at the deformable surfaces 432 but otherwise be relatively rigid. Alternatively, all or most of the enclosure layer 430 can comprise a deformable and resilient material, and all or most of the enclosure layer 430 can thus be deformable and resilient. Thus, for example, the enclosure layer 430 can be entirely elastic. In such an embodiment, the entire enclosure layer 430 can be deformable and thus be a deformable surface 432. Regardless of whether the enclosure layer 430 is substantially entirely deformable or comprises deformable material only at the deformable surfaces 432, examples of the deformable material include rubber, plastic, elastomer, silicone, PDMS, or the like. The enclosure layer 430 may further include the upper electrode, which may be formed from a conductive oxide, such as indium-tin-oxide (ITO), which may be coated on the bottom surface of the enclosure layer 430. The deformable surface(s) 432 may also include the conductive coating forming the upper electrode. In other embodiments, the upper electrode may be formed within the enclosure layer 430, using a flexible mesh electrode incorporated within the enclosure layer 430, and the deformable surface(s) 432 may also include portions of the flexible mesh incorporation. For example, the flexible mesh electrode may include conductive nanowires or nanoparticles. In some embodiments, the conductive nanowires may include carbon nanowires or carbon nanotubes. See U.S. Patent Publication No. 2012/0325665, Chiou et al., herein incorporated in its entirety.

The cover 444 can be disposed on the enclosure layer 430 and can comprise a substantially rigid material. The cover 444 can thus be substantially rigid. The cover 444 can comprise through-holes 446 for the actuators 434. The through-holes 446 can be aligned with one or more of the deformable surfaces 432. The biasing electrode 452 can include similar through-holes 456 aligned with the cover through-holes 446. The through-holes 446, 456 can thus follow contours of the microfluidic elements 414 (e.g., the channel 122 and chambers 418). Although the cover 444 is above the enclosure layer 430, which is above the microfluidic structure 416, which is above the base 440 in FIGS. 1A-2, the foregoing orientations can be different. For example, the base 440 can be disposed above the microfluidic structure 416, which can be above the enclosure layer 430, which can be above the cover 444.

The enclosure layer 430 can be structurally distinct from but attached to the microfluidic structure 416 as illustrated in FIGS. 4A, 4B and 5. Alternatively, the enclosure layer 430 can be integrally formed and thus be part of the same integral structure as the microfluidic structure 416. In such an embodiment, the enclosure layer 430 can comprise the same material as the microfluidic structure 416. In other embodiments, the enclosure layer 430 can comprise different material than the microfluidic structure 416.

Similarly, the cover 444 can be a structurally distinct element (as illustrated in FIGS. 4A, 4B and 5) from the enclosure layer 430 and/or the microfluidic structure 416. Alternatively, the cover 444 can be integrally formed and thus be part of the same integral structure as the enclosure layer 430 and/or the microfluidic structure 416. The base 440 can likewise be a structurally distinct element that is attached to the microfluidic structure 416 or integrally formed and thus part of the same integral structure as the microfluidic structure 416, the enclosure layer 430, and/or the cover 444. In some embodiments, a cover 444 is not included. Thus, for example, the enclosure layer 430 can function as the cover 444.

The actuators 434 can be disposed in cover through-holes 446 and electrode through-holes 456 such that the actuators 434 pass through those through-holes 446, 456 and abut or are disposed in immediate proximity to the deformable surfaces 432 of the enclosure layer 430. The actuators 434 can be supported and held in position in any suitable manner. For example, the actuators 434 can be disposed in a holding apparatus (not shown), which can be separate from the microfluidic device 420. Alternatively, the actuators 434 can be part of the microfluidic device 420. For example, the actuators 434 can be attached to or otherwise mounted on the microfluidic device 420. As another example, the actuators 434 can be integral with the microfluidic device 420.

The actuators 434 can be any type of actuator or microactuator that can deform a deformable surface 432 sufficiently to generate a localized flow of medium (not shown) in a microfluidic circuit element 414. Examples of the actuators 434 include actuating mechanisms comprising piezoelectric material (e.g., a piezoelectric element or stack comprising lead zirconate titanate (PZT), piezocrystal, piezopolymer, or the like) that expands or contracts in response to a change in a voltage applied to the piezoelectric material. As another example, the actuators 434 can comprise mechanisms other than a piezoelectric material. Examples of alternative mechanisms for the actuators 434 include a voice coil and the like. Also, as noted, one or more of the actuators 434 can be a microactuator.

In FIG. 4B, each actuator 434 is shown in an un-actuated position. As will be seen, each actuator 434 can be actuated to move into contact with and press a corresponding deformable surface 432 toward and into one of the microfluidic circuit elements 414, which can decrease the volume of the enclosure 102 or the microfluidic element 414 in the immediate vicinity of the pressed deformable surface 432. Alternatively or in addition, an actuator 434 can be attached to a deformable surface 432 and be configured to pull the deformable surface 432 away from the corresponding microfluidic element 414, which can increase the volume of the enclosure 102 or the microfluidic element 414 in the immediate vicinity of the pulled deformable surface 432. Pulling on a deformable surface may be accomplished in a number of ways. The actuator may include a hollow core needle that does not pierce the deformable surface but can be attached to a source of vacuum, thereby pulling on the deformable surface by application of vacuum to the deformable surface. Alternatively, the actuator may be permanently fastened to the deformable surface, for example, by gluing the actuator to the surface. In yet another embodiments, the actuator may include a forceps or other gripping device, which may pinch portions of the deformable surface within its grip, and thereby permit pulling on the deformable surface. Hereinafter, the foregoing positions in which an actuator 434 is moved into pressing contact with a deformable surface 432 and presses the deformable surface 432 into the corresponding microfluidic element 414 or is moved away from a deformable surface 432 and pulls the deformable surface away from the corresponding microfluidic element 414 are referred to as "actuated positions." Each actuator 434 can be individually controllable (e.g., by the control system 470) to be moved between the un-actuated position shown in FIG. 4B and one or both of the actuated positions discussed above. As noted, among other things, the control system 470 can individually control the actuators 434 and thus individually actuate and de-actuate one or more or selected patterns or combinations of the actuators 434.

In FIGS. 4A, 4B, and 5, one actuator 434 is illustrated as corresponding to one deformable surface 432. There is thus a one-to-one ratio of actuators 434 to deformable surfaces 432 in the examples illustrated in FIGS. 4A, 4B, and 5. There can, however, be a many-to-one ratio and/or a one-to-many ratio of actuators 434 to deformable surfaces 432. Thus, for example, a plurality of actuators 434 can abut, be immediately adjacent to, or be coupled to one deformable surface 432. As another example, one actuator 434 can abut, be immediately adjacent to, or be coupled to a plurality of deformable surfaces 432.

FIG. 4A illustrates an example of the control system 470. As shown, the system 470 can comprise a controller 154 and control/monitoring equipment 168. The controller 154 can be configured to control and monitor the device 420 directly and/or through the control/monitoring equipment 168.

The controller 154 can comprise a digital processor 156 and a digital memory 158. The processor 156 can be, for example, a digital processor, computer, or the like, and the digital memory 158 can be a digital memory for storing data and machine executable instructions (e.g., software, firmware, microcode, or the like) as non-transitory data or signals. The processor 156 can be configured to operate in accordance with such machine executable instructions stored in the memory 158. Alternatively or in addition, the processor 156 can comprise hardwired digital circuitry and/or analog circuitry. The controller 154 can thus be configured to perform any process (e.g., process 1600 of FIG. 16), step of such a process, function, act, or the like discussed herein. The controller 154 may be further configured to control and other components of the system as shown in FIG. 1. The system may contain include any of the modules as shown in FIG. 1, including but not limited to media module 160, motive module 162, imaging module 164, tilting module 166, other modules 168, input/output device 172, or display device 170. The controller 154 may further include a flow controller (not shown) for generation and control of fluidic flow in the microfluidic device.

In addition to comprising equipment for individually actuating and de-actuating the actuators 434, the control/monitoring equipment 168 can comprise any of a number of different types of equipment for controlling or monitoring the microfluidic device 420 and processes performed with the microfluidic device 420. For example, the equipment 168 can include power sources (not shown) for providing power to the microfluidic device 420; fluidic media sources (not shown) for providing fluidic media to or removing media from the microfluidic device 420; motive modules (not shown) for controlling selection and movement of micro-objects (not shown) in the microfluidic circuit elements 414 other than for generating localized flow of medium in the enclosure 102; image capture mechanisms (not shown) for capturing images (e.g., of micro-objects) inside the microfluidic elements 414; stimulation mechanisms (not shown) for directing energy into the microfluidic elements 414 to stimulate reactions; or the like. As noted, the base 440 can be configured to selectively induce localized DEP forces in the enclosure 102. If the base 440 is so configured, the control/monitoring equipment 168 can comprise motive modules for controlling generation of localized DEP forces to select and/or move micro-objects (not shown) in one or more of the microfluidic elements 414.

In some embodiments, the volume of the enclosure 102, the volume of any of the microfluidic circuit elements 414, or the volume of a region of one of the microfluidic elements 414 corresponding to one of the deformable surfaces 434 can be in any of the following ranges: about $1\times10^6$ $\mu m^3$ to about $1\times10^8$ $\mu m^3$; about $1\times10^7$ $\mu m^3$ to about $1\times10^9$ $\mu m^3$; and about $1\times10^8$ $\mu m^3$ to about $1\times10^{10}$ $\mu m^3$. In some embodiments, a volume of the enclosure 102 can be at least $1.0\times10^7$ $\mu m^3$; at least $2.0\times10^7$ $\mu m^3$; at least $3.0\times10^7$ $\mu m^3$; at least $4.0\times10^7$ $\mu m^3$; at least $5.0\times10^7$ $\mu m^3$; at least $6.0\times10^7$ $\mu m^3$; at least $7.0\times10^7$ $\mu m^3$; at least $8.0\times10^7$ $\mu m^3$; at least $9.0\times10^7$ $\mu m^3$; at least $1.0\times10^8$ $\mu m^3$; or more. Alternatively or in addition, the volume of the enclosure 102 can be less than or equal to $1.0\times10^{10}$ $\mu m^3$; less than or equal to $2.0\times10^{10}$ $\mu m^3$; less than or equal to $3.0\times10^{10}$ $\mu m^3$; less than or equal to $4.0\times10^{10}$ $\mu m^3$; less than or equal to $5.0\times10^{10}$ $\mu m^3$; less than or equal to $6.0\times10^{10}$ $\mu m^3$; less than or equal to $7.0\times10^{10}$ $\mu m^3$; less than or equal to $8.0\times10^{10}$ $\mu m^3$; or less than or equal to $9.0\times10^{10}$ $\mu m^3$; or less than or equal to $1.0\times10^{11}$ $\mu m^3$. The foregoing numerical values and ranges are examples only and not intended to be limiting.

Figure 6A:
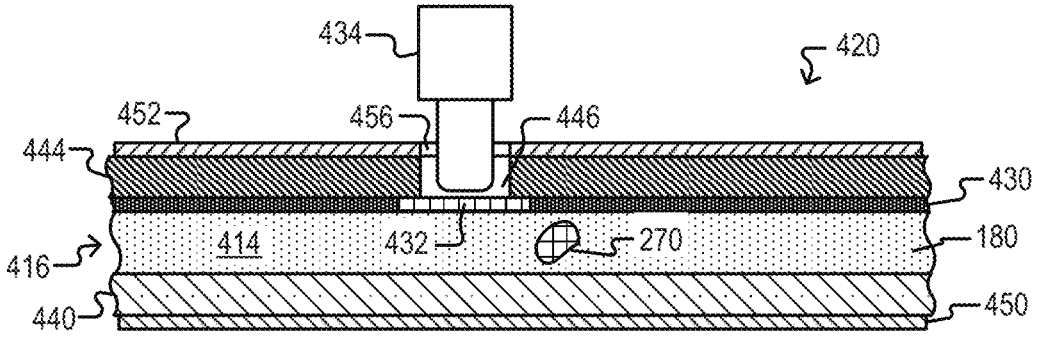
FIG. 6A is a cross-sectional side partial view of the microfluidic device of FIG. 4A showing an actuator positioned immediately adjacent to or abutting a corresponding deformable surface according to some embodiments of the invention.
Figure 6B:
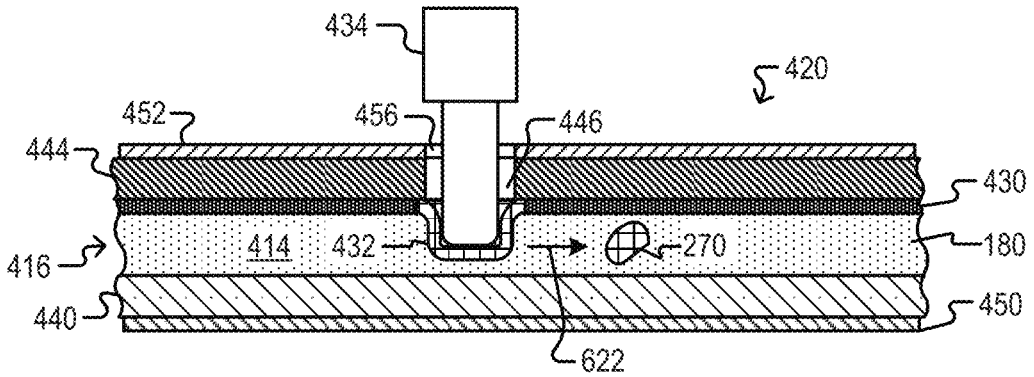
FIG. 6B shows the actuator of FIG. 6A actuated to push the deformable surface into a microfluidic element of the device according to some embodiments of the invention.

FIGS. 6A and 6B illustrate an example in which one of the actuators 434 is actuated to create a localized flow 622 of medium 180 in one of the microfluidic circuit elements 414. The localized flow 622 can be sufficient to move a micro-object 270 within the enclosure 102. For example, the localized flow 622 can move the micro-object 270 within one of the microfluidic elements 414, between two of the microfluidic elements 414, or the like. In doing so, the localized flow 622 can move the micro-object 270 from a first position of the micro-object prior to actuation of the actuator 434 to a second position that is different than the first position.

The micro-object 270 can be an inanimate micro-object or a biological micro-object. Examples of inanimate micro-objects include microbeads, microrods, or the like. Examples of biological micro-objects include biological cells such as mammalian cells, eukaryotic cells, prokaryotic cells, or protozoan cells.

The enclosure 102 including the microfluidic elements 414 can be substantially filled with a fluidic medium 180, which can be any type of liquid or gaseous fluid. For example, the medium 180 can comprise an aqueous solution. As another example, the medium 180 can comprise an oil-based solution. In some embodiments, the medium 180 can have a low viscosity. In some embodiments, the medium 180 can comprise a culture medium in which biological cells can be cultured. For example, the medium 180 can have a relatively high electrical conductivity.

Although not shown in the drawings, the enclosure 102 can comprise more than one type of medium 180. For example, one of the microfluidic circuit elements 414 (e.g., a chamber 418) can contain one type of medium, and another of the microfluidic elements 414 (e.g., the channel 122) can contain a different type of medium. As another example, there can be more than one type of medium in one or more of the microfluidic elements 414. If the enclosure 102 of the microfluidic device 420 contains more than one type of medium, one of the types of media can be immiscible in another of the types of media. For example, one medium can be an aqueous solution, and another medium can comprise an oil based solution.

When the term "first medium" is used herein to refer to a medium in one region, portion, or microelement 414 of the enclosure 102, and the term "second medium" is used to refer to a medium in another region, portion, or microelement 414 of the enclosure 102, the first medium and the second medium can be different types of media or the same type of medium.

In FIG. 6A, the actuator 434 is in an un-actuated position, and can be immediately adjacent to or abut a deformable surface 432. In an actuated position illustrated in FIG. 6B, the actuator 434 moves toward and into the microfluidic circuit element 414, pressing the deformable surface 432 into the microfluidic element 414. This can decrease the volume of the microfluidic element 414 (and consequently the enclosure 102) at the deformable surface 432. This can push medium 180 out of the temporarily decreased space below the stretched deformable surface 432, which can create a localized flow 622 in the microfluidic element 414 sufficient to move a nearby object 270 in the direction of the localized flow 622.

Figure 7:
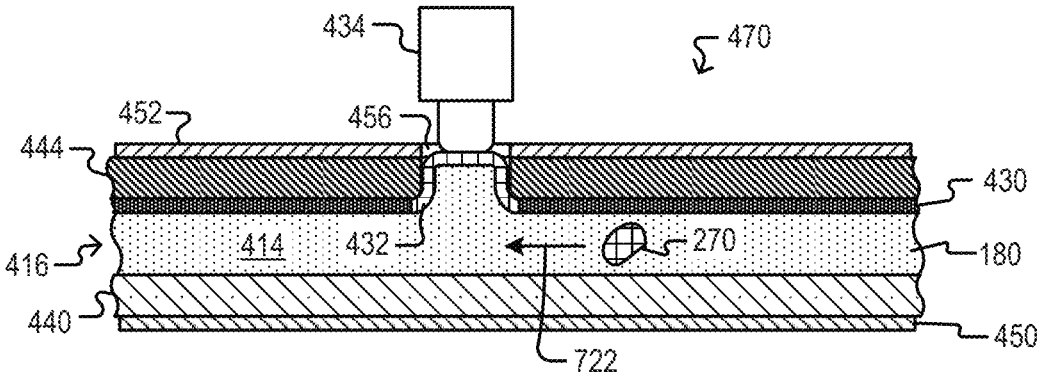
FIG. 7 shows the actuator of FIG. 6A actuated to pull the deformable surface away from the microfluidic element of the device according to some embodiments of the invention.

FIG. 7 illustrates an example in which the actuator 434 is attached to the deformable surface 432 and configured to pull the deformable surface 432 away from microfluidic element 414. In an actuated position illustrated in FIG. 7, the actuator 434 moves away from the microfluidic element 414, pulling the deformable surface 432 away from the microfluidic element 414. This can increase the volume of the microfluidic element 414 (and consequently the enclosure 102) at the deformable surface 432, which can draw medium 180 into the temporarily expanded space below the stretched deformable surface 432, creating a localized flow 722 of medium 180 sufficient to move a nearby micro-object 270 in the direction of the localized flow 722. In some embodiments, the actuator 434 can utilize suction to pull the deformable surface 432 away from the microfluidic element 414. In such embodiments, the actuator 434 need not be attached to the deformable surface 432.

Figure 8:
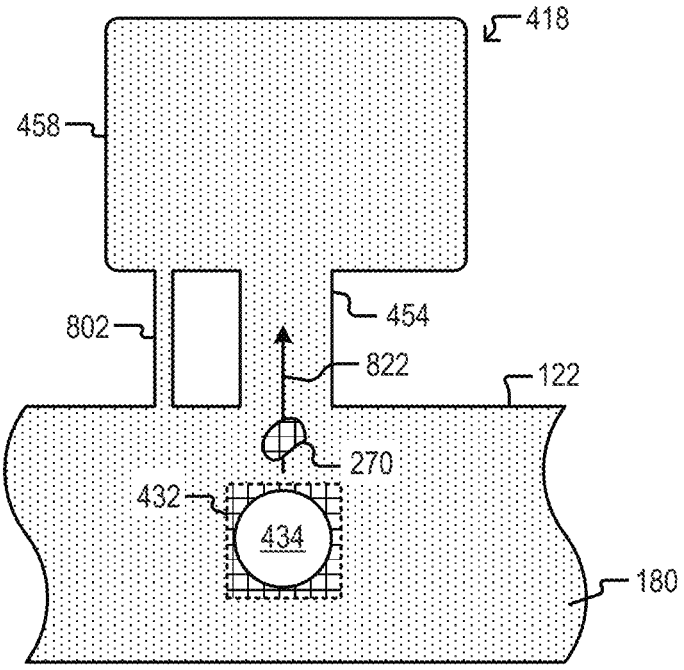
FIG. 8 is an example in which an actuator in a channel of the microfluidic device creates a localized flow of medium to move a micro-object from the channel into a chamber according to some embodiments of the invention.

FIG. 8 illustrates an example in which an actuator 434 is immediately adjacent to or abuts a deformable surface 432 that is part of the channel 122 and adjacent to a connection region 454 of a chamber 418. A micro-object 270 positioned between the actuator 434 and the connection region 454 can be moved into the chamber 418 by actuating the actuator 434 to press the deformable surface 432 into the channel 122, generally as illustrated in FIG. 6B and discussed above. This can generate a localized flow 822 of the medium 180 away from the actuated actuator 434, which can move the micro-object 270 into the connection region 454 or the isolation region 458 of the chamber 418.

As also illustrated in FIG. 8, one or more pressure relief passages 802 can provide an outlet for medium 180 that flows 822 into the isolation region 458. As shown, such a pressure relief passage 802 can be a secondary fluidic connection from the isolation region 458 to the channel 122. Although not shown, the pressure relief passage 802 can alternatively be from the isolation region 458 to another microfluidic circuit element 414 such as another channel (e.g., like channel 122), a well (e.g., like 1318 in FIG. 13), a reservoir (e.g., like reservoirs 1718 in FIG. 17), or the like. As yet another example, the pressure relief passage 802 can be to an outlet (e.g., like port 460). Regardless, a width of the pressure relief passage 802 can be relatively small. For example, the width of the pressure relief passage 802 can be less than the width of the connection region 454. As another example, the width of the pressure relief passage 802 can be less than a size of the micro-object 270, which can preclude the micro-object 270 from exiting the isolation region 458 through the pressure relief passage 802.

Figure 9:
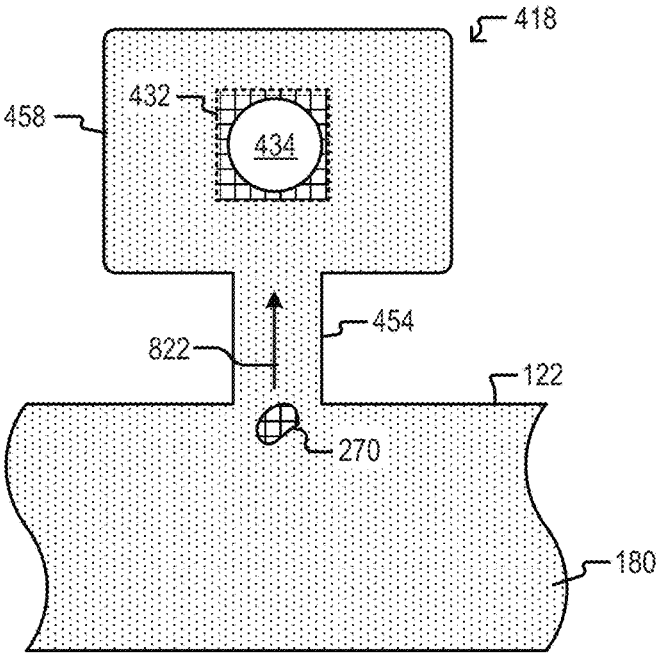
FIG. 9 is an example in which an actuator in a chamber of the microfluidic device creates a localized flow of medium to move a micro-object from the channel into the chamber according to some embodiments of the invention.

FIG. 9 shows a similar example except that the actuator 434 corresponds to a deformable surface 432 that is part of the isolation region 458 of the chamber 418. The actuator 434 in FIG. 9 can be configured to pull the deformable surface 432 away from the chamber 418 generally as illustrated in FIG. 7. When actuated, the actuator 434 can thus generate a localized flow 822 of medium 180 from the channel 122 into the connection region 454 and/or the isolation region 458 of the chamber 418, generally in accordance with the discussion above of FIG. 7. This can draw a micro-object 270 from the channel 122 into the chamber 418.

The examples illustrated in FIGS. 8 and 9 can alternatively be configured in reverse. For example, the actuator 434 in FIG. 8 can be configured to pull the deformable surface 432, as illustrated in FIG. 7, generating a localized flow (not shown but would be opposite the localized flow 822) of medium 180 from the chamber 418 into the channel 122. The foregoing can draw a micro-object 270 from the chamber 418 into the channel 122.

As another example, the actuator 434 in FIG. 9 can be configured to press the deformable surface 432, as illustrated in FIG. 6B, generating a localized flow (not shown but would be opposite the localized flow 822) of medium 180 from the chamber 418 into the channel 122. The foregoing can move a micro-object 270 from the chamber 418 into the channel 122.

As yet another example, there can be an actuator 434 at a deformable surface 432 of the channel 122 as shown in FIG. 8 and another actuator 434 at a deformable surface 432 of the chamber 418 as shown in FIG. 9. The actuator 434 corresponding to the channel 122 can be activated to press the deformable surface 432 into the channel 122, creating the flow 822 into the chamber 418 as shown in FIG. 8. Substantially simultaneously, the actuator 434 corresponding to the chamber 418 can be activated to pull the deformable surface 432 away from the chamber 418, creating the flow 822 into the chamber 418 as shown in FIG. 9. Alternatively, the foregoing can be done in reverse: the actuator 434 corresponding to the channel 122 can pull the deformable surface 432 away from the channel 122, and at the same time, the actuator 434 corresponding to the chamber 418 can push the deformable surface into the chamber 418. The foregoing can create a localized flow of the medium 180 out of the chamber 418 into the channel 122.

As noted, the connection region 454 of each chamber 418 can be configured so that the maximum penetration depth of a flow of medium 180 in the channel 122 extends into the connection region 454 but not the isolation region 458. There can thus be substantially no flow of medium 180 between the channel 122 and the isolation regions 458 of the chambers 418 in either direction except when one or more actuators 434 are actuated as illustrated in FIG. 8 or 9 and/or as discussed above. The foregoing can be the case regardless of any other flows (e.g., a flow of medium 180 in the channel 122 between a port 460 at one end of the channel 122 and another port 460 at another end of the channel 122) of medium 180 in the enclosure 102.

Figure 10:
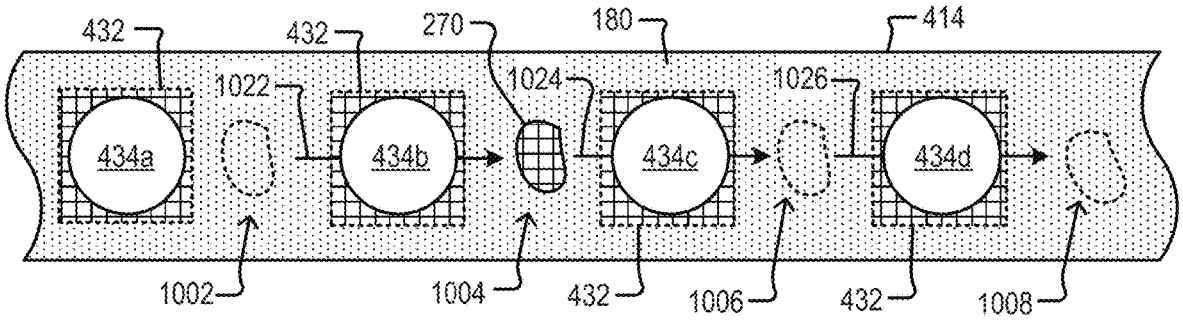
FIG. 10 illustrates an example in which a series of actuators are sequentially activated to move a micro-object within the microfluidic device according to some embodiments of the invention.

FIG. 10 is an example in which a plurality of actuators 434*a*-434*d* are disposed sequentially in a microfluidic circuit element 414 (e.g., the channel 122). As shown, the actuators 434*a*-434*c* can be actuated in sequence, starting with actuator 434*a* and ending with actuator 434*c*. Such sequential actuation can move the micro-object 270 along a path (which can be substantially linear) from an initial position 1002 to a final/other position 1008. For example, a first of the actuators 434*a* can be actuated to press a corresponding deformable surface 432 and create a first localized flow 1022 of the medium 180, moving the micro-object 270 from the initial position 1002 adjacent to the first actuator 434*a* to a second position 1004 adjacent to a second actuator 434*b*. The second actuator 434*b* can then be actuated to press a corresponding deformable surface 432 (while optionally de-actuating the first actuator 434*a*) to create a second localized flow 1024, moving the micro-object 270 from the second position 1004 to a third position 1006 adjacent to a third actuator 434*c*. The third actuator 434*c* can then be actuated to press a corresponding deformable surface 432 (while optionally de-actuating the second actuator 434*b*) (while optionally de-actuating the first actuator 434*a*) to create a third localized flow 1026, further moving the micro-object 270 from the third position 1006 to the final/other position 1008. A micro-object 270 can thus be moved from an initial position 1002 to another position 1008 by sequentially activating the first actuator 434*a* and then a plurality of actuators 434*b*, 434*c* between the initial position 1002 and the final/other position 1008.

In the example illustrated in FIG. 10, the actuators 434*a*-434*c* are configured to push their corresponding deformable surfaces 432 (as in FIG. 6B). The actuators 434*a*-434*d* could alternatively be configured to pull their deformable surfaces 432 (as in FIG. 7) and move the micro-object 270 from position 1008 to position 1002 by sequentially actuating actuator 434*d*, then actuator 434*c* (while optionally de-actuating actuator 434*d*), and then actuator 434*b* (while optionally de-actuating actuator 434*c*). Also, although illustrated as distinct separated surfaces 432, the deformable surfaces 432 can instead be one relatively larger surface.

Figure 11:
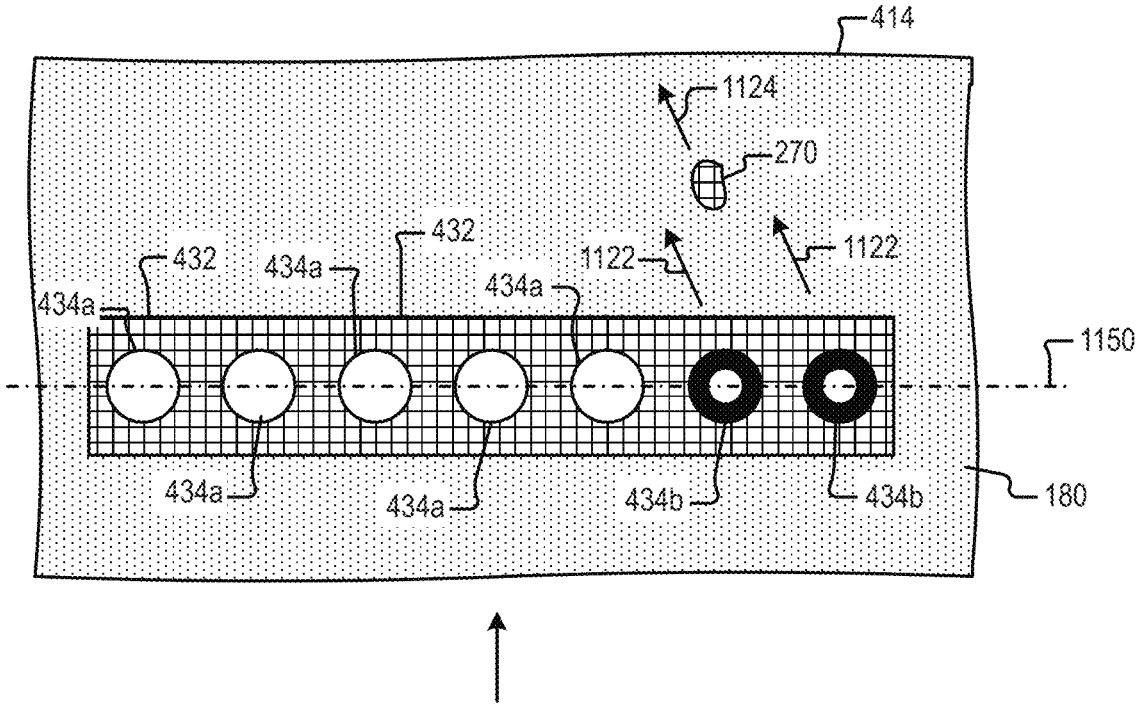
FIGS. 11 and 12 illustrate examples of a plurality of actuators being actuated in a selected pattern to direct movement of a micro-object according to some embodiments of the invention.
Figure 12:
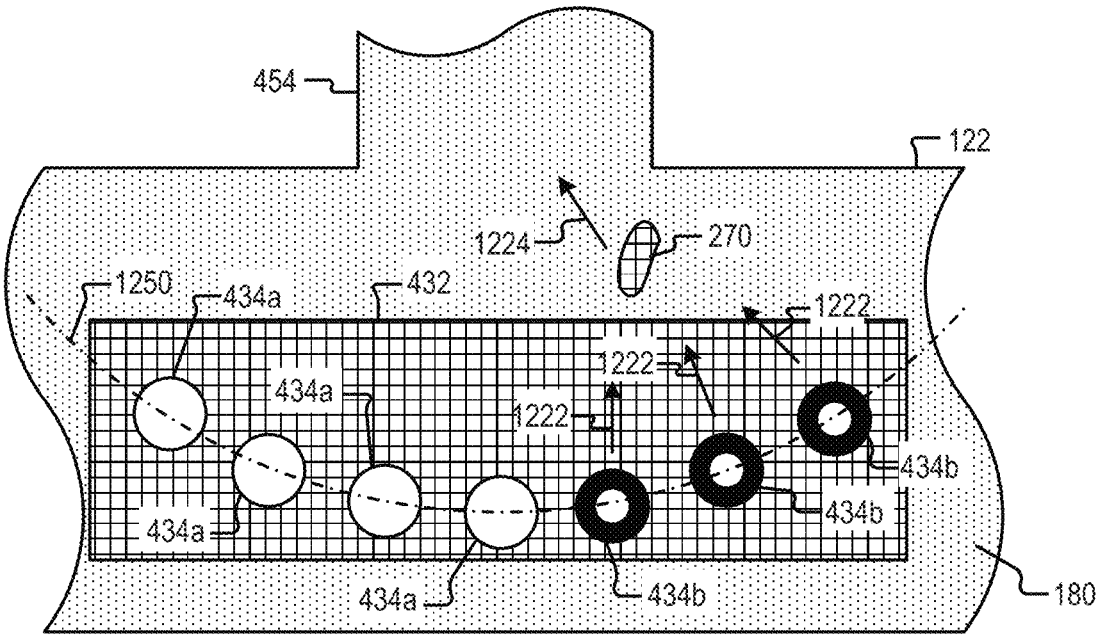

FIGS. 11 and 12 are examples in which actuators 434*a* and 434*b* are disposed in a pattern relative to a deformable surface 432 and selectively activated to create multiple localized flows 1122, 1222 to move 1124, 1224 a nearby micro-object 270.

In FIG. 11, actuators 434*a*, 434*b* are in a linear pattern (e.g., disposed on a substantially linear axis 1150) and each is configured to deform a different region of a deformable surface 432. In the illustrated example, only actuators 434*b* are activated, creating localized flows 1122 from the activated actuators 434*b* but not from the un-actuated actuators 434*a*. The localized flows 1122 can move a nearby micro-object 270 in a direction 1124 that is a composite of the localized flows 1122. Although two of the actuators 434*b* are illustrated in FIG. 11 as actuated, any subgroup (including a subgroup consisting of all) of the actuators 434*a*, 434*b* can be selectively actuated.

In FIG. 12, actuators 434*a*, 434*b* are disposed along a curve 1250. For example, the curve 1250 can be an arc of a circle, an arc of an oval, or the like. As another example, the curve 1250 can be parabolic. The actuators 434*a*, 434*b* can partially surround the micro-object 270. For example, a portion (but not all) of the micro-object 270 can appear surrounded by the actuators 434*a*, 434*b* when the micro-object 270 is observed from an observation point that lies on a line that (i) passes through the micro-object 270 (and also the deformable surface 432 if the micro-object 270 is disposed below or above the deformable surface 432), and (ii) is perpendicular to the plane of the deformable surface 432. Although not illustrated in FIG. 12, such a line can be out of the page of FIG. 12 and pass through the micro-object 270. In the illustrated example, only actuators 434*b* are activated, creating localized flows 1222 that can move a nearby micro-object in a direction 1224 that is a composite of the flows 1222. Although three of the actuators 434*b* are illustrated in FIG. 12 as actuated, any subgroup (including a subgroup consisting of all) of the actuators 434*a*, 434*b* can be selectively actuated.

The patterns of actuators 434*a*, 434*b* illustrated in FIGS. 11 and 12 can be provided for any of the microfluidic circuit elements 414. For example, the pattern of actuators 434*a*, 434*b* illustrated in FIG. 11 can be provided for a channel 122. As another example, the pattern of actuators 434*a*, 434*b* shown in FIG. 12 can be provided for a channel 122 and face a connection region 458 having a distal opening to a corresponding isolation region 458, as illustrated in FIG. 12.

Figure 13:
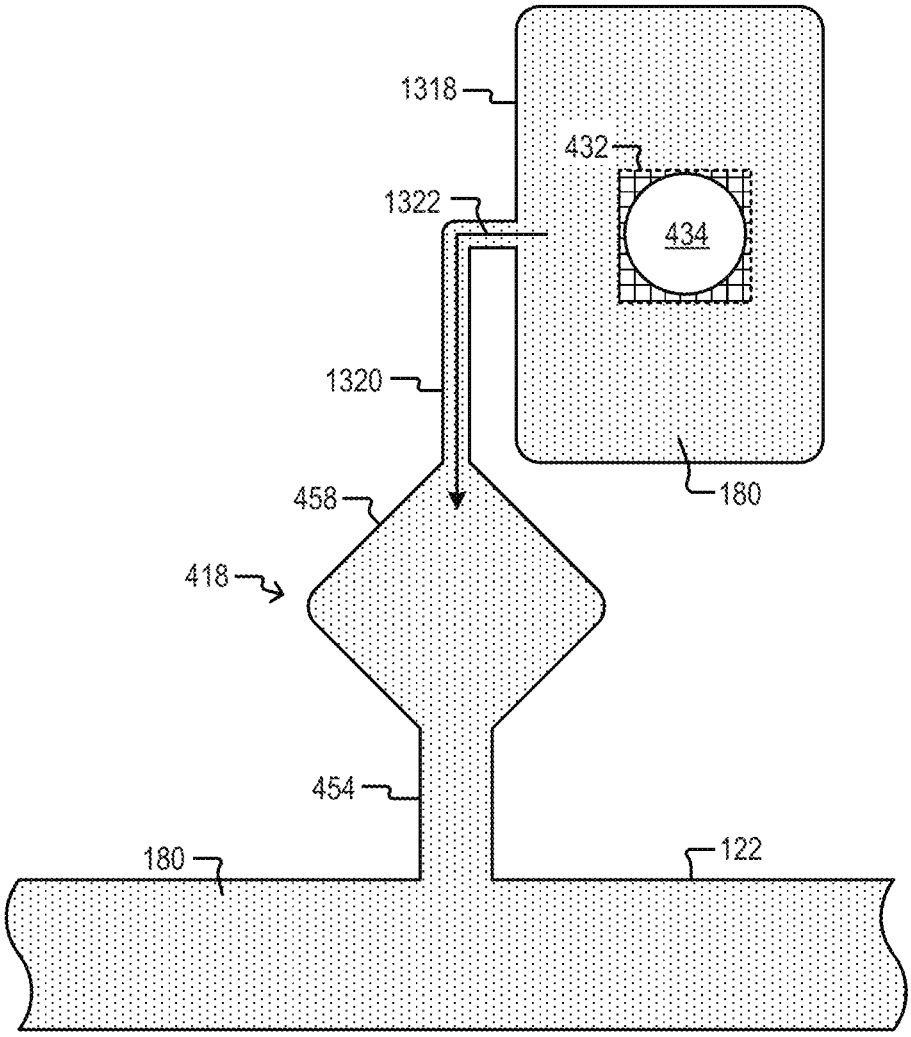
FIG. 13 is an example of microfluidic elements in the form of a channel, a chamber, and a well according to some embodiments of the invention.

FIG. 13 illustrates an example of a microfluidic well 1318, which can be another example of a microfluidic circuit element 414. As shown, a fluidic connector 1320 can connect the well 1318 to the isolation region 458 of a chamber 418. In some embodiments, at least a portion of the fluidic connector 1320 can be align with at least a portion of the connection region 454. In some embodiments, a width of the connector 1320 can be less than the size of a micro-object (e.g., 270 in FIG. 5). As shown, the well 1318 can comprise a deformable surface 432. An actuator 434 can be configured to press the deformable surface 432 into the well 1318 (as illustrated in FIG. 6B) and thereby create a localized flow 1322 of medium 180 from the well 1318 through the connector 1320 into another microfluidic element 414 (which in the example illustrated in FIG. 13 is the isolation region 458 of the chamber 418). Alternatively, the actuator 434 can be configured to pull the surface 432 away from the well 1318 (as illustrated in FIG. 7) and thereby create a localized flow (not shown but can be opposite the flow 1322) of the medium 180 into the well 1318.

The volume of a well 1318 can be in any of the following ranges: at least $5.0\times10^5$ $\mu m^3$; at least $7.5\times10^5$ $\mu m^3$; at least $1.0\times10^6$ $\mu m^3$; at least $2.5\times10^6$ $\mu m^3$; at least $5.0\times10^6$ $\mu m^3$; at least $7.5\times10^6$ $\mu m^3$; at least $1.0\times10^7$ $\mu m^3$, or more. The volume of a well 1318 can additionally or alternatively be less than or equal to $1.0\times10^7$ $\mu m^3$; less than or equal to $2.5\times10^7$ $\mu m^3$; less than or equal to $5.0\times10^7$ $\mu m^3$; less than or equal to $7.5\times10^7$ $\mu m^3$; or less than or equal to $1.0\times10^8$ $\mu m^3$. In other embodiments, the well may have a volume in a range of about $5.0\times10^5$ $\mu m^3$ to about $1\times10^8$ $\mu m^3$; about $5.0\times10^5$ $\mu m^3$ to about $1\times10^8$ $\mu m^3$; about $5.0\times10^5$ $\mu m^3$ to about $1\times10^7$ $\mu m^3$; or about $5.0\times10^5$ $\mu m^3$ to about $5\times10^6$ $\mu m^3$. The foregoing numerical values and ranges are examples only and not intended to be limiting.

The volume of the well region 1318 can be at least 2 times greater, at least 3 times greater, at least 4 times greater, at least 5 times greater, at least 6 times greater, at least 7 times greater, at least 8 times greater, at least 9 times greater, at least 10 times greater, at least 15 times greater, or at least 20 times greater than the volume of the isolation region 454. The foregoing ranges and numerical values are examples only and not intended to be limiting.

Figure 14:
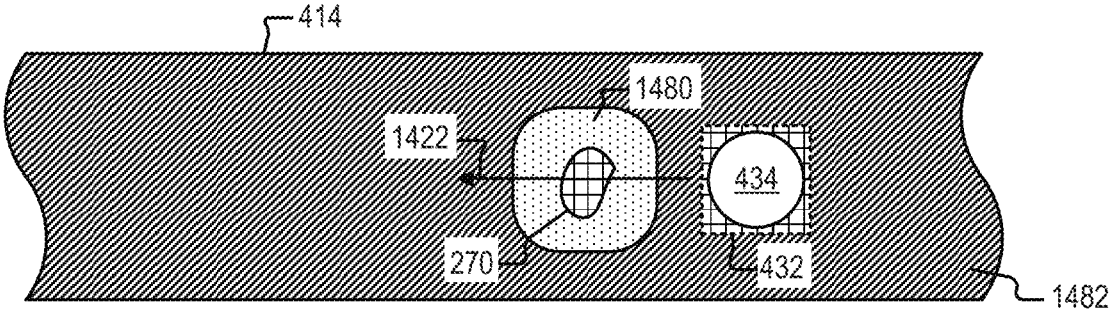
FIG. 14 shows an example of moving a droplet of a first medium within a second medium according to some embodiments of the invention.

FIG. 14 is an example in which a droplet of a first medium 1480 is disposed in a second medium 1482 in a microfluidic circuit element 414. An actuator 434 can be activated to create a localized flow 1422 of the second medium 1482, which can move the droplet of the first medium 1480 in the microfluidic element 414. A micro-object 270 can be disposed in the droplet of the first medium 1480 and move with the droplet. For example, the first medium 1480 can be an oil, and the second medium 1482 can be an aqueous solution, such as an aqueous buffer or a cell culture medium.

The droplet of the first medium 1480 can have any of the following sizes: about 100 pL; about 150 pL; about 200 pL; about 250 pL; about 300 pL; about 350 pL; about 400 pL; about 450 pL; about 500 pL; about 600 pL; about 700 pL; about 800 pL; about 900 pL; about 1 nL; about 2 nL, about 3 nL, about 4 nL, about 5 nL, about 10 nL, about 20 nL, about 30 nL, about 40 nL, about 50 nL, about 60 nL, about 70 nL, about 80 nL, about 90 nL, about 100 nL, or more. The size of the droplet of the first medium 1480 can be between any two of the foregoing data points. The foregoing numerical values and ranges are examples only and not intended to be limiting.

Figure 15B:
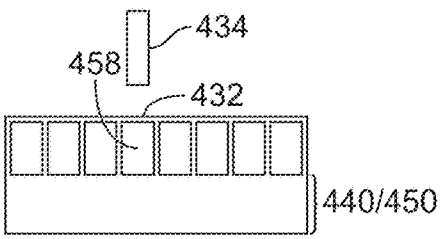
FIGS. 15A-F show images and graphical representations of the export of a micro-object from a chamber to a microchannel by actuating a local flow of medium from a well according to some embodiments of the invention.
Figure 15A:
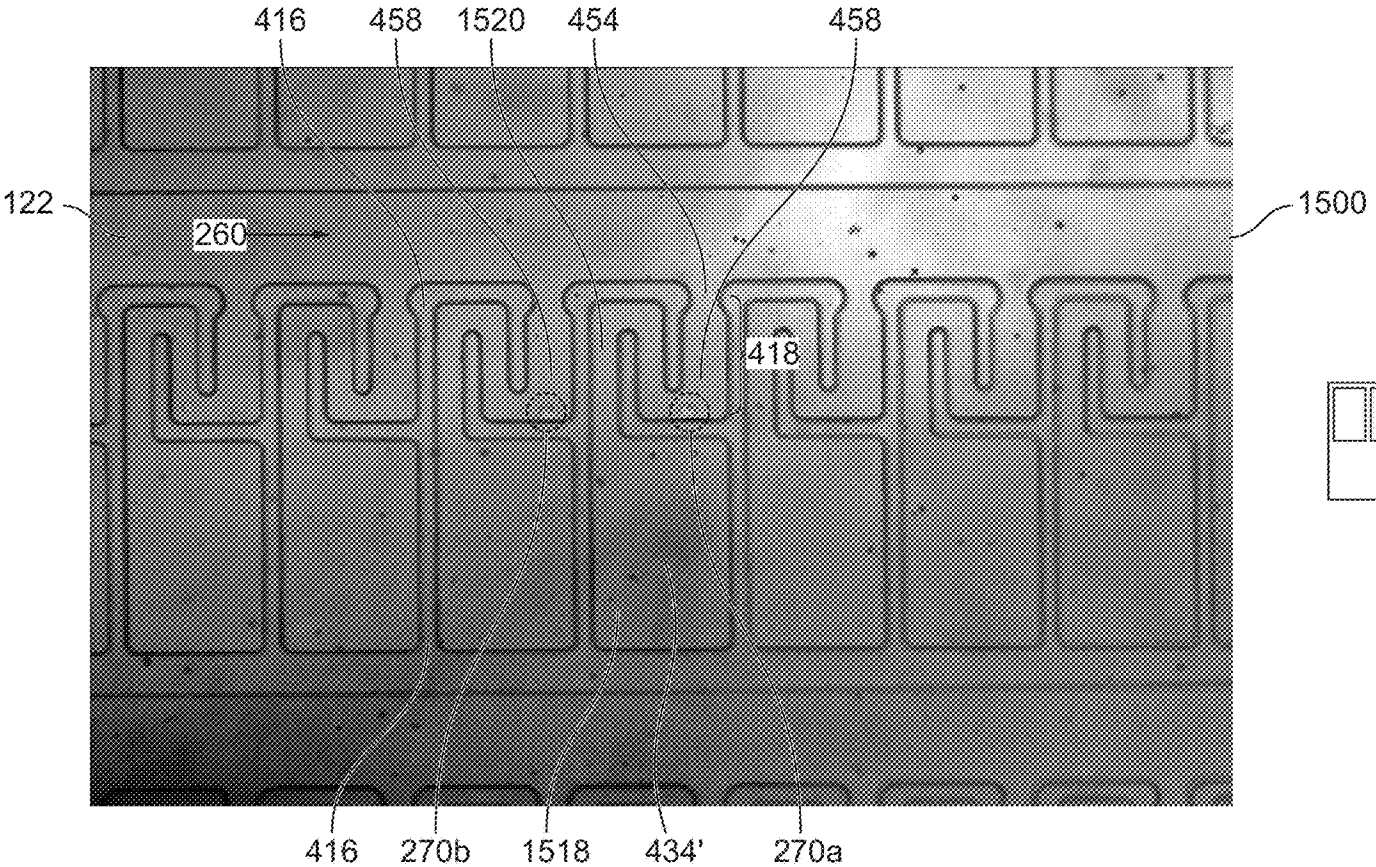

FIGS. 15A-F show an example of a microfluidic device having sequestration pens, each of which includes a microfluidic well that can provide a localized flow that can expel a micro-object from an isolation region of the sequestration pen. FIG. 15A shows a photographic image of a portion of microfluidic device 1500, which contains a plurality of sequestration pens 418, each having a well 1518 and a fluidic connector 1520 connecting the well to the isolation region 458 of the pen 418. The pens 418, wells 1518 and fluidic connectors 1520 are filled with fluidic medium 180 (not shown). The walls 416 of the sequestration pens 418, fluidic connectors 1520, and wells 1518 extend from the upper surface of the base 440 to the enclosure layer (not visible here). Within the illustrated portion of the device, micro-objects, which in this example are cells 270*a*, 270*b*, are located in the isolation regions 458 of adjacent sequestration pens 418. The sequestration pens may have a volume of about $6\times10^5$ $\mu m^3$, not including the volume of the fluidically connected wells 1518. The flow channel 122 has fluidic medium 180 (not shown) having a flow 260 in the channel 122, but the flow 260 does not enter the isolation regions 458 of the pens 418, as described above. An actuator 434 is positioned above, and not touching, the deformable surface 432 (not visible) of the well in this photograph. A graphic showing a side cross-sectional view of through the wells 1518 of the microfluidic device 1500 is shown in FIG. 15B. The shadow 434' of the bottom of the actuator 434 is visible in FIG. 15A, where the photograph was taken from below the base 440 and bottom electrode 450 of the microfluidic device.

Figure 15D:
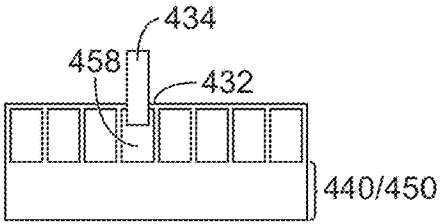
Figure 15C:
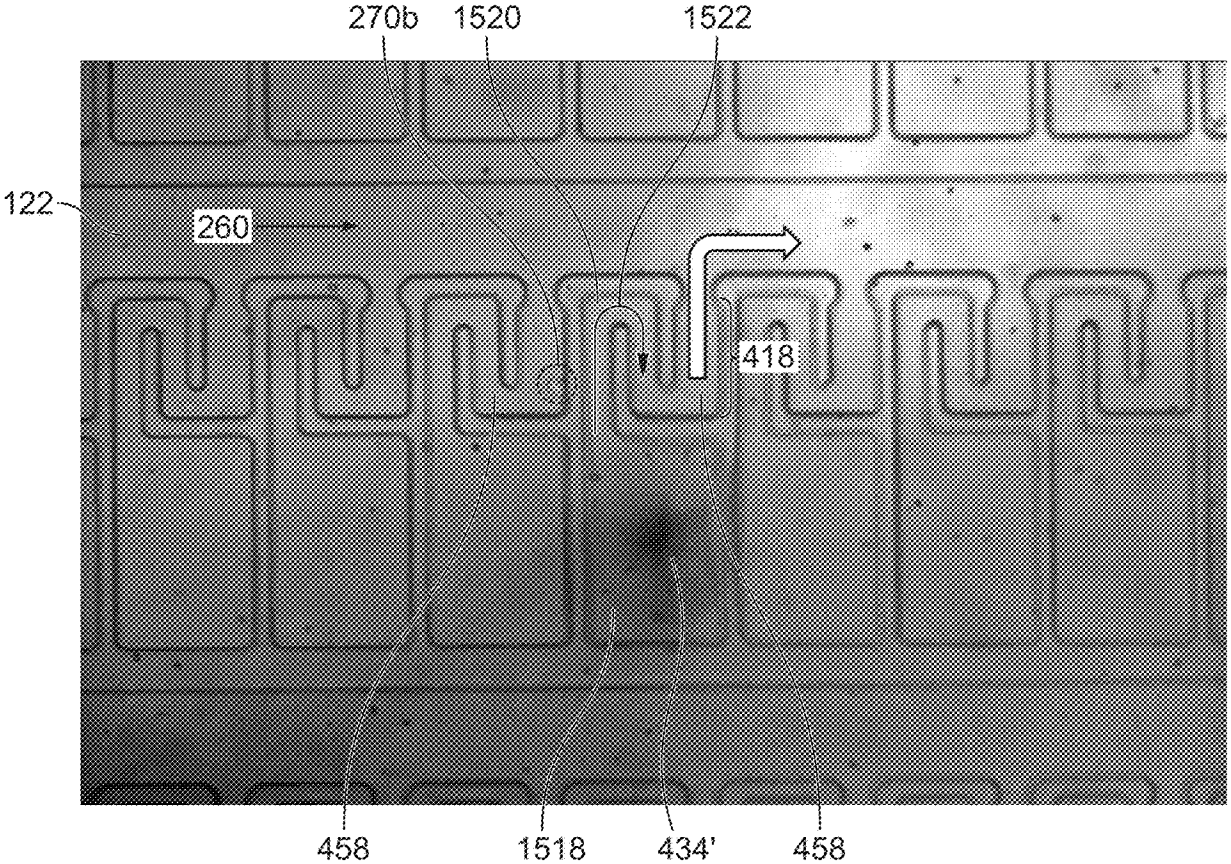

FIG. 15C is a photographic representation of the microfluidic device 1500 and cells contained therein, at the time when the actuator 434 has been actuated and is in an actuated position at the deformable surface 432 of the well 1518. A graphical representation of this actuated state is shown in FIG. 15D. The well 1518 has a volume of about $20\times10^5$ $\mu m^3$, providing about a 3:1 ratio of fluidic volume to that of the sequestration pen. While this ratio is useful, it is not limiting and displacement of a micro-object, particularly a biological micro-object may be effected using a well with a smaller volume (hence a smaller ratio of volumes relative to the sequestration pen.) A localized flow 1522 of medium 180 from the well 1518 through the fluidic connector 1520 was created, and flowed into the isolation region 458 of the sequestration pen 418 where the cell 270*a* had been. In this photograph, it can be seen that the cell 270*a* has been dislodged from the isolation region 458. The cell 270*a* has moved along a trajectory 1524 into the fluidic flow 260 in the flow channel 122 and has passed out of the photographic frame. The shadow 434' of the actuator is darkened and enlarged as it is in closer proximity to the photographic vantage point underneath the base 440/electrode 450 of the microfluidic device 1500, and its actuated position is denoted in the graphic of FIG. 15D showing the side cross-sectional view of microfluidic device 1500. In FIG. 15C, it is seen that cell 270*b* in the isolation region of the adjacent sequestration pen 418 is not disturbed by the localized flow 1522 created by the actuator 434. The export of cell 270*a* in the targeted sequestration pen is very selective.

Figure 15F:
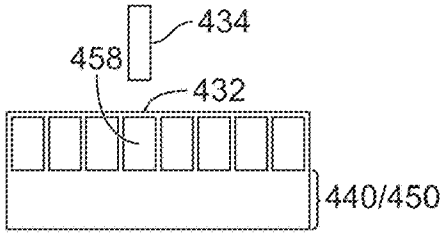
Figure 15E:
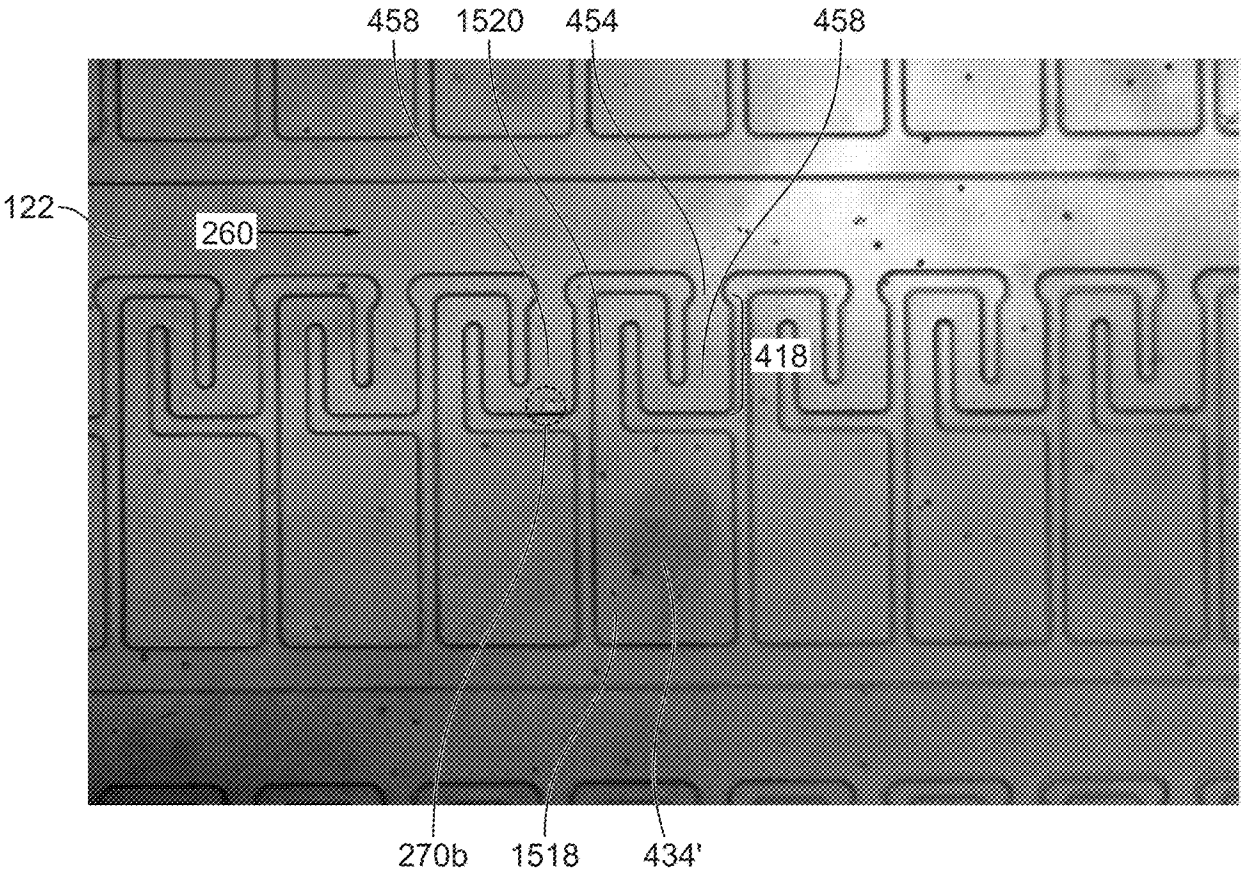

FIG. 15E is a photographic representation of the microfluidic device 1500 after the actuator 434 has been moved out of the actuated position. The localized flow 1522 has ended, and the actuator 434 has moved back to an unactuated position. A graphical representation of a side cross-sectional view of microfluidic device 1500 in FIG. 15F shows the disposition of the actuator 434 raised above the deformable surface 432 again. As a result of the actuation described above in connection with FIG. 15C, the targeted cell 270*a* was exported, while the cell 270*b* in the adjacent pen was not exported and remained in its respective isolation region of the adjacent sequestration pen 418. The shadow 434' of the bottom of the actuator 434 is less dense, indicating that it has moved away from contact with the device 1500.

In any of the examples illustrated in FIGS. 8-15A-F, the actuators 434 can be configured to press corresponding deformable surfaces 432 into a microfluidic circuit element 414 as illustrated in FIG. 6B. The actuators 432 can alternatively be configured to pull corresponding deformable surfaces 432 away from the microfluidic element 414 as illustrated in FIG. 7. Also, in any of the examples illustrated in FIGS. 6A-10, 13, 14 and 15A-F, a plurality of actuators 434 can be provided for a plurality of individual deformable surfaces 432 or for deforming a plurality of regions of a relatively large single deformable surface 432 (e.g., like the examples illustrated in FIGS. 11 and 12).

Figure 16:
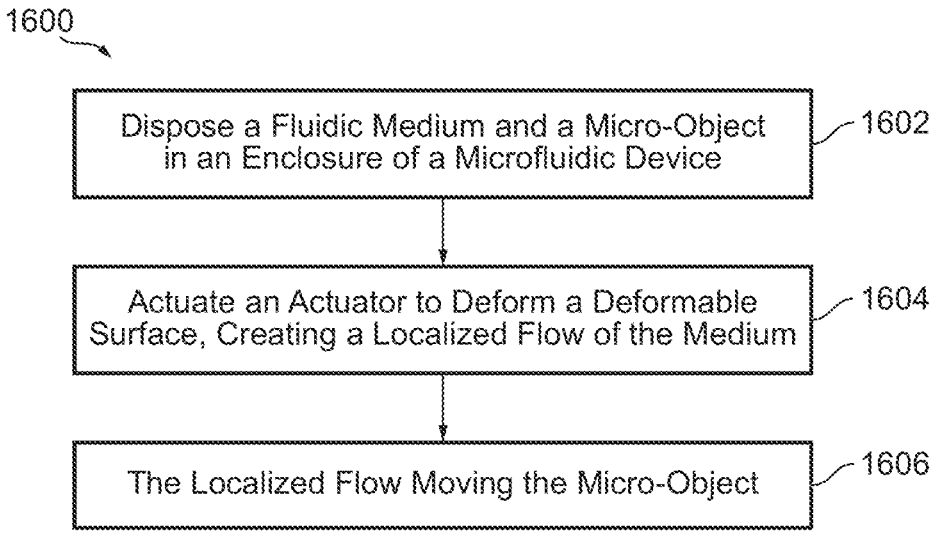
FIG. 16 illustrates a process that can be an example of operation of the microfluidic device of FIG. 4A according to some embodiments of the invention.

FIG. 16 illustrates a process 1600 that can be an example of operation of the microfluidic device 420 of FIGS. 4A-15A-F, including any variation or embodiment illustrated in FIGS. 6A-15A-F or mentioned or discussed herein.

At step 1602, a medium 180 containing a micro-object 270 can be disposed in the enclosure 102 of the microfluidic device 420 generally in accordance with the discussions above. The medium 180 can be a single type of medium as discussed above or can comprise multiple types of media. In accordance with the example shown in FIG. 14, the medium 180 can comprise a non-aqueous medium 1482 containing a droplet or droplets of an aqueous medium 1480.

At step 1604, an actuator 434 can be actuated to create a localized flow (e.g., localized flow 622, 722, 822, 1022, 1024, 1026, 1122, 1222, 1322, 1422 or 1522 of the medium 180 in the device 420 or 1500. For example, an actuator 434 can be actuated to press a deformable surface 432 into a microfluidic circuit element 414 as illustrated in FIG. 6B. As another example, an actuator 434 can be actuated to pull a deformable surface 432 away from a microfluidic element 414 as shown in FIG. 7. As another example, multiple actuators 434 can be actuated to create multiple localized flows of medium in the device 420, 1500. For example, multiple actuators 434 can be actuated simultaneously (e.g., as discussed above with respect to FIGS. 11 and 12). As another example, multiple actuators 434 can be actuated sequentially (e.g., as discussed above with respect to FIG. 10).

As indicated by step 1606, the localized flow(s) of medium 180 created at step 1604 can move the micro-object 270 from a first position to a second position in the enclosure 102 of the device 420, generally as discussed above. As another example, sequential actuation of a plurality of actuators 434 at step 1602 can move a micro-object 270 along a path as illustrated in and discussed above with respect to FIG. 10. As yet another example, the movement at step 1606 can move a micro-object 270 from one microfluidic circuit element 414 to another microfluidic element 414. For example, the movement at step 1606 can move a micro-object 270 from a microelement 414 comprising a flow path (e.g., the channel 122) into a chamber 418 or from a chamber 418 to the flow path as discussed above with respect to FIGS. 8 and 9. Substantially simultaneous actuation of multiple actuators 434 at step 1604 can move a micro-object 270 as discussed above with respect to FIGS. 11 and 12. As still another example, actuation of an actuator 434 can move a droplet of a first medium 1480 in a second medium 1482 as discussed above with respect to FIG. 14.

Figure 17:
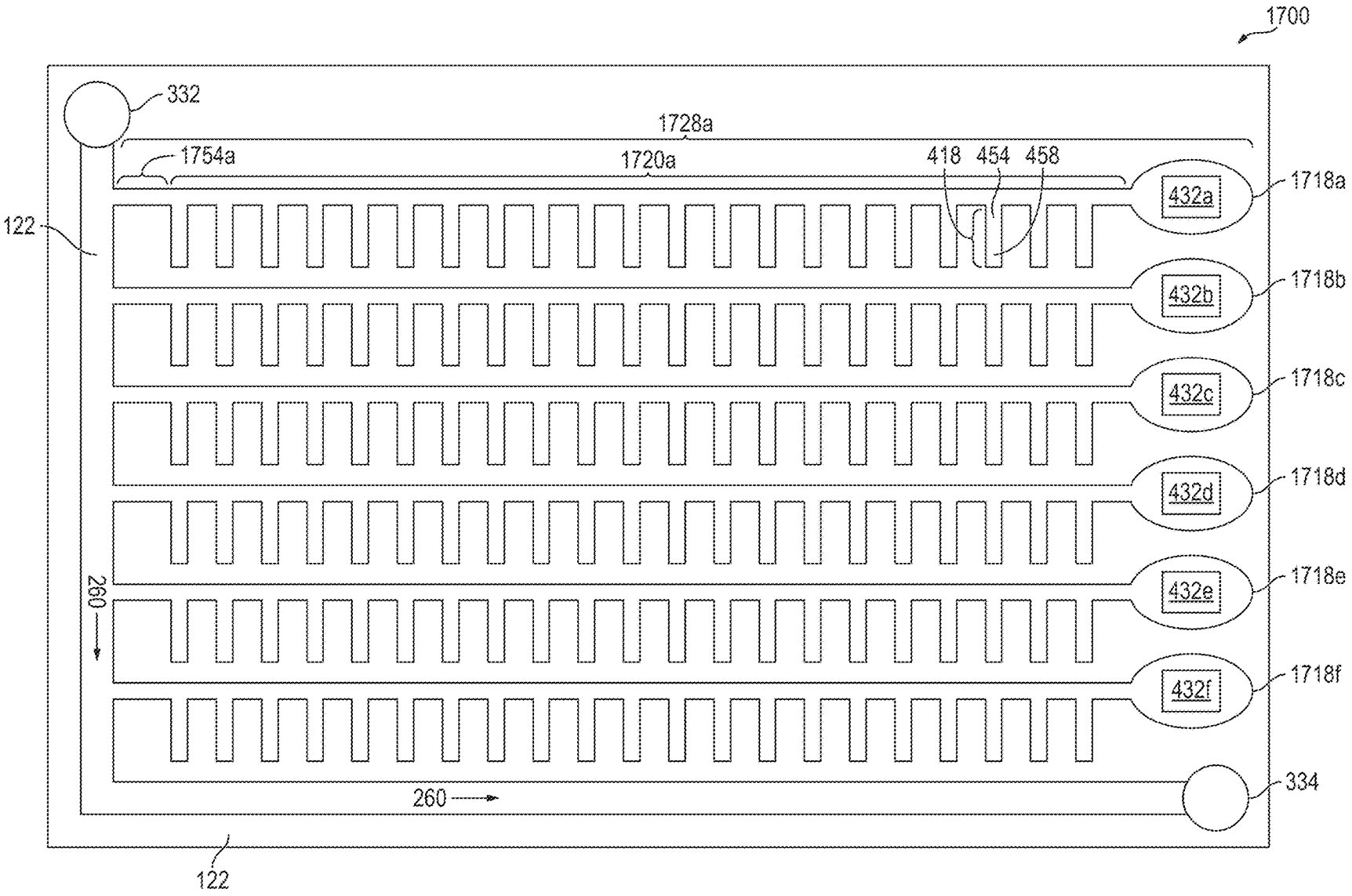
FIG. 17 shows an example of a multiplex assay device having deformable surfaces in selected microfluidic elements.
Figure 18:
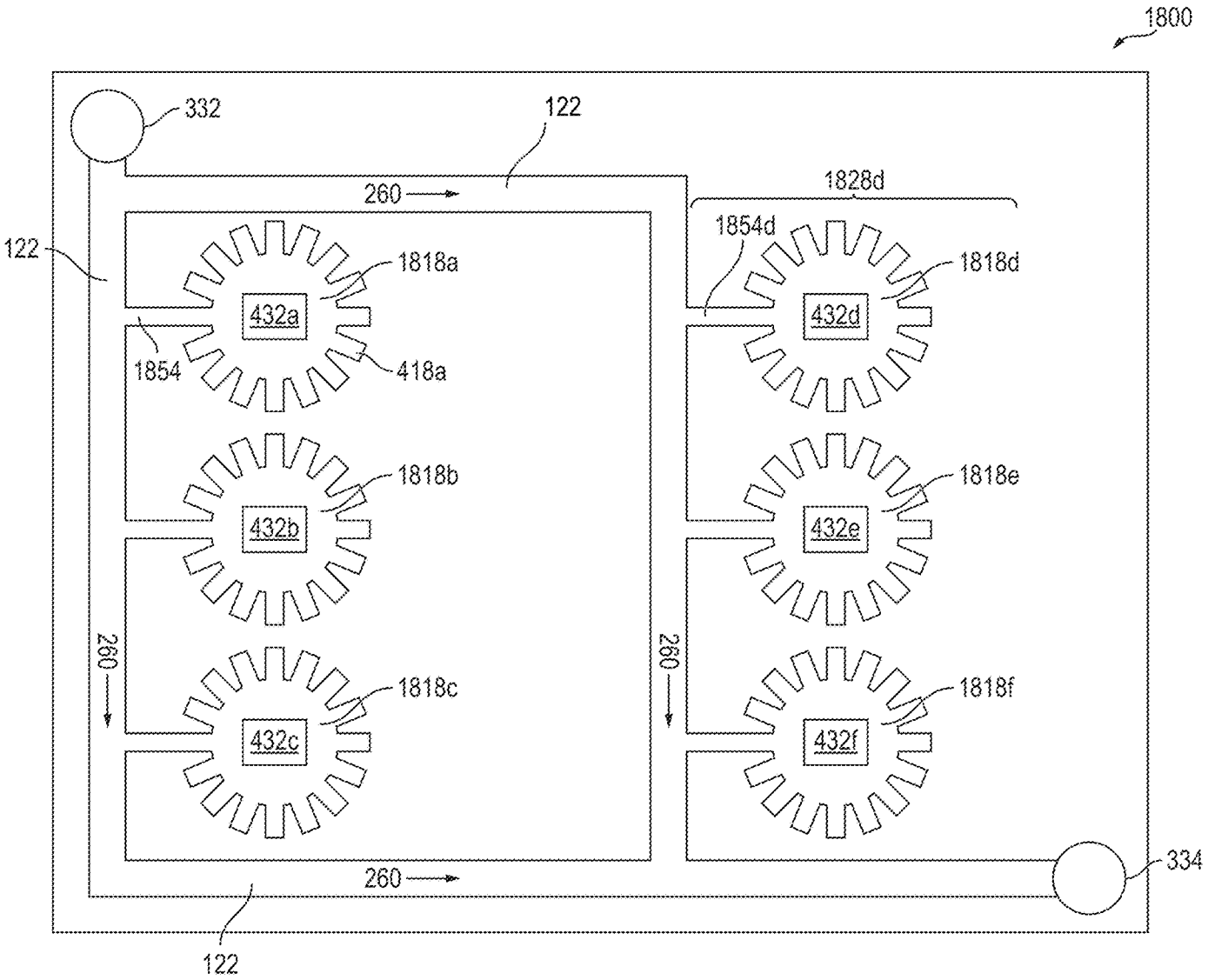
FIG. 18 shows another embodiment of a multiplex assay device having deformable surfaces in selected microfluidic elements.

In other embodiments of the microfluidic systems described herein, actuated flow of medium is capable of moving a reagent contained within the fluidic medium selectively to a location different from its starting location. The system may include at least one actuator and a microfluidic device having an enclosure which includes a flow region and a chamber configured to hold a fluidic medium, where the chamber may be an actuatable flow sector. In other embodiments, the microfluidic device may include at least two chambers, each of which can be an actuatable flow sector. The actuatable flow sector may include at least one surface that is deformable by the actuator. The microfluidic device may include any of the microfluidic circuit elements 414 described herein. Two non-limiting embodiments are illustrated in FIGS. 17 and 18. The medium 180 in the flow region may be the same or may be different from that in the actuatable flow sector. The flow region may include a flow path which may be a single flow channel 122 (FIG. 17) or may have 2, 3, 4, 5, or more split or forked flow channels (FIG. 18) traversing from inlet 332 to outlet 334. Each flow channel 122 may have one, two, three, four, five, six, seven, eight, nine, ten or more flow sectors (e.g., 1728*a-f*, 1828*a-f*), each flow sector including a flow sector connection region (e.g., 1754, 1854), a reservoir (e.g., 1718, 1818) and a plurality of sequestration pens (e.g., 418). Each flow sector 1728, 1828 may be fluidically attached to the flow channel 122 via the flow sector connector region 1754, 1854. Each of the plurality of sequestration pens 418 may open into the reservoir 1818 of the flow sector 1828 (See FIG. 18). Each actuatable flow sector (e.g., 1728) may further include an actuatable channel (e.g., 1720) that connects the reservoir (e.g., 1718) to the flow sector connector region. In some embodiments, when the flow sector (e.g., 1728) includes an actuatable channel (e.g., 1720), each of the plurality of sequestration pens 418 may open into the actuatable channel. (See FIG. 17.)

The flow sector connection region 1754, 1854 can comprise a proximal opening (e.g., 252) to the flow region/flow channel 122 and a distal opening (e.g., 256) to the reservoir (e.g., 1818) or actuatable channel (e.g. 1720), if present. The flow sector connection region 1754, 1854 can be configured, as discussed above generally for a connection region of a sequestration pen, so that a maximum penetration depth of a flow 260 of a fluidic medium 180 (not shown) flowing at a maximum velocity ($V_{max}$) in the flow region/flow channel does not extend into the reservoir or actuatable channel, if present.

The flow region/flow channel 122 can thus be a swept region, and the reservoir (e.g., 1718, 1818) and actuatable channel (e.g., 1720), if present, can be an unswept region. As long as the flow (e.g., 260) in the flow region/flow channel 122 does not exceed the maximum velocity $V_{max}$, the flow and resulting secondary flow 262 (not shown in FIGS. 17 and 18) can be limited to the flow region/flow channel 122 and the flow sector connection region(s) (e.g. 1754 or 1854) and prevented from entering the reservoir(s) or actuatable channel(s). In various embodiments, in the absence of the actuator being actuated, there is substantially no flow of medium between the flow region, which may be a flow channel, and portions of the actuatable flow sector(s), such as the reservoir(s), actuatable channel(s), and respective plurality of sequestration pens.

In some embodiments, the flow sector may further include an actuatable channel (e.g., 1720), which can connect the reservoir (e.g. 1718) to the flow sector connection region (e.g., 1754), as shown in FIG. 17. When the flow of fluidic medium in the flow region/flow channel (e.g. 122) does not exceed $V_{max}$, the actuatable channel is also an unswept region. The width of the actuatable channel may be in the range of about 50-200 microns, 50-150 microns, 50-100 microns, 70-1000 microns, 70-500 microns, 70-400 microns, 70-300 microns, 70-250 microns, 70-200 microns, 70-150 microns, 90-400 microns, 90-300 microns, 90-250 microns, 90-200 microns, 90-150 microns, 100-300 microns, 100-250 microns, 100-200 microns, 100-150 microns, or about 100-120 microns. The actuatable channel may have a height in the range of about 20-100 microns, 20-90 microns, 20-80 microns, 20-70 microns, 20-60 microns, 20-50 microns, 30-100 microns, 30-90 microns, 30-80 microns, 30-70 microns, 30-60 microns, 30-50 microns, 40-100 microns, 40-90 microns, 40-80 microns, 40-70 microns, 40-60 microns, or about 40-50 microns. The actuatable channel may be configured to have a width and a height similar to that of the flow sector connection region and/or the flow channel. Alternatively, the actuatable channel may have dimensions of width and/or height that are different from that of the flow channel or flow sector connection region. The length of the actuatable channel may be as short as 20 μm, or may be in the range of about 50 μm to about 80,000 about 50 μm to about 60,000 about 50 μm to about 40,000 about 50 μm to about 30,000 μm, about 50 μm to about 20,000 μm, about 50 μm to about 10,000 μm, about 50 μm to about 7,500 μm, about 50 μm to about 5,000 μm, about 50 μm to about 4,000 μm, about 50 μm to about 2,500 μm, about 250 μm to about 40,000 μm, about 250 μm to about 30,000 μm, about 250 μm to about 25,000 μm, about 250 μm to about 10,000 μm, about 250 μm to about 7,500 μm, about 250 μm to about 5,000 μm, about 250 μm to about 4,000 μm, about 250 μm to about 2,500 μm, about 500 μm to about 70,000 μm, about 500 μm to about 60,000 μm, about 500 μm to about 40,000 μm, about 500 μm to about 30,000 μm, about 500 μm to about 20,000 μm, about 500 μm to about 10,000 μm, about 500 μm to about 7,500 μm, about 500 μm to about 5,000 μm, about 500 μm to about 4,000 μm, about 500 μm to about 2,500 μm, or any value in between. The volume of the actuatable channel may be in the range of about $0.5\times10^6$ $\mu m^3$ to about $1.0\times10^{10}$ $\mu m^3$, about $1.0\times10^6$ $\mu m^3$ to about $1.0\times10^{10}$ $\mu m^3$, about $5.0\times10^6$ $\mu m^3$ to about $1.0\times10^{10}$ $\mu m^3$, about $1.0\times10^7$ $\mu m^3$ to about $1.0\times10^{10}$ $\mu m^3$, about $0.5\times10^6$ $\mu m^3$ to about $1.0\times10^9$ $\mu m^3$, about $1.0\times10^6$ $\mu m^3$ to about $1.0\times10^9$ $\mu m^3$, about $5.0\times10^6$ $\mu m^3$ to about $1.0\times10^9$ $\mu m^3$, about $1.0\times10^7$ $\mu m^3$ to about $1.0\times10^9$ $\mu m^3$, about $0.5\times10^6$ $\mu m^3$ to about $2.0\times10^8$ $\mu m^3$, about $1.0\times10^6$ $\mu m^3$ to about $2.0\times10^8$ $\mu m^3$, about $5.0\times10^6$ $\mu m^3$ to about $2.0\times10^8$ $\mu m^3$, about $1.0\times10^7$ $\mu m^3$ to about $2.0\times10^8$ $\mu m^3$, or any value in between.

Each sequestration pen of an actuatable flow sector may be similar to the sequestration pens described herein, having a connector region (e.g., 454) and an isolation region (e.g., 458), where the proximal end of the connector region may open to the reservoir or the actuatable channel, if present, and the distal end of the connector region opens to the isolation region of the sequestration pen. The sequestration pen may have any suitable volume as described above. Regardless of whether a sequestration pen opens to the reservoir or to the actuatable channel, if present, the isolation region of the sequestration pen is also an unswept region of the microfluidic device. Fluidic media may not flow into it, but components of fluidic medium can diffuse into the isolation region from the element that it opens to, such as the reservoir or actuatable channel. In addition, the sequestration pens may be defined, at least in part, by a deformable surface and/or may include a well, such that deformation of the deformable surface results in flow of fluidic medium (as discussed above) between the sequestration pen and the reservoir or actuatable channel.

A reservoir (e.g., 1718 or 1818) may be substantially circular or oval, as illustrated in FIGS. 17 and 18, or any other shape. Examples of such shapes include triangular, rhomboid, square, hourglass-shaped, and the like. At least a portion of one surface of the reservoir may be deformable (e.g. 432*a*-432*f*) by an actuator, and the surface may be a wall. A reservoir may be configured to contain from about $1\times10^6$ μm$^3$ to about $9\times10^{12}$ μm$^3$, about $4\times10^6$ μm$^3$ to about $1\times10^{10}$ μm$^3$, about $5\times10^6$ μm$^3$ to about $1\times10^{10}$ μm$^3$, about $1\times10^7$ μm$^3$ to about $1\times10^{10}$ μm$^3$, about $1\times10^8$ μm$^3$ to about $1\times10^{10}$ μm$^3$, or about $1\times10^8$ μm$^3$ to about $1\times10^9$ μm$^3$. In some embodiments, the reservoir may be configured to have a volume of about $1\times10^7$ μm$^3$ to about $1\times10^9$ μm$^3$, or about $1\times10^8$ μm$^3$ to about $1\times10^{10}$ μm$^3$. The volume of the reservoir may be 1, 2, 3, 4, 5, 6, 8, 9, 10, 20 or greater than 20 times the volume of the flow sector connection region and/or actuatable channel (when present). In some embodiments, the volume of the reservoir is four times the volume of the flow sector connection region and/or the actuatable channel. In other embodiments, the volume of the reservoir does not need to be as large as the volume of the flow sector connection region or actuatable channel, but may be a size which permits insertion of a hollow needle. The hollow needle may be configured to transfer fluidic media into the reservoir, the actuatable channel, when present, and the flow sector connection region.

The actuatable fluidic volume of an actuatable flow sector (e.g., the volume that may be actuated through a flow sector connection region, reservoir and actuatable channel, if present, of a flow sector) may be in a range of about $1.0\times10^6$ μm$^3$ to about $1.0\times10^{11}$ μm$^3$, about $4.0\times10^7$ μm$^3$ to about $1.0\times10^{11}$ μm$^3$, about $1.0\times10^8$ μm$^3$ to about $1.0\times10^{11}$ μm$^3$, about $1.0\times10^6$ μm$^3$ to about $1.0\times10^{10}$ μm$^3$, about $4.0\times10^7$ μm$^3$ to about $1\times10^{10}$ μm$^3$, about $1.0\times10^8$ μm$^3$ to about $1\times10^{10}$ μm$^3$, or any value in between.

There may be one, two, five, ten, fifteen or twenty actuatable flow sectors, or any desired number of flow sectors, each of which may have a flow sector connection region, a reservoir, and optionally an actuatable channel, which may open off of a flow path in a microfluidic device. Each of the flow sectors may include about 2 to about 250 sequestration pens, about 5 to about 250 sequestration pens, about 5 to about 200 sequestration pens, about 10 to about 200 sequestration pens, about 10 to about 100 sequestration pens, about 10 to about 75 sequestration pens, 20 to about 250 sequestration pens, or about 50 to about 250 sequestration pens.

The volume of fluidic medium that the enclosure of the microfluidic device may contain may be from about 100 nL to about 2 mL, about 500 nL to about 1 mL, about 500 nL to about 250 μL, about 500 nL to about 100 μL, about 1 μL to about 750 μL, about 1 μL to about 500 μL, about 1 μL to about 250 μL, about 1 μL to about 100 μL, about 5 μL to about 500 μL, about 5 μL to about 100 μL, or any value in between.

The deformable surface 432 of a reservoir (e.g., 1718 or 1818) can be deformed by the actuator 434, for instance, by pressing inward to decrease the volume in the reservoir. This action expels fluidic medium from the reservoir, flow sector connection region, and the actuatable channel, if present. Alternatively, the reservoir may be deformed by the actuator, for instance, pulling outward to increase the volume of the reservoir. This action draws fluidic medium in from the flow channel into the reservoir, flow sector connection region, and actuatable channel, if present. In this manner, the unswept regions of the reservoir and the actuatable channel can have fluidic media introduced even though these regions are not within the flow path of the microfluidic device. The amount of deflection caused by the actuator can be used to select the desired amount of volume to be expelled or drawn in by the deformation of the reservoir's deformable surface.

The microfluidic device (e.g., 1700, 1800) of the system may further include any other components as described for any microfluidic devices (e.g., 100, 200, 240, 290, 420, 1500). In some embodiments, the microfluidic device may further include a substantially non-deformable base. The microfluidic device may have a substantially non-deformable cover. The cover may have an opening that adjoins the deformable surface of the actuatable flow sector. The microfluidic device may further include a plurality of deformable surfaces, and may further have a plurality of actuators. The actuator may be a micro-actuator. If a plurality of actuators are present, some or all of the actuators of the plurality may be micro-actuators. An actuator may be configured to deform a single surface. Each deformable surface of the microfluidic device may be configured to be deformed by a single actuator. The actuator, or plurality of actuators, if present, may be configured to be integrated in the microfluidic device. The system may further include a controller configured to individually actuate and, optionally, de-actuate, said actuator or each actuator of said plurality.

In this embodiment, deformation of the deformable surface of the reservoir permits the reservoir and/or the actuatable channel, if present, to either receive or expel a selected volume of fluidic medium from or to the flow channel, respectively. In this manner, an initial volume of a first fluidic medium present in the reservoir and/or actuatable channel may be expelled to the flow channel (or pulled into the reservoir), and a volume of a different fluidic medium may be introduced to the reservoir (to mix with the first fluidic medium) and/or the actuatable channel. In such manner, fluidic media exchanges may be made selectively to one specific region (i.e., a single actuatable flow sector) of the testing chip at a time, and provide a way to exchange fluidic environments in an unswept region of the microfluidic circuit.

In other embodiments of the microfluidic system, the at least one deformable surface 432 of the reservoir (e.g., 1718 or 1818) of an actuatable flow sector may be pierceable. It may further be made of a self-sealing material. Suitable materials may include, but are not limited to, rubbers and polydimethylsiloxanes. In this embodiment, the actuator 434 may be a hollow needle. In some embodiments, the hollow needle actuator may be non-coring, thereby permitting the deformable surface to self-seal after being pierced. In other embodiments, self-healing materials may be incorporated into the deformable surface 432, which include a wide variety of polymers which may have active and responsive self-healing behaviors. The actuator, in this embodiment, may not pull the deformable surface to make fluid move into the reservoir and/or fluidic connector, but may instead pierce the deformable surface of the reservoir, and subsequently inject a new fluidic medium into or withdraw fluidic medium from the reservoir and the fluidic connector, if present. The hollow needle actuator may be connected to a source of fluidic medium and capable of replacing or withdrawing all or some of the fluidic medium present from cell loading preparation. This alternative embodiment permits the reservoir to contain significantly less volume, and thus require less space within the microfluidic device. Since the hollow needle is importing fluidic medium, the reservoir needs only to be as large as needed to securely introduce the hollow needle to import/withdraw fluidic media. In this embodiment, the reservoir may have a volume of about $1\times10^5$ $\mu m^3$ to about $1\times10^8$ $\mu m^3$, and may be no larger than about $5\times10^7$ $\mu m^3$. The volume of the reservoir in this embodiment does not need to contain multiple volumes of the fluidic connector volume as the new fluidic medium does not need to be contained within the reservoir to be deployed. This may significantly reduce the total fluidic volume of the enclosure of the microfluidic device to be in the range of about 100 nL to about 10 μL (e.g., for embodiments having about 5 to about 250 sequestration pens in each of one or more (e.g., up to ten) flow sectors, and including reservoirs and actuatable channels).

The microfluidic devices of FIGS. 17 and 18 offer multiplex opportunities for testing not previously possible. The microfluidic device may be loaded with biological cells in one or more of the sequestration pens opening to each reservoir or actuatable channel thereof. Advantageously, these microfluidic devices allow for each respective plurality of sequestration pens to have a different fluidic medium than any of the other pluralities. The fluidic medium delivered to the reservoir and/or actuatable channel via the action of deformation of the deformable surface of the reservoir (or via a needle) may be available to the biological cells in the isolation regions of sequestration pens via diffusion or forces not requiring fluid flow. The different media may include an assay reagent/reagents unique to each of the flow sectors in the microfluidic device. The reagent(s) may include soluble reagents and may further include bead based reagents.

Figure 19:
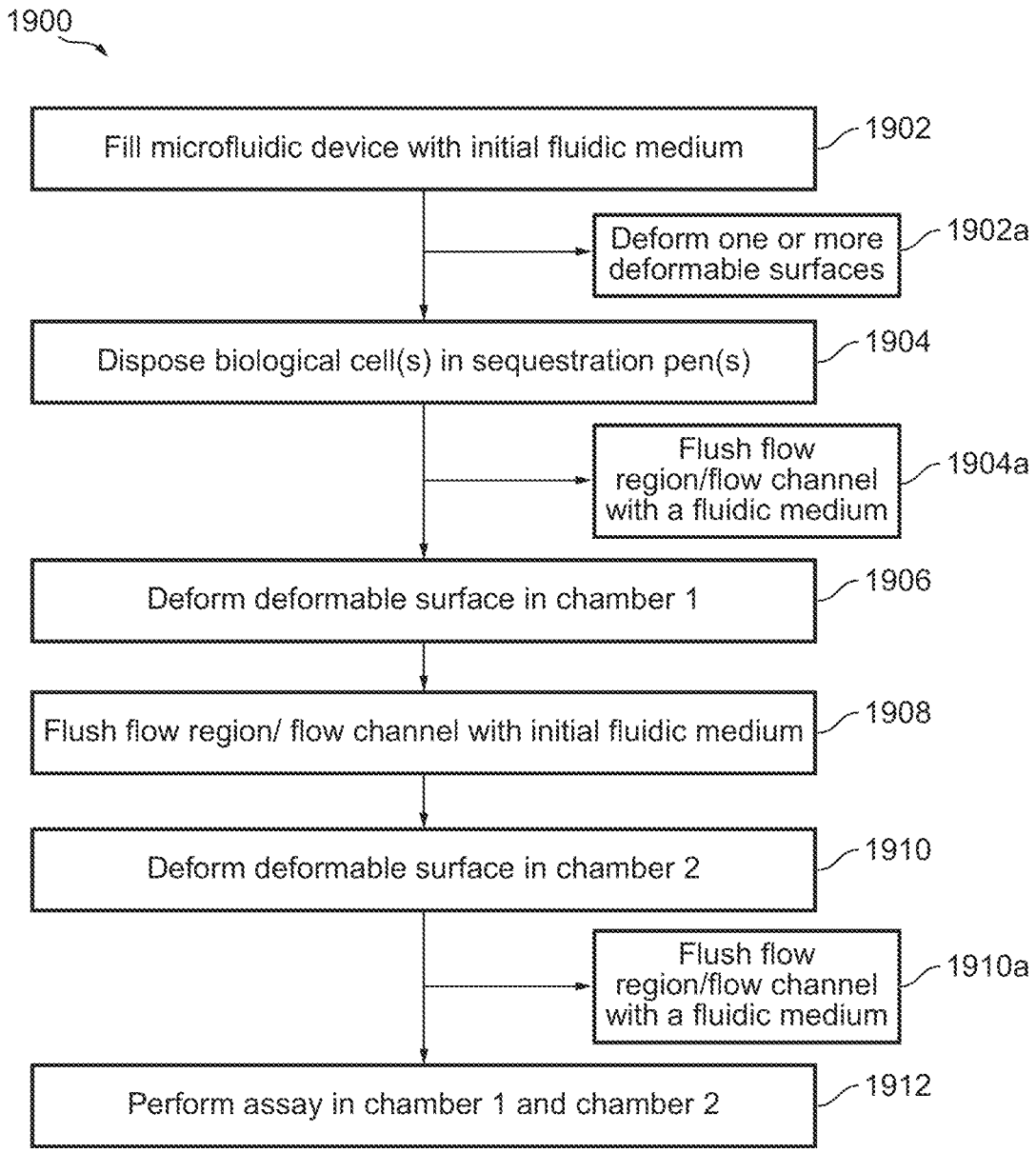
FIG. 19 illustrates a process that can be an example of operation of the microfluidic devices of FIGS. 17 and 18.

Notably, the introduction of new or different fluidic media can be performed selectively in these microfluidic devices, permitting their use as multiplex assay devices, as shown in FIGS. 17 and 18. A method of selective assay of a micro-object is illustrated in FIG. 19, and may include providing a microfluidic device including an enclosure, wherein the enclosure includes a flow region configured to contain a fluidic medium; and a first and a second actuatable flow sector configured to contain fluidic medium. The terms "first actuatable flow sector" and "second actuatable flow sector" are arbitrary labels used for clarity's sake only. The first flow sector can be any one of the actuatable flow sectors available within the microfluidic device, and can be the flow sector closest to the inlet, the second closest to the inlet, closest to the outlet, and so on. The second flow sector can be any of the flow sectors remaining after the flow sector chosen to be the first flow sector. The microfluidic device may include any number of flow sectors, as desired, such as 2, 3, 4, 5, 6, 7, 8, 9, 10, 20 or more. Each of the first and second flow sectors may be bounded at least in part by a deformable surface and may further include a respective first and second plurality of sequestration pens. Each of the first and second flow sectors may be fluidically connected to the flow region. Each of the first and second flow sectors may include a reservoir and a flow sector connection region fluidically connecting the reservoir to the flow region. At least one wall of the reservoir may include the deformable surface. The microfluidic device may further include any other component or feature described here, such as described for microfluidic devices 100, 200, 240, 290, 420, 1500, 1700, 1800.

The flow region may be configured as one or more flow channels. The flow region/flow channel(s) may be connected to an inlet where fluidic media, assay reagents and micro-objects may be input and to an outlet where any of these may be output. The first and second flow sectors, while fluidically connected to the flow region, may not be part of the flow path of the microfluidic device, and may exchange components of a fluidic medium only by diffusion, and not by fluid flow. In some embodiments, the plurality of sequestration pens of each flow sector open to the reservoir. In other embodiments, each flow sector may further include an actuatable channel, where the actuatable channel connects the reservoir to the flow sector connection region. When a flow sector includes the actuatable channel, at least some of the plurality of sequestration pens may be disposed along the actuatable channel, and the proximal openings of the connection region of such sequestration pens may open to the actuatable channel.

Prior to introduction of the fluidic medium 180, the microfluidic device may be primed with a gas such as carbon dioxide gas. The initial fluidic medium may be selected to be a fluidic medium suitable for cell growth and viability and may be present in the flow region, first and second actuatable flow sectors, and in the sequestration pens. In some embodiments, the initial fluidic medium may be present in the reservoir and sequestration pens, and a different fluidic medium may be present in the flow region/flow channel. The different fluidic medium may have the same components as the initial fluidic medium but in different proportions, or it may have additional or different components from the initial fluidic medium. Typically, the initial fluidic medium can have components that will support growth and viability of biological cells. In any case, the initial fluidic medium is introduced to the microfluidic device at step 1902. An optional step 1902*a* may be included, where one or more of the deformable surfaces of the flow sectors may be deformed to expel or import the initial medium from/into the flow sectors so deformed.

At step 1904, at least one micro-object may be disposed within at least one sequestration pen of each of the first or second plurality of sequestration pens. The at least one micro-object(s), which may include biological cells, may be introduced to the sequestration pens by any suitable means such as gravity, dielectrophoresis (which may include opto-electronic tweezers), or electro-wetting forces (such as opto-electrowetting), or localized flow actuation described herein. Biological cells that are introduced into the microfluidic device may be members of a clonal population. If all the cells introduced to the sequestration pens of every actuatable flow sector of the microfluidic device are clonal, multiplex assay may permit characterization of a plurality of traits at the same time. This can permit more accurate characterization of the cells, as they can be tested at the same point in clonal expansion, under the same general physical conditions, and can thus may yield more comparable assay results. In other embodiments of the method, the biological cells introduced into the sequestration pens of a first flow sector may be the same type of cell as those introduced into the sequestration pens of the second flow sector, but may come from a different subject. In this embodiment, the method provides higher throughput for testing many samples of the same type of biological cell or cells suspected of having similar biological activities. In other embodiments, the cells may come from a single subject, but may be different types of cells derived from, for example, a resected tumor sample or biopsy sample from a single subject.

The method also provides for an optional clearing step 1904*a*, which flushes a fluidic medium through the flow region/channel after importation of the micro-objects is complete. The fluidic medium may be the initial medium or it may be a different fluidic medium designated to be present in the flow region/flow channel during the assay step.

At step 1906, a volume of a first fluidic medium containing a first assay reagent may be introduced into the first flow sector (e.g. a reservoir, or a respective actuatable channel, if present) by deforming the deformable surface of the first flow sector (e.g., reservoir). Pulling on the deformable surface enlarges the volume in the flow sector and permits entry of the first fluidic medium into the, reservoir, and/or actuatable channel. Alternatively, the first fluidic medium may be introduced to the microfluidic device, and flowed through the flow region/flow channel prior to deforming the deformable surface of the first flow sector, decreasing the amount of flow sector enlargement necessary to introduce the first fluidic medium to the reservoir and/or actuatable channel if present. In yet another variant of the method, the deformable surface of the first flow sector may have been pushed inward by the actuator to expel a portion or all of the fluidic medium initially loaded at step 1902*a*, prior to pulling on the deformable surface of the first flow sector to import the first fluidic medium. In still other embodiments, the deformable surface of the first flow sector can be actuated (whether by pressing inward or pulling outward) and de-actuated repeatedly, or alternately pressed and pulled repeatedly, in order to introduce the first fluidic medium into the first flow sector.

Once the first fluidic medium has been introduced into the first flow sector (e.g., the reservoir and/or actuatable channel, if present), the first assay reagent can be given time to diffuse into the one or more sequestration pens (e.g., an isolation region thereof) of the first flow sector into which a micro-object has been placed.

After the first fluidic medium has been introduced into the first actuatable flow sector, any remaining amount of the first fluidic medium containing the first assay reagent may be flushed from the flow region/flow channel of the microfluidic device by flowing a different fluidic medium, which may be the initial fluidic medium or a second fluidic medium, through the flow region/flow channel at step 1908. At step 1910, the second fluidic medium containing a second assay reagent may be imported to the second flow sector, which may include importing the second fluidic medium to the reservoir and/or actuatable channel, if present, by deforming the deformable surface of the second flow sector, using any of the variations described for the first flow sector. The introduction of the first assay reagent in the first fluidic medium and the second assay reagent in the second fluidic medium to the first flow sector and the second flow sector respectively may be performed sequentially. The second assay reagent may be given time to diffuse into the second plurality of sequestration pens in the second flow sector. After introduction of the first assay reagent in the first fluidic medium to the first flow sector and the second assay reagent in the second fluidic medium to the second flow sector, the flow region/flow channel may be cleared of any assay reagent(s) by flushing with yet another fluidic medium, which may be the initial fluidic medium or may be a third fluidic medium selected to be present during the assay step.

The first assay reagent(s) and/or the second assay reagent (s) may each diffuse within a predetermined time into the respective one or more sequestration pens where micro-object(s) are located within each of the first and the second actuatable flow sectors. A first assay may be performed upon the micro-object located within the sequestration pens of the first flow sector, and a second assay may be performed upon the one micro-object in the sequestration pens of the second flow sector. The first and second assays can comprise detecting an interaction between the first assay reagent(s) and any micro-objects (or secretions thereof) loaded into the first flow sector and between the second assay reagent(s) and any micro-objects (or secretions thereof) loaded into the second flow sector, respectively. The first assay reagent(s) may be different from the second assay reagent(s). The first and/or the second assay reagent may further include beads or one or more bead-based reagents. The results of the first assay and/or the second assay may be used to determine whether additional biological cells in sequestration pens associated with a third (or fourth, fifth, sixth, etc.) actuatable flow sector are tested with the first or second assay reagents, or tested with a third (or fourth, fifth, or sixth, etc.) assay reagent in a respective fluidic medium. Alternatively, the biological cells in the plurality of sequestration pens in the first actuatable flow sector and/or the biological cells in the plurality of sequestration pens in the second flow sector may be tested with a third (fourth, fifth, sixth, etc.) assay reagent depending on the results of the first assay and/or the second assay. Based on the results of the assay(s), selected cells may be exported out of the microfluidic device by any suitable method, including the localized flow methods described herein, including but not limited to fluidic flow, gravity, actuated localized fluid flow, manipulation of the cells (using DEP, OET, or OEW), or by piercing a deformable surface with a hollow needle and extracting the selected cell.

A variation of the method may be performed using a microfluidic device having deformable surfaces that are pierceable, and optionally, self-sealing. The step of deforming said deformable surface may include piercing with a hollow needle the deformable surface of an actuatable flow sector, which may be a reservoir. The hollow needle may be non-coring. Once the hollow needle has been inserted into the flow sector/reservoir, a fluidic medium containing one or more assay reagents may be introduced into the flow sector via the hollow needle, which may be connected to a source of the fluidic medium. A quantity of the fluidic medium containing the assay reagent(s) can be injected sufficient to expel, and replace all of the initial fluidic medium disposed in the reservoir, flow sector connection region and actuatable channel of the flow sector, and be replaced by the fluidic medium containing the assay reagent(s). Sufficient fluidic medium may be injected to exit the flow sector connection region and enter the flow region. Each actuatable flow sector along the flow region may have a fluidic medium having a different assay reagent composition. The step of piercing and injecting the fluidic medium having assay reagent(s) may be performed in parallel for all of the flow sectors along a flow region. In some embodiments, the introduction of fluidic media containing assay reagents may be performed substantially simultaneously. However, actuation and introduction of fluidic media may instead be performed sequentially, irregularly, or in any combination desired. Since the newly introduced fluidic media are contained in each flow sector's reservoir, actuatable channel, and flow sector connection region and cannot flow into the regions of another flow sector, cross contamination may not be of any substantial concern. Additionally, using the deformable surface as an import site for fluidic media reduces the amount of flushing needed when importing fluidic media containing assay reagent(s), and steps 1904*a*, 1908, and/or 1910*a* may be skipped. In other alternatives, fluidic media may be pulled through the reservoir and removed from the microfluidic device by withdrawing fluidic medium through the hollow needle once the deformable surface has been pierced, and thus drawing corresponding fluidic medium into each of the activatable flow sectors. The introduction of the first medium, second medium, etc., may be performed sequentially and/or independently of each other. After introduction of the first medium, second medium, etc., the assaying steps may be performed as described above.

In yet another variation, the method of importing fluidic media into an actuatable flow sector may be performed with a microfluidic system having at least one actuator and a microfluidic device having an enclosure including a flow region and one actuatable flow sector. The actuatable flow sector may be fluidically connected to the flow region, and the flow sector is bounded at least in part by a deformable surface. The flow sector also includes a plurality of sequestration pens. At least one micro-object may be disposed in at least one of the sequestration pens. The deformable surface of the flow sector may be deformed, thereby importing a volume of a first fluidic medium containing a first assay reagent to the flow sector. The first assay reagent may diffuse into said plurality of sequestration pens in the flow sector; and the first assay may be performed upon the micro-object. The microfluidic device may be configured as any microfluidic device described here, and may therefore include any components of the devices containing multiple actuatable flow sectors described above (e.g., microfluidic device 1700, 1800, which may further include any of the microfluidic elements described for devices 100, 200, 240, 290, 420, 1500). Importing the volume of the first fluidic medium containing the first assay reagent to the flow sector may further include replacing the initial fluidic medium in the actuatable channel with the first fluidic medium. The deformable surface of the flow sector may be pressed to expel a volume of said initial fluidic medium prior to deforming the deformable surface of the flow sector to import the first fluidic medium. The fluidic medium containing the first assay reagent may be flushed with any fluidic medium suitable for clearing the first assay reagent from the flow. After the first assay has been performed on the micro-object, yet another fluidic medium containing a second assay reagent may be introduced in to the same flow sector, similar to the introduction of the first assay reagent (without removing the first assay reagent). Deforming the deformable surface may be performed as described above, with the actuator either pushing or pulling on the deformable surface. Alternatively, the actuator may pierce a pierceable deformable surface with a hollow needle thereby importing or withdrawing a volume of any of the fluidic media.

Although specific embodiments and applications of the invention have been described in this specification, these embodiments and applications are exemplary only, and many variations are possible.

We claim:

1. A process of moving a micro-object in a microfluidic device of a microfluidic system comprising an actuator and the microfluidic device, wherein the microfluidic device comprises an enclosure comprising:

a flow region with a channel for containing a fluidic medium; and a chamber for containing the fluidic medium and fluidically connected to the flow region, wherein the chamber contains a sequestration pen comprising:

an isolation region;

a connection region fluidically connecting the isolation region with the channel; and a well region comprising a deformable surface that is disposed above the well region, wherein the well region is fluidically connected to the isolation region, the process comprising:

disposing a fluidic medium containing the micro-object in the enclosure within the microfluidic device; and actuating the actuator to deform the deformable surface at a location proximal to the micro-object, thereby causing a flow of the fluidic medium within the enclosure; and wherein the flow is of sufficient magnitude to move the micro-object from the flow region to the chamber, or from the chamber to the flow region.

2. The process of claim 1, wherein:

the disposing comprises disposing the fluidic medium containing the micro-object in the channel such that the micro-object is located in the channel, proximal to the connection region of the sequestration pen; and the actuating causes a flow of the fluidic medium from the channel into the isolation region of the sequestration pen, thereby transporting the micro-object from the channel into the isolation region.

3. The process of claim 1, wherein the disposing comprises disposing the fluidic medium containing the micro-object in the chamber, such that the micro-object is located in the isolation region, proximal to the connection region of the sequestration pen; and the actuating causes a flow of the fluidic medium from the well region into the isolation region of the sequestration pen, thereby transporting the micro-object from the isolation region into the connection region or the channel.

4. The process of claim 1, wherein the actuating comprises actuating a plurality of actuators.

5. The process of claim 4, wherein the plurality of actuators are actuated substantially simultaneously.

6. The process of claim 1, wherein the micro-object is a biological cell.

7. The process of claim 1, wherein the deforming the deformable surface comprises pressing the deformable surface inward.

8. The process of claim 1, wherein deforming the deformable surface comprises pulling the deformable surface outward.

9. The process of claim 1, wherein the microfluidic device comprises multiple chambers, each chamber containing a sequestration pen comprising an isolation region, connection region, and well region.

10. The process of claim 7, wherein pressing the deformable surface inward decreases the volume of the fluidic medium in the vicinity of the deformable surface.

11. The process of claim 8, wherein pulling the deformable surface outward decreases the volume of the fluidic medium in the vicinity of the deformable surface.

12. The process of claim 1, wherein in the absence of the actuator being actuated, there is substantially no flow of the fluidic medium.

13. The process of claim 4, wherein each actuator in the plurality of actuators is individually controllable to move from an un-actuated position to an actuated position.

14. The process of claim 1, wherein the channel further comprises a deformable surface with an actuator located above the deformable surface.

15. The process of claim 13, wherein the channel further comprises multiple deformable surfaces with an actuator located above each deformable surface.

16. The process of claim 1, wherein the microfluidic device further comprises a fluidic connector connecting the well region to the isolation region of the chamber.

17. The process of claim 16, wherein at least a portion of the fluidic connector is aligned with at least a portion of the connection region, such that displacement of fluid in the well region directly results in displacement of fluid in the isolation region.

18. The process of claim 1, wherein a volume of the well region is at least 5.0×10^5 cubic microns.

19. The process of claim 1, wherein a volume of the well region is less than or equal to 1.0×10^8 cubic microns.

20. The process of claim 1, wherein a volume of the well region is at least 2 times greater than a volume of the isolation region.

* * * * *